US007766024B2

(12) United States Patent
Rottmann

(10) Patent No.: US 7,766,024 B2
(45) Date of Patent: Aug. 3, 2010

(54) TENT FRAME AND CANOPY

(76) Inventor: Andrew A. Rottmann, 15 Wertheim Court, Suite 509, Richmond Hill, ON (CA) L4B 3H7

( * ) Notice: Subject to any disclaimer, the term of this patent is extended or adjusted under 35 U.S.C. 154(b) by 124 days.

(21) Appl. No.: 12/216,284

(22) Filed: Jul. 2, 2008

(65) Prior Publication Data

US 2008/0264462 A1 Oct. 30, 2008

Related U.S. Application Data

(63) Continuation-in-part of application No. 11/642,548, filed on Dec. 21, 2006, now Pat. No. 7,575,010, which is a continuation-in-part of application No. 10/944,178, filed on Sep. 20, 2004, now Pat. No. 7,185,667.

(51) Int. Cl.
*E04H 15/42* (2006.01)
*E04H 15/34* (2006.01)

(52) U.S. Cl. ..... 135/156; 135/123; 135/122; 135/908

(58) Field of Classification Search ..... 135/121–123, 135/143–144, 151, 156, 908; 52/79.5, 80.2, 52/81.1, 83, 644–645
See application file for complete search history.

(56) References Cited

U.S. PATENT DOCUMENTS

| | | | | |
|---|---|---|---|---|
| 1,202,475 | A | 10/1916 | Brent | |
| 1,839,076 | A | 12/1931 | Adams | |
| 1,846,305 | A | 2/1932 | Brooks | |
| 2,140,220 | A | 12/1938 | Colvin, Jr. | |
| 2,187,436 | A * | 1/1940 | Thofehrn et al. | 135/122 |
| 2,440,557 | A | 4/1948 | Power | |
| 2,509,759 | A | 5/1950 | Church | |
| 2,677,384 | A * | 5/1954 | Luisada | 135/123 |
| 2,704,522 | A * | 3/1955 | Frieder et al. | 52/641 |
| 3,095,069 | A * | 6/1963 | Winkler | 135/123 |
| 3,424,178 | A | 1/1969 | Yazaki | |
| 3,468,321 | A | 9/1969 | Thompson | |
| 3,510,996 | A | 5/1970 | Popil | |
| 3,643,391 | A | 2/1972 | Mollinger | |
| 3,670,747 | A | 6/1972 | Pohl | |
| 3,699,986 | A | 10/1972 | Kirkham | |
| 3,874,396 | A | 4/1975 | Kirkham | |

(Continued)

FOREIGN PATENT DOCUMENTS

| | | |
|---|---|---|
| CA | 2520049 | 3/2006 |

(Continued)

*Primary Examiner*—David Dunn
*Assistant Examiner*—Tania Abraham

(57) ABSTRACT

A tent frame comprising support frames having side support and roof support members. Spans of the support frames are adjustable perpendicular to a ridge line of the tent frame without substituting structural members of different length. The tent frame is laterally adjusted by adding or removing support frames or by altering the distance between individual support frames. The tent frame is adaptable on uneven terrain and is capable of following irregular ground contour without delay in erection or changes in length and details in the structural members. A canopy can be provided overtop of the tent frame, or on the inside of the tent frame so that adjustments to the span do not require adjustment to the canopy size. The canopy is removably attached to the frame to cover the whole area or only partially cover the area under the tent, or can be removed fully.

29 Claims, 39 Drawing Sheets

U.S. PATENT DOCUMENTS

| | | | |
|---|---|---|---|
| 3,909,993 | A | 10/1975 | Huddle |
| 3,986,519 | A | 10/1976 | Gillis |
| 4,099,533 | A | 7/1978 | Gillis |
| 4,175,305 | A | 11/1979 | Gillis |
| 4,193,413 | A | 3/1980 | Watts et al. |
| 4,265,259 | A | 5/1981 | Gillis |
| 4,265,260 | A | 5/1981 | Gillis |
| 4,308,647 | A | 1/1982 | Gillis |
| 4,414,993 | A | 11/1983 | Gillis |
| 4,509,879 | A | 4/1985 | Pearce |
| 4,667,692 | A | 5/1987 | Tury et al. |
| 4,715,598 | A | 12/1987 | Knight |
| 4,982,534 | A | 1/1991 | Saitoh et al. |
| 5,234,011 | A | 8/1993 | Lynch |
| 5,261,436 | A | 11/1993 | Funk |
| 5,345,962 | A | 9/1994 | Moss |
| 5,381,634 | A | 1/1995 | Pietrogrande et al. |
| 5,485,863 | A | 1/1996 | Carter |
| 5,490,533 | A | 2/1996 | Carter |
| 5,632,292 | A | 5/1997 | Carter |
| 5,638,848 | A | 6/1997 | November |
| 5,692,534 | A | 12/1997 | Brumfield |
| 5,813,425 | A | 9/1998 | Carter |
| 6,012,505 | A | 1/2000 | Wurz et al. |
| 6,129,102 | A | 10/2000 | Carter |
| 6,145,527 | A | 11/2000 | Gillis |
| 6,148,835 | A | 11/2000 | Rhee |
| 6,412,507 | B1 | 7/2002 | Carter |
| 6,463,948 | B2 | 10/2002 | Lee |
| 6,470,901 | B1 | 10/2002 | Scherer |
| 6,523,558 | B1 | 2/2003 | Gillis |
| 6,546,988 | B2 | 4/2003 | Stahl |
| 6,564,817 | B1 | 5/2003 | Tseng |
| 6,925,762 | B2 | 8/2005 | Halford |
| 7,185,667 | B2 | 3/2007 | Rottmann |
| 2002/0066239 | A1 | 6/2002 | Gillis |
| 2006/0081282 | A1 | 4/2006 | Rottmann |
| 2007/0095376 | A1 | 5/2007 | Rottmann |

FOREIGN PATENT DOCUMENTS

| | | |
|---|---|---|
| CA | 2579590 | 6/2008 |

* cited by examiner

TENT FRAME AND CANOPY

RELATED APPLICATIONS

This application is a continuation-in-part of U.S. patent application Ser. No. 11/642,548, entitled "Tent Frame and Canopy", filed Dec. 21, 2006 now U.S. Pat. No. 7,575,010 as a continuation-in-part of U.S. patent application Ser. No. 10/944,178, entitled "Tent Frame and Canopy", filed Sep. 20, 2004, now U.S. Pat. No. 7,185,667 issued Mar. 6, 2007, and which claims the benefit under 35 U.S.C. 120 to U.S. patent application Ser. No. 10/944,178, filed Sep. 20, 2004, and U.S. patent application Ser. No. 11/642,548, filed Dec. 21, 2006.

SCOPE OF THE INVENTION

The present invention relates to a tent, and particularly, a structural tent frame that includes a number of adjustable support frames which may be located at a range of relatively spaced positions to form a sheltered enclosure which is adjustable in width, length and/or height, depending on desired needs.

BACKGROUND OF THE INVENTION

For many years tents have been used to provide shelter for purposes ranging from sleeping quarters to carnival shows. Some tents used for outdoor camping, such as "dome tents", use flexible segmented members to form a frame that is easy to set up and dismantle by a user, and is also compact for storage. However, the tent frame members traditionally used with these tents are smaller in size and do not provide sufficient structural strength to endure both static and dynamic loading to a canopy which covers a larger area.

Conventional tents that are used to cover larger areas, such as pools, or which can be used to provide shelter for large outdoor gatherings and shelter for the military are characterised by a structural frame and a cover to provide shelter under the structural frame. The structural frame of these tents generally comprises structural members that are rigid and sized to be sufficiently strong to endure greater loading associated with covering a larger area. However, such structural frames are comprised of structural members of a predetermined dimension to provide a tent of a predetermined size. Typically, the structural members are fixed together using rigid connections to lock the structural members in a defined configuration. Because of the sizing of the structural members and the rigid fixing of such members together, these conventional tents do not provide the ability to vary the area to be covered without substituting a different set of structural members that are longer or shorter.

Also, the cover used to provide shelter for the area under the tent frame is generally sized to be placed over the tent frame. Conventional covers must be sized specifically for the dimension of the tent frame to provide a tensioned cover fitted over the tent frame.

SUMMARY OF THE INVENTION

Accordingly, it is an object of this invention to at least partially overcome the disadvantages of the prior art and to provide a tent that incorporates a tent frame that can easily be adjusted in length or width without requiring the substitution of structural members of a different dimension. Optionally, a canopy can be advantageously suspended or otherwise provided on the inside of the frame so that one canopy size fits adjusted dimensions of the tent.

In a simplified construction, the tent frame of the present invention comprises one or more support frames, each having a side support and roof support. The side support and roof support have structural members that are pivotally connected such that two or more individual support frames can be coupled together to form one or more support trusses which have adjustable spans by altering the pitch of the roof supports and without substituting structural members of a different length.

It is another object of this invention to provide a tent frame having a number of laterally aligned support trusses which consist of pairs of connected support frames. The overall length of the tent can be adjusted in dimension by adding or removing support trusses, or by adjusting the lateral distance between adjacent support trusses. More preferably, the width of the tent is adjustable by altering the span of an individual support truss by selectively varying the distance between the individual support frames.

To achieve at least some of these objects, the present invention provides a tent frame which, for example, may be used in conjunction with a tarp, canvas or other suitable material to form a tent that is adjustable in length, width and height.

In a simplified planar construction, the tent frame includes a support frame having a rigid side support member and a rigid roof support member. In assembly, an upper end of the rigid side support member is pivotally coupled to a distal end of the rigid roof support member. The rigid side support member is positionable in a substantially vertical orientation with the rigid roof support member positionable at an angle to the rigid side support member. By orienting the rigid side support member and the rigid roof support member in this configuration, the support frame has an acute angle side and an obtuse angle side.

A first tension member is provided at the obtuse angle side. In assembly, the first tension member has one end fixed to a proximal end of the rigid roof support member and the other end fixed to a lower end of the side support member. The first tension member is positioned at the obtuse angle side and deflected over a first end portion of a rigid first link member. The first link member is coupled to the upper end and the distal end at a second end portion of the first link member.

By this construction, the adjustment of the length of the first tension member permits vertical adjustment in height of the proximal end of the rigid roof support member.

In a preferred construction, a second tension member is positioned at the acute angle side and has one end fixed to the proximal end of the roof support member and the other end fixed to the lower end of the side support member. A second link member is provided with a first end coupled proximate to the pivotal coupling of the upper end and the distal end, and a second end of the second link member has a tension member deflector positioned thereon. The length of the second tension member can be adjusted to permit the vertical adjustment in height of the proximal end of the rigid roof support member. The lengths of the first and second tension members can be adjusted together to achieve a change in height and/or span of the tent frame.

In a more preferred construction, the rigid side support member and/or rigid roof support member is adjustable in length so as to permit adjustment in the vertical height of the upper end and the pitch of the roof support member of the tent frame.

In a more preferred construction, the tent includes a tent frame which consists of a number of longitudinally extended support trusses. Each support truss consists of two support frames which are pivotally coupled together at their respective proximal ends of the roof support members, and with the roof support members of each support frame positioned and pivotal in a substantially co-planar alignment. The two support frames so connected form a support truss which is symmetrical or nearly symmetrical about its centre and the support truss spans a longitudinal distance in the direction of elongation of the roof support members. This longitudinal distance can be adjusted to alter the area under the support truss. The mutual adjustment in length of respective first and second tension members permits the vertical adjustment in the position of a respective proximal end of the roof support member coupled thereto. This results in a change in the pitch of the respective roof support members and a corresponding rise or lowering of the proximal ends of the respective roof support members, which raises or lowers the overhead clearance of the support truss.

In another construction, a plurality of support trusses can be positioned adjacent to each other and spaced a lateral distance apart. For increased stability, the support trusses are preferably provided in an orientation that is substantially parallel to both each other and to a substantially co-planar alignment of the roof support members of each support truss. Adjacent support trusses can be attached together using rigid bars, poles or other suitable attachment means, or by coupling to a tensioned cable or rope which extends between two or more adjacent support trusses. Rigid bars may be pivotally attached horizontally between adjacent support trusses, and are aligned substantially perpendicular to the longitudinal axis of the support trusses. Such rigid bars have one end attached to a support frame of a support truss, at a position proximate to the upper end of a side support member, and the other end attached at a position proximate to the upper end of a side support member of a respective support frame of an adjacent support truss. With respect to two adjacent support trusses, two such rigid bars may be pivotally attached substantially perpendicular to the longitudinal axis of the support trusses, proximate to each upper end of each side support member of each respective support frame. A similar rigid bar may be pivotally attached between adjacent support trusses, at a position proximate to the proximal ends of the roof support members of each support frame, so as to be substantially perpendicular to the longitudinal axes of the adjacent support trusses.

It is yet another object of this invention to provide a tent frame that is stable on uneven ground. By the construction of the tent frame, adjacent support trusses are positioned relative to each other and accommodate surface variations of the ground and the tent remains functional without changing the constituent framing members and the suspended canopy. The built in flexibility of the design is advantageous under adverse conditions.

In another construction, a tent frame incorporates two or more support frames which are pivotally coupled together at their respective proximal ends of the roof support members, and with the distal ends of the roof support members spaced at a distance from each other. Such a retractable tent frame could, for example, be used in the erection of a tent having a generally square, rectangular, or polygonal outer circumferential plan.

In a further simplified planar construction, the tent frame includes a support frame which has a side support and roof support. The side support comprises at least one elongated inner side support member and an extensible outer side support member. In assembly, the inner side support member extends from a lower member end to an upper member end. The outer side support member is similarly elongated between a lower and upper end, and more preferably is adjustable in length between a retracted position, wherein the outer side support member has a length selected less than a length of the inner side support member, and an extended position, wherein the outer side support member has a length selected greater than the length of the inner side support member. Each of the lower member end and the lower end are pivotally coupled together, so that the upper member end of the inner side support member and the upper end of the outer side support member can be displaced with respect to each other at a selected distance.

The roof support similarly includes at least one elongated lower roof support member which extends from a respective proximal member end to a distal member end, and an upper roof support member extending from a proximal end to a distal end. Each of the proximal end and proximal member end are pivotally coupled together, so that the distal member end of the lower roof support member and the distal end of the upper roof support member can be displaced with respect to each other at a selected distance.

In this simplified construction, the side support and roof support are pivotally connected together by at least one rigid connecting bar or other suitable linking member elongated between a first end portion and a second end portion. The first end portion of the link member is pivotally coupled to each of the upper end of the extensible outer side support member and the distal end of the upper roof support member. The second end portion of the link member is pivotally coupled to each of the upper member end of the inner side support member and the distal member end of the lower roof support member.

By this construction, the adjustment of the length of the extensible outer side support member, between retracted and extended positions, permits the vertical adjustment in the height of the proximal end of the upper roof support member and proximal member end of the lower roof support member to adjust the overall ridge height of the tent and any canopy attached to the tent.

In a more preferred construction, the tent includes a tent frame which consists of a number of longitudinally extended support trusses. Each support truss consists of two support frames which are pivotally coupled together at their respective proximal ends of the upper roof support members, and with the upper roof support members of each support frame positioned and pivotal in a substantially co-planar alignment. The two support frames so connected form a support truss which is symmetrical or nearly symmetrical about its centre and the support truss spans a longitudinal distance in the direction of elongation of the upper roof support members. This longitudinal distance can be adjusted to alter the area under the support truss. The adjustment of a respective extensible outer side support member between retracted and extended positions permits the vertical adjustment in the position of a respective distal end of the upper roof support member coupled thereto. This results in a change in the vertical pitch of the respective upper roof support members and a corresponding deflection in the upper ends of the respective outer side support members, which raises or lowers the overhead clearance of the support truss.

In another construction, a plurality of support trusses can be positioned adjacent to each other and spaced a lateral distance apart. For increased stability, the support trusses are preferably provided in an orientation that is substantially parallel to both each other and to a substantially co-planar alignment of the upper roof support members of each support truss. Adjacent support trusses can be attached together using rigid bars, poles or other suitable attachment means, or by coupling to a tensioned cable or rope which extends between two or more adjacent support trusses. Rigid bars may be pivotally attached horizontally between adjacent support trusses, and are aligned substantially perpendicular to the longitudinal axis of the support trusses. Such rigid bars have one end attached to a support frame of a support truss, at a position proximate to the upper member end of an inner side support member, and the other end attached at a position proximate to the upper member end of an inner side support member of a respective support frame of an adjacent support truss. With respect to two adjacent support trusses, two such rigid bars may be pivotally attached substantially perpendicular to the longitudinal axis of the support trusses, proximate to each upper member end of each inner side support member of each respective support frame. A similar rigid bar may be pivotally attached between adjacent support trusses, at a position proximate to the proximal ends of the upper roof support members of each support frame, so as to be substantially perpendicular to the longitudinal axes of the adjacent support trusses.

It is yet another object of this invention to provide a tent frame that is stable on uneven ground. By the construction of the tent frame, adjacent support trusses are positioned relative to each other and accommodate surface variations of the ground and the tent remains functional without changing the constituent framing members and the suspended canopy. The built in flexibility of the design is advantageous under adverse conditions.

In another construction, a tent frame incorporates two or more support frames which are pivotally coupled together at their respective proximal ends of the roof support members, and with the distal ends of the upper support members spaced at a distance from each other. Such a retractable tent frame could, for example, be used in the erection of a tent having a generally square, rectangular, or near polygonal outer circumferential plan.

In a preferred construction, a canopy is provided on either the inside or over top of the tent frame according to any of the previous mentioned constructions. Providing a canopy on the inside of the tent frame is advantageous as an adjustment to the span of a support frame of the tent frame does not require a subsequent adjustment to the canopy size. The canopy can be attached to the tent frame using hangers, clips or other suitable pivoting attachments that allow for alignment and/or repositioning of the canopy for different span adjustments of a support frame of a tent.

In one aspect, the present invention provides a tent frame comprising at least one support frame, each said support frame including: a side support having first and second rigid side support members, each of said side support members being elongated between a respective lower member end and an upper member end, and a central support member being elongated between a lower end and an upper end and being adjustable in length between a retracted position and an extended position, said central support member being positionable at a location interposed between said first and second side support members, each lower member end of said first and second side supports and the lower end of said central support member being pivotally coupled together; a roof support having first and second roof support members, each of said first and second roof support members being elongated between a respective proximal member end and a distal member end, and a central roof support member being elongated between a proximal end and a distal end, said central roof support member being positionable at a location interposed between said first and second roof support members, each proximal member end of said first and second roof support members and the proximal end of said central roof support being pivotally coupled together; first and second rigid coupling members, each coupling member being elongated between a respective first end portion and a second end portion, and each of the upper end, the distal end and each first end portion of said first and second coupling members being pivotally coupled to each other, the second end portion of said first coupling member being pivotally coupled to each of the upper member end of said first side support member and the distal member end of said first roof support member, and the second end portion of said second coupling member being pivotally coupled to each of the upper member end of said second side support member and the distal member end of said second roof support member, wherein the retraction or extension of said central support member permits vertical adjustment in the position of the distal end of the central roof support member.

In another aspect, the present invention provides a tent frame comprising a support truss having at least one pair of connected support frames, each said support frame including: a side support having first and second side support poles, each of said first and second side support poles being elongated between a respective lower end and an upper end, and a central telescoping member being elongated between a lower support end and an upper support end, the central telescoping member being adjustable in length between a retracted position and an extended position, said lower support end being interposed between and pivotally coupled to each lower end of said first and second side support poles; a roof support having first and second roof poles, each of said first and second roof poles having a substantially identical longitudinal length and being elongated between a respective proximal end and a distal end, and a central support pole being elongated between a proximal support end and a distal support end, the central support pole having a longitudinal length selected greater than the length of the first and second roof poles, and said proximal support end being interposed between and pivotally coupled to each proximal end of said first and second roof poles to form a roof coupling joint with the distal support end being selectively pivotally moveable relative to each distal end of each said first and second roof poles; first and second rigid bracing members, each bracing member being elongated between a respective first end portion and a second end portion, and each of the upper support end, the distal support end, and the first end portions of each said first and second bracing members being coupled for pivotal movement relative to each other, the second end portion of said first bracing member being pivotally coupled to each of the upper end of said first side support pole and the distal end of said first roof pole, and the second end portion of said second bracing member being pivotally coupled to each of the upper end of said second side support pole and the distal end of said second roof support pole, wherein each of said pair of connected support frames is pivotally connected to each other proximate to each said roof coupling joint, with the respective central support poles of each said support span extending in a substantially co-planar alignment.

In another aspect, the present invention provides a tent frame comprising a plurality of connected support trusses, at least one of said plurality of support trusses being displaced laterally from and having a longitudinal axis substantially parallel to a longitudinal axis of an adjacent one of said plurality of support trusses, each said support truss further comprising a pair of connected support frames, each including: a side support having first and second elongated rigid side support rods, each of said first and second side support rods having a substantially equal longitudinal length and being elongated between a respective lower end and an upper end, and an extensible central member being elongated between a lower support end and an upper support end, said extensible central member being adjustable in length between a retracted position, wherein said extensible central member has a length selected less than the length of said first and second side support rods, and an extended position, wherein said extensible central member has a length selected greater than the length of said first and second side support rods, and the lower support end being interposed between and pivotally coupled to each of the lower ends of said first and second side support rods; a roof support having first and second roof support rods, each of said first and second roof support rods being elongated between a respective proximal end and a distal end, a central roof rod being elongated between a proximal support end and a distal support end, the proximal support end being interposed between and pivotally coupled to each of the proximal ends of said first and second roof support rods so as to be pivotally movable relative thereto in a longitudinal plane of said support frames, the proximal support end and each of the proximal ends of said first and second roof support rods defining a roof coupling joint; first and second rigid coupling arms, each coupling arm being elongated between a respective first end portion and a second end portion, and each of said upper support end and said distal support end being pivotally coupled to each other and to each first end portion of said first and second coupling arms, the second end portion of said first coupling arm being pivotally coupled to each of the upper end of said first side support rod and the distal end of said first roof support rod to define a first side/roof attachment joint, and the second end portion of said second coupling arm being pivotally coupled to each of the upper end of said second side support rod and the distal end of said second roof support rod to define a second side/roof attachment joint, wherein each of said connected pair of support spans are pivotally connected to each other with said longitudinal axis positioned in a substantially co-planar alignment, and a first end portion of a first eaves attachment member engaging said one of said plurality of support trusses at respective first and second side/roof attachment joints of a first support frame of said pair of connected support frames of said one of said plurality of support trusses, and a second end portion of said first eaves attachment member engaging said adjacent one of said plurality of support trusses at respective first and second side/roof attachment joints of a first support frame of said pair of connected support frames of said next adjacent one of said plurality of support trusses, a first end portion of a second eaves attachment member engaging said one of said plurality of support trusses at respective first and second side/roof attachment joints of a second support frame of said pair of connected support frames of said one of said plurality of support trusses, and a second end portion of said second eaves attachment member engaging said adjacent one of said plurality of support trusses at respective first and second side/roof attachment joints of a second support frame of said pair of support frames of said adjacent one of said plurality of support trusses, and a first end portion of a ridge attachment member engaging said one of said plurality of support trusses at each respective roof coupling joint of said first and second support frames of said one of said plurality of support trusses, and a second end portion of said ridge attachment member pivotally engaging said adjacent one of said plurality of support trusses at each respective roof coupling joint of said first and second support frames of said adjacent one of said plurality of support trusses.

In a further aspect, the present invention provides a tent frame comprising at least one support frame, each said support frame including: a side support having an inner support member being elongated between a lower member end and an upper member end, and an outer support member being elongated between a lower end and an upper end, said outer support member being adjustable in length between a retracted position and an extended position and each of said lower end and said lower member end being pivotally coupled together; a roof support having a lower support member being elongated between a proximal member end and a distal member end, and an upper support member being elongated between a proximal end and a distal end, each of said proximal end and said proximal member end being pivotally coupled together; a rigid link member being elongated between a first end portion and a second end portion; the first end portion being pivotally coupled to each of the upper end and the distal end; and the second end portion being pivotally coupled to each of the upper member end and the distal member end, wherein the retraction or extension of said outer support member permits vertical adjustment in the position of the distal end of the upper support member.

In another aspect, the present invention provides a tent frame comprising at least one support frame, each said support frame including: a rigid side support member being elongated between a lower end and an upper end; a rigid roof support member being elongated between a proximal end and a distal end; a rigid link member being elongated between a first end portion and a second end portion, and having a body portion positioned between the first end portion and the second end portion; the body portion being pivotally coupled to each of the upper end and the distal end and the side support member and the roof support member are positioned at an angle to each other such that the support frame has an acute angle side and an obtuse angle side; the first end portion being positioned outwardly from the obtuse angle side and a first tension member deflector is positioned thereon; the second end portion being positioned outwardly from the acute angle side and a second tension member deflector is positioned thereon; a first tension member having a first end and a second end, the first end being fixed to the proximal end of the roof support member, and the second end being adjustably fixed to the lower end of the side support member such that a portion of the first tension member is positioned on the first tension member deflector; and a second tension member having a first end and a second end, the first end being fixed to the proximal end of the roof support member, and the second end being adjustably fixed to the lower end of the side support member such that a portion of the second tension member is positioned on the second tension member deflector; wherein shortening a length of the first tension member and lengthening a length of the second tension member permits an upward vertical adjustment in the position of the proximal end of the rigid roof support member.

In another aspect, the present invention provides a tent comprising a support truss having at least one pair of connected support frames, each said support frame including: a rigid side support pole being elongated between a lower end and an upper end; a rigid roof support pole being elongated between a proximal end and a distal end; a first rigid link pole being elongated between a first end portion and a second end portion; a second tensile link member being elongated between a first end portion and a second end portion, and each of the upper end, the distal end, and the first end portion of said first rigid link pole being coupled for pivotal movement relative to each other, and said first end portion of the second tensile link member is fixed thereto, the second end portion of said first rigid link pole having a first tension member deflector positioned thereon, the second end portion of said second tensile link member having a second tension member deflector positioned thereon, a first tension cable having a first end and a second end, the first end being fixed to the proximal end of the roof support pole, and the second end being adjustably fixed to the lower end of the side support member such that a portion of the first tension member is positioned on the first tension member deflector; and a second tension cable having a first end and a second end, the first end being fixed to the proximal end of the roof support pole, and the second end being adjustably fixed to the lower end of the side support member such that a portion of the second tension member is positioned on the second tension member deflector; wherein each of said pair of connected support frames is pivotally connected to each other proximate to each said proximal end, with the respective side and roof support poles of each said support frame extending in a substantially co-planar alignment.

In another aspect, the present invention provides a tent frame comprising a plurality of connected support trusses, at least one of said plurality of support trusses being displaced laterally from and having a longitudinal axis substantially parallel to a longitudinal axis of an adjacent one of said plurality of support trusses, each said support truss further comprising a pair of connected support frames, each including: a side support rod being elongated between a lower end and an upper end; a roof support rod being elongated between a proximal end and a distal end, the proximal ends of each pair of connected support frames being pivotally coupled to each other to define a roof coupling joint; a first rigid arm being elongated between a first end portion and a second end portion, a second tensile arm being elongated between a first end portion and a second end portion, each of said upper end and said distal end being pivotally coupled to each other with each said first end portion of said first rigid arm and said second tensile arm being interposed therebetween such as to be pivotally movable relative thereto, said pivotal coupling of the upper end, the distal end and each of said first end portions defining a side/roof attachment joint, the second end portion of said first rigid arm having a first tensile member deflector attached thereto, and the second end portion of said second tensile arm having a second tension member deflector coupled thereto, a first tension member having a first end and a second end, the first end being fixed to the proximal end of the roof support member, and the second end being adjustably fixed to the lower end of the side support member such that a portion of the first tension member is positioned on the first tension member deflector; and a second tension member having a first end and a second end, the first end being fixed to the proximal end of the roof support member, and the second end being adjustably fixed to the lower end of the side support member such that a portion of the second tension member is positioned on the second tension member deflector; wherein each of said connected pair of support frames are pivotally connected to each other with said longitudinal axis positioned in a substantially co-planar alignment, and a first end portion of a first eaves support member engaging said one of said plurality of support trusses at the side/roof attachment joint of a first support frame of said pair of connected support frames of said one of said plurality of support trusses, and a second end portion of said first eaves support member engaging said adjacent one of said plurality of support trusses at the side/roof attachment joint of a first support frame of said pair of connected support frames of said next adjacent one of said plurality of support trusses, a first end portion of a second eaves support member engaging said one of said plurality of support trusses at the side/roof attachment joint of a second support frame of said pair of connected support frames of said one of said plurality of support trusses, and a second end portion of said second eaves support member engaging said adjacent one of said plurality of support trusses at the side/roof attachment joint of a second support frame of said pair of support frames of said adjacent one of said plurality of support trusses, and a first end portion of a ridge support member engaging said one of said plurality of support trusses at the roof coupling joint of said first and second support frames of said one of said plurality of support trusses, and a second end portion of said ridge support member pivotally engaging said adjacent one of said plurality of support trusses at the roof coupling joint of said first and second support frames of said adjacent one of said plurality of support trusses.

In yet another aspect, the present invention provides a tent frame comprising at least one support frame, each said support frame including: a rigid side support member being elongated between a lower end and an upper end; a rigid roof support member being elongated between a proximal end and a distal end; a rigid first link member being elongated between a first end portion and a second end portion; the first end portion being pivotally coupled to each of the upper end and the distal end and the side member and upper member are positioned at an angle with respect to each other such that the support frame has an acute angle side and an obtuse angle side; the second end portion being positioned outwardly from the obtuse angle side and a first tension member deflector is positioned thereon; a first tension member having a first end and a second end is positioned with the first end fixed to the proximal end of the roof support member, and the second end fixed to the lower end of the side support member such that a portion of the first tension member is positioned on the first tension member deflector; wherein the shortening or lengthening of the first tension member permits vertical adjustment in the position of the proximal end of the rigid roof support member.

In a further aspect, the present invention provides a kit for making a tent frame, the kit comprising at least one set of support frame joints including: one eaves joint comprising a roof member socket configured to receive an end of a roof member, a side member socket configured to receive an end of a side member and a first link member socket configured to receive an end of a first link member, the roof member socket, the side member socket and the first link member socket being pivotally coupled together.

In another aspect, the present invention provides a kit for making a tent frame, the kit comprising at least one set of support truss joints including: two eaves joints, each eaves joint comprising a roof member socket configured to receive an end of a roof member, a side member socket configured to receive an end of a side member and a first link member having a first end pivotally coupled to the roof member socket and the side member socket, a second end of the first link member having a first tension member deflector thereon; and one ridge joint comprising pivotally coupled roof member sockets, each roof member socket configured to receive an end of a roof member.

In yet another aspect, the present invention resides in a tent frame comprising a support truss having at least one pair of connected support frames, each said support frame including: a rigid side support member being elongated between a lower end and an upper end; a rigid roof support member being elongated between a proximal end and a distal end; an outside link member assembly elongated between a first end portion and a second end portion; an inside link member assembly elongated between a first end portion and a second end portion, and each of the upper end, the distal end, and the first end portion of said outside link member assembly being coupled for pivotal movement relative to each other, and said first end portion of the inside link member assembly being fixed thereto, the second end portion of said outside link member assembly having an outside tension member deflector assembly positioned thereon, the second end portion of said inside link member assembly having an inside tension member deflector assembly positioned thereon, an outside tension member assembly having at least one cable having a first end and a second end, the first end being fixed to the proximal end of the roof support pole, and the second end being removably fixed to the lower end of the side support member such that a portion of the outside tension member assembly is positioned on the outside tension member deflector assembly; and an inside tension member assembly having at least one cable having a first end and a second end, the first end being fixed to the proximal end of the roof support pole, and the second end being removably fixed to the lower end of the side support member such that a portion of the inside tension member assembly is positioned on the second tension member deflector assembly; wherein each of said pair of connected support frames is pivotally connected to each other proximate to each said proximal end, with the respective side and roof support poles of each said support frame extending in a substantially co-planar alignment.

In a further aspect, the present invention resides in a tent frame comprising at least one support frame, each said support frame including: a rigid side support member being elongated between a lower end and an upper end; a rigid roof support member being elongated between a proximal end and a distal end; a first link member assembly comprising a first rigid pole, a second rigid pole and a third rigid pole fixed as a substantially triangular frame having a first corner, a second corner and a third corner; a second adjustable link member being elongated between a first end and a second end; the first corner of the triangular frame and the first end are pivotally coupled to each of the upper end and the distal end, and the side support member and the roof support member are positioned at an angle to each other such that the support frame has an acute angle side and an obtuse angle side; the second corner and the third corner of the triangular frame are positioned outwardly from the obtuse angle side; the second end being positioned outwardly from the acute angle side and has a tension member deflector positioned thereon; a first tension member fixed between the lower end of the side support member and the second corner of the triangular frame; a second tension member fixed between the lower end of the side support member and the third corner of the triangular frame; a third tension member fixed between the proximal end of the roof support member and the second corner of the triangular frame; a fourth tension member fixed between the proximal end of the roof support member and the third corner of the triangular frame; and an inside tension member fixed between the proximal end of the roof support member and the lower end of the side support member such that a portion of the inside tension member is position on the tension member deflector.

BRIEF DESCRIPTION OF THE DRAWINGS

Further and other features of the invention will be apparent to those skilled in the art from the following detailed description taken together with the accompanying drawings in which.

DETAILED DESCRIPTION OF THE PREFERRED EMBODIMENTS

Figure 1:
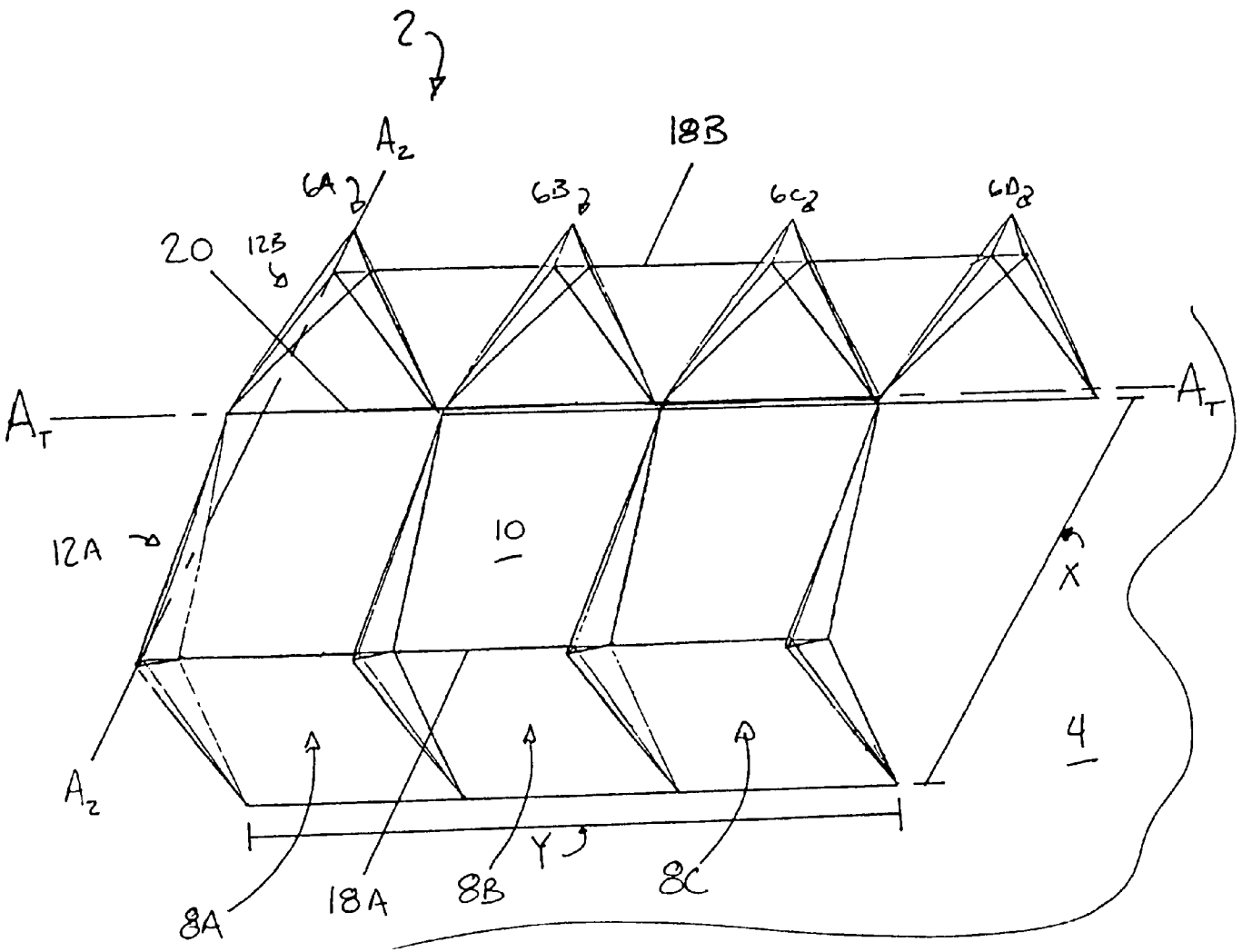
FIG. 1 shows a schematic view of a tent in accordance with a preferred embodiment of the present invention.

The present invention is now described with reference to FIG. 1. FIG. 1 shows an adjustable tent 2 which is elongated along a longitudinal tent axis $A_T$-$A_T$, in accordance with one embodiment of the present invention. The tent 2 is positioned on the ground 4 and comprises four collapsible metal or carbon-fibre support trusses 6A, 6B, 6C, 6D, a flexible canopy 10, a pair of side eaves attachment cables 18A, 18B, and a central ridge attachment cable 20. The support trusses 6A, 6B, 6C, 6D are positioned laterally spaced from each other along the axis $A_T$-$A_T$. The support trusses 6A, 6B, 6C, 6D are arranged at intervals such that bays 8A, 8B, 8C are formed. As will be described, the canopy 10, formed of canvass, cloth or other suitable flexible material, is secured to an inner side of the support trusses 6A, 6B, 6C, 6D to complete the tent 2. By this construction, the tent 2 provides a sheltered enclosure covering an area of ground 4 which, in a simplified commercial embodiment, has a length Y selected at between about four meters and eight meters, and a width X selected at between about 3 meters and 10 meters, as shown on FIG. 1.

Figure 2:
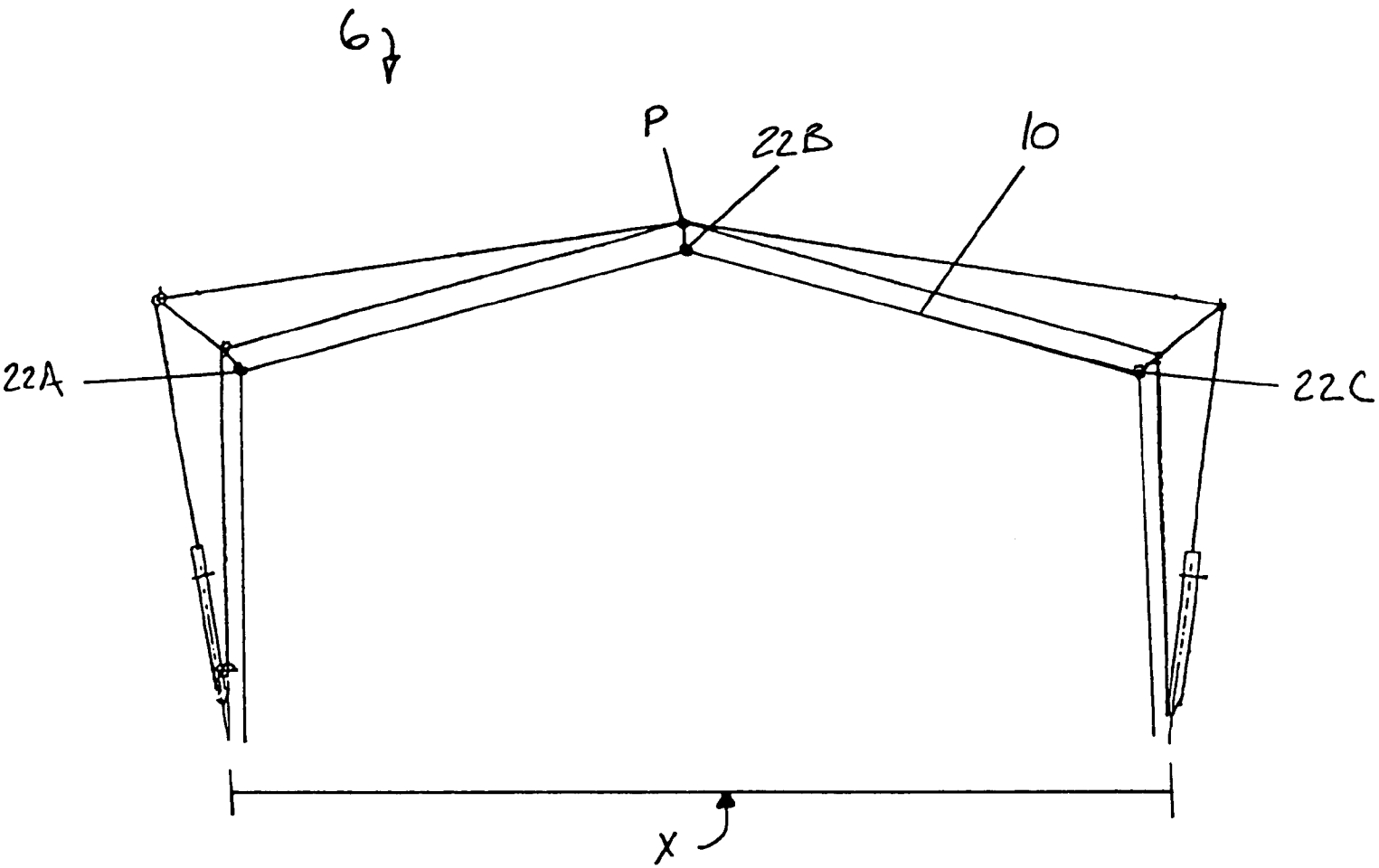
FIG. 2 shows a support truss, of the tent shown in FIG. 1, from an end view with a canopy attached to the inside of the support truss.
Figure 3:
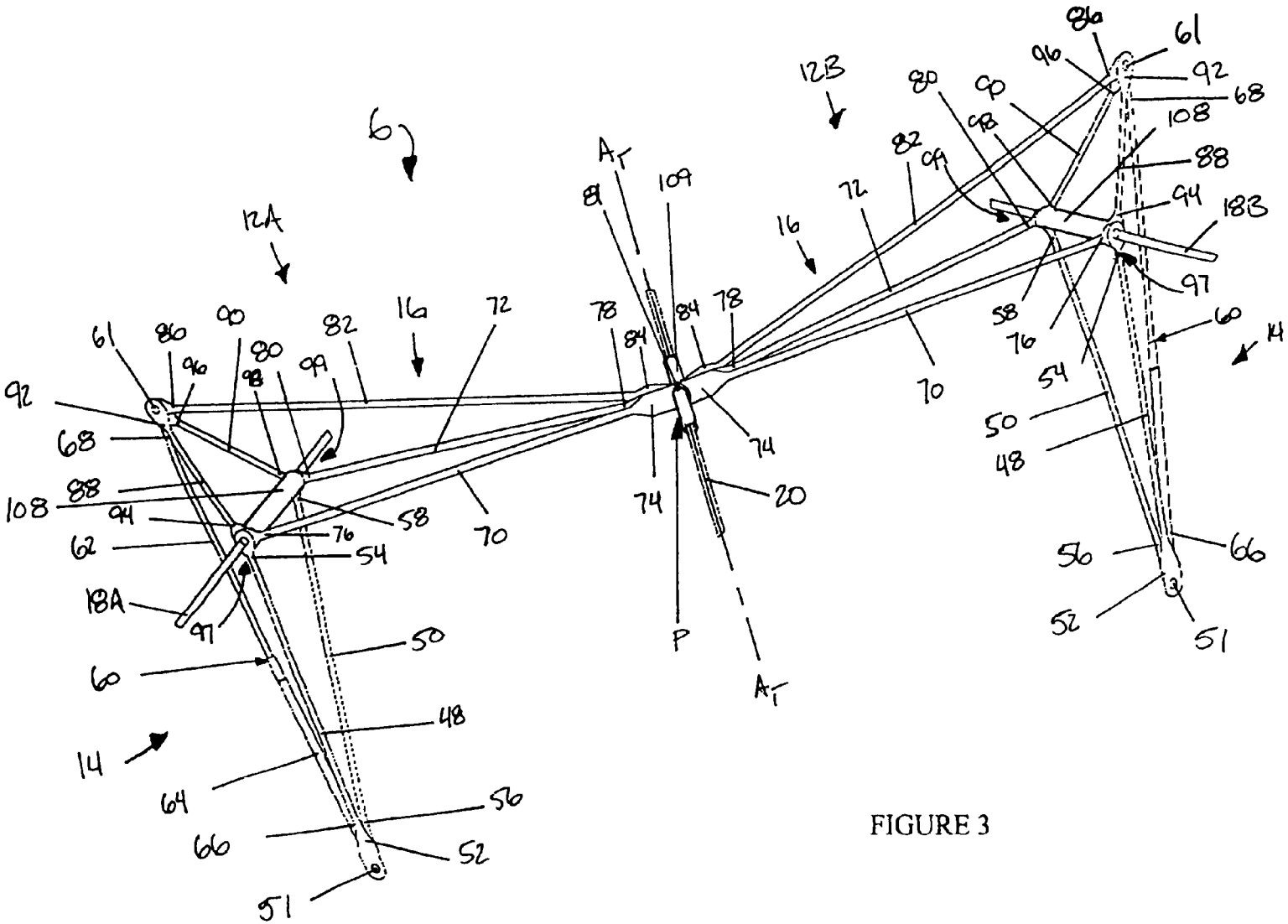
FIG. 3 shows a perspective view of a support truss used in the tent shown in FIG. 1.

Each of the support trusses 6A, 6B, 6C, 6D have the identical construction and, as will be described with reference to FIGS. 2 and 3, are comprised of two support frames 12A, 12B. The support frames 12A, 12B are pivotally coupled to each other in a substantially co-planar alignment along axis $A_2$-$A_2$ which, in the construction shown, is oriented perpendicular to axis $A_T$-$A_T$.

FIG. 3 shows a perspective view of a support truss 6 comprising a pair of support frames 12A, 12B which, in assembly of the tent 2, are secured in a pivotally coupled orientation about a central pivot point P. By this construction, the support truss 6 is symmetrical about axis $A_T$-$A_T$, as shown on FIG. 3.

As also shown on FIG. 3, each of the support frames 12A, 12B includes a respective side support 14 and roof support 16. The side support 14 consists of a pair of vertically elongated rigid metal or carbon-fibre poles 48, 50 and telescopically extensible central support member 60. The side support poles 48, 50 are each elongated from a respective flattened lower member end 52, 56 to a flattened upper member end 54, 58 with the side support poles 48, 50 having an overall length preferably selected at between about 2.5 meters and 4.0 meters. The side support poles 48, 50 are each selected to have approximately the same length.

The central support member 60 is provided with a reduced diameter upper pole 62 which is selectively insertable into a lower hollow tube 64. The upper pole 62 is positionable relative to the hollow tube 64 to permit adjustment of the central support member 60 in length between a retracted position, wherein the central support member has a reduced length selected less than that of the rigid side support poles 48, 50, and an extended position, wherein the central support member 60 has an extended length selected greater than that of the rigid side support poles 48, 50. The central support member 60 has a flattened lower end 66 and a flattened upper end 68, and preferably is extensible from a retracted position length, between about 2.0 meters and 3.5 meters, and an extended position length, between about 3.0 meters and 4.5 meters.

In a simplified construction, the lower member ends 52, 56 of each respective side support pole 48, 50 and the lower end 66 of the central support member 60 have a bore 51 formed there through. A threaded fastener or other suitable mechanical fastener, not shown, is inserted through the bore 51 to pivotally couple the telescoping central support member 60 in a position interposed between the side support poles 48, 50.

The roof support 16 includes a pair of identical rafter poles 70, 72 and a central roof pole 82. The rafter poles 70, 72 and central roof pole 82 are each formed from metal or carbon-fibre, and more preferably, the rafter poles 70, 72 each have the identical longitudinal length and extend from a respective flattened proximal member end 74, 78 to a respective flattened distal member end 76, 80. Preferably, the rafter poles 70, 72 have a length selected at between about 3.0 meters and 6.0 meters. The central roof pole 82 is formed as a rigid metal or carbon-fibre pole and has a length selected greater than the length of the rafter poles 70, 72, and preferably has a length approximately between 3.5 meters and 6.5 meters.

As with the rafter poles 70, 72, the central roof pole 82 has a flattened proximal end 84 and a flattened distal end 86. Each of the flattened proximal member ends 74, 78 and the proximal end 84 include a bore 81 extending there through. In this manner a hollow tubular strut 109, positioned within the bore 81, is used to pivotally secure the central roof pole 82 in a position interposed between the rafter poles 70, 72 of each support frame 12A, 12B. As shown on FIG. 3, the flattened proximal member ends 74, 78 and the flattened proximal end 84 are pivotally coupled to each other to define the pivot point P.

A pair of rigid metal or carbon-fibre coupling poles 88, 90 are further provided. Each of the coupling poles 88, 90 extend from a respective first flattened end portion 92, 96 to a respective second flattened end portion 94, 98. In a simplified construction, the respective first end portions 92, 96 of the coupling poles 88, 90 and the upper end 68 of the central support member 60 and the distal end 86 of the central roof pole 82 have a bore 61 formed there through. A bolt or other suitable mechanical fastener, not shown, is inserted through the bore 61 to pivotally couple the upper end 68 and the distal end 86 to the respective first end portions 92, 96 of the coupling poles 88, 90.

The second end portion 94 of the first coupling pole 88 is pivotally coupled to each of the upper member end 54 of the first side support pole 48 and the distal member end 76 of the first rafter pole 70. Each of the second end portion 94, upper member end 54 and distal member end 76 are flattened with holes there through to define a first side/roof joint 97. The second end portion 98 of the second coupling pole 90 is pivotally coupled to the upper member end 58 of the second side support pole 50 and the distal member end 80 of the second rafter pole 72. Each of the second end portion 98, the upper member end 58 and the distal member 80 are flattened with holes there through to define a second side/roof joint 99.

The eaves attachment cables 18A, 18B extend through a strut 108 positioned between respective first and second side/roof joints 97, 99, as shown on FIG. 3. Because the eaves attachment cables 18A, 18B, extend through the strut 108 positioned between the first and second side/roof joints 97, 99, a pivotal relationship is maintained between side support poles 48, 50 and rafter poles 70, 72.

Preferably, the eaves attachment cables 18A, 18B and ridge attachment cable 20 are formed of flexible cable having a diameter ranging between about 0.3 centimeters and 1.0 centimeters.

As shown on FIG. 3, the support frames 12A, 12B of each support truss 6 are pivotally connected so that the respective central roof poles 82 are aligned for pivotal movement in a substantially co-planar alignment. The pivotal connection of support frames 12A, 12B enables the tent ridge cable attachment 20 to be vertically raised or lowered to allow overall adjustment in the height of the ridge of the tent 2 by varying the span of the support truss 6 in the direction of axis $A_2$-$A_2$, as shown on FIG. 4.

Figure 4:
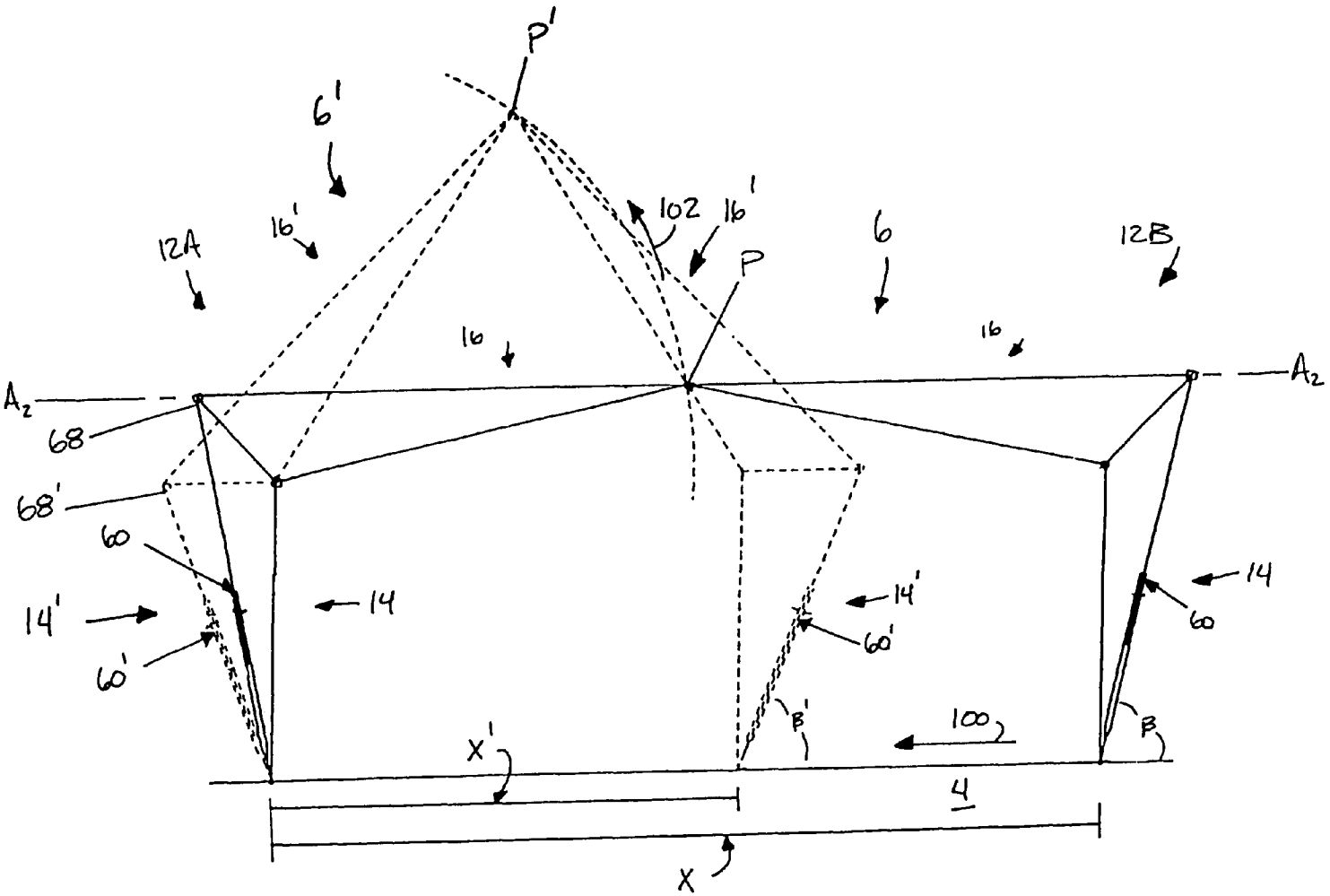
FIG. 4 shows schematically the support truss of FIG. 3 illustrating the adjustability of the span, whereby a longer span is shown as X and a shorter span is shown as X'.

FIG. 4 shows the support truss 6 of FIG. 3 in two-dimensional side view. The support truss 6 is shown first at a span X. Support truss 6' is shown in dashed lines at an adjusted shorter span X'. The span X is adjusted to span X' by moving side support 14 of support frame 12B in the direction of arrow 100 parallel to axis $A_2$-$A_2$. As the support frames 12A, 12B are adjusted to shorter span X', the upper end 68 of the telescoping central support members 60 of each side support 14 are pivoted outwardly away from the opposing support frame 12A, 12B. The adjustment of the span X to span X' requires the central support members 60 to be shortened which causes the central support members 60 to be inclined at an angle which is less steep to vertical, shown by symbol β'. The angle of the central support members 60 at span X is more steep to vertical, shown by symbol β. The respective first and second side support poles 48, 50 remain substantially vertical, as shown on FIG. 4. This in turn results in the proximal member ends 74, 78 and the proximal end 84 of each roof support 16 pivoting upwardly. Because of the hinged connection at pivot point P, the support truss 6 is correspondingly adjusted in the direction of arrow 102 to new position P', and the overall height of the support truss 6 is raised, as shown by adjusted support truss 6'.

Figure 5:
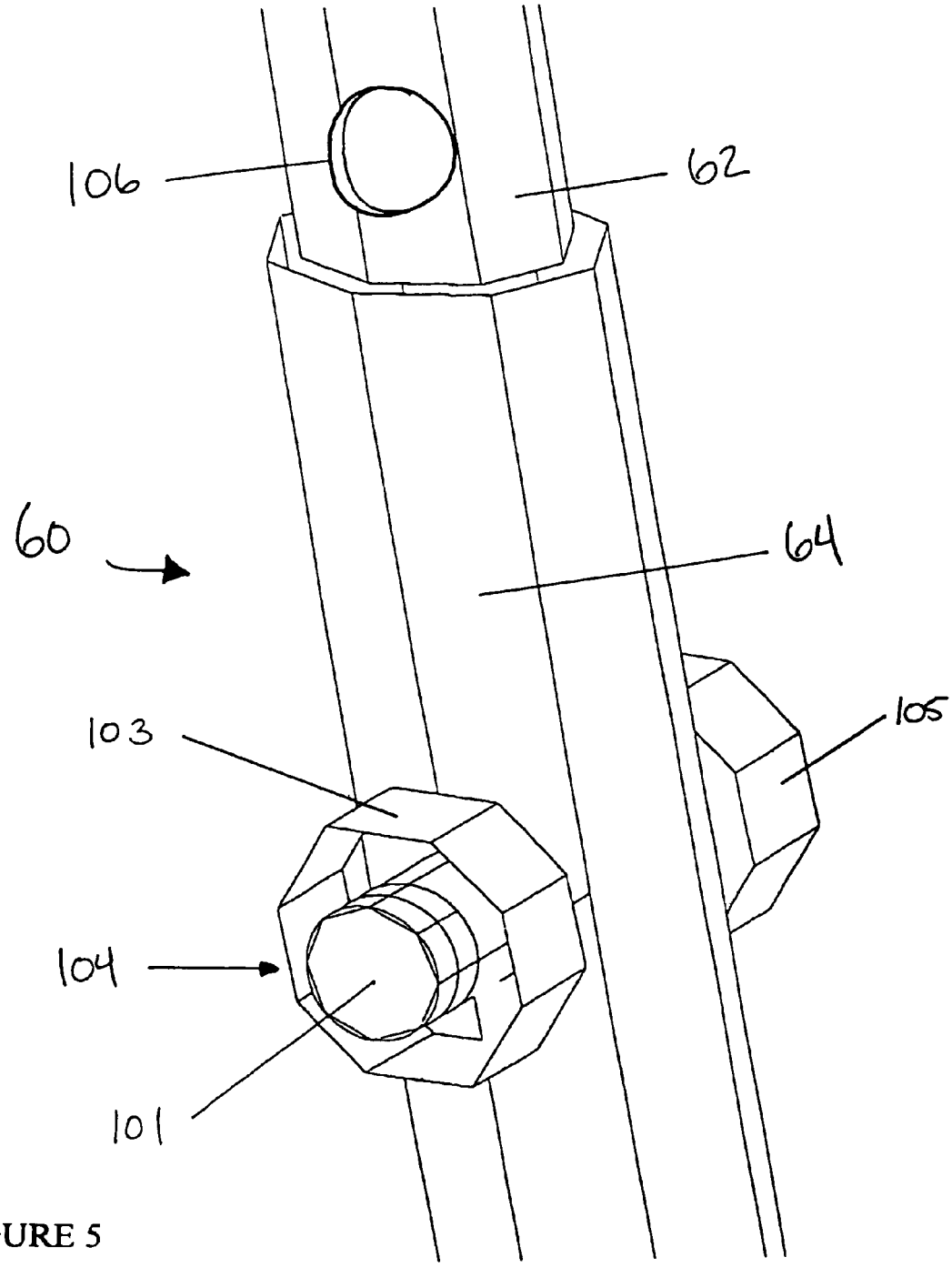
FIG. 5 shows a perspective view of a portion of the extensible support member capable of locking the extensible support member at a selected length.

FIG. 5 shows a portion of the central support member 60 shown in FIG. 3. As previously described, the central support member 60 comprises two sub-members, the upper pole 62 and the lower hollow tube 64. As shown on FIG. 5, the upper pole 62 is disposed in the lower hollow tube 64 and the upper pole 62 is held in place by a bolt 104. The bolt 104 has a threaded end 101 with threaded nut 103 secured thereto. The end of the bolt 104 opposite to the threaded end 101 is the head of the bolt 105 which has a diameter selected greater than the diameter of the aperture in the lower tube 64. The bolt 104 is inserted through one of the holes 106 in the upper pole 62 such that the bolt 104 engages an aperture in the lower tube 64. The threaded nut 103 is screwed onto the threaded end 101 of the bolt 104. The central support member 60 is adjusted in length between a retracted position and an extended position by unscrewing the nut 103, removing the bolt 104 and sliding the upper pole 62 further into or out of the lower tube 64, respectively. The bolt 104 is then replaced to engage both the aperture in the lower tube 64 and a hole 106 in the upper tube pole 62. The nut 103 is then replaced on the threaded end 101 to secure the bolt 104 in place with the central support member 60 locked at a selected length.

While the upper pole 62 may optionally have a plurality of holes 106 drilled at predetermined intervals, it is to be appreciated that holes 106 can be drilled through the upper pole 62 as required when assembling the tent 2 or adjusting the span of the tent 2. While a bolt 104 with nut 105 has been described to lock the central support member 60 at a selected length, other suitable mechanical locking devices may be used to lock the central support member 60 at a selected length, such as shear-pins.

Figure 6:
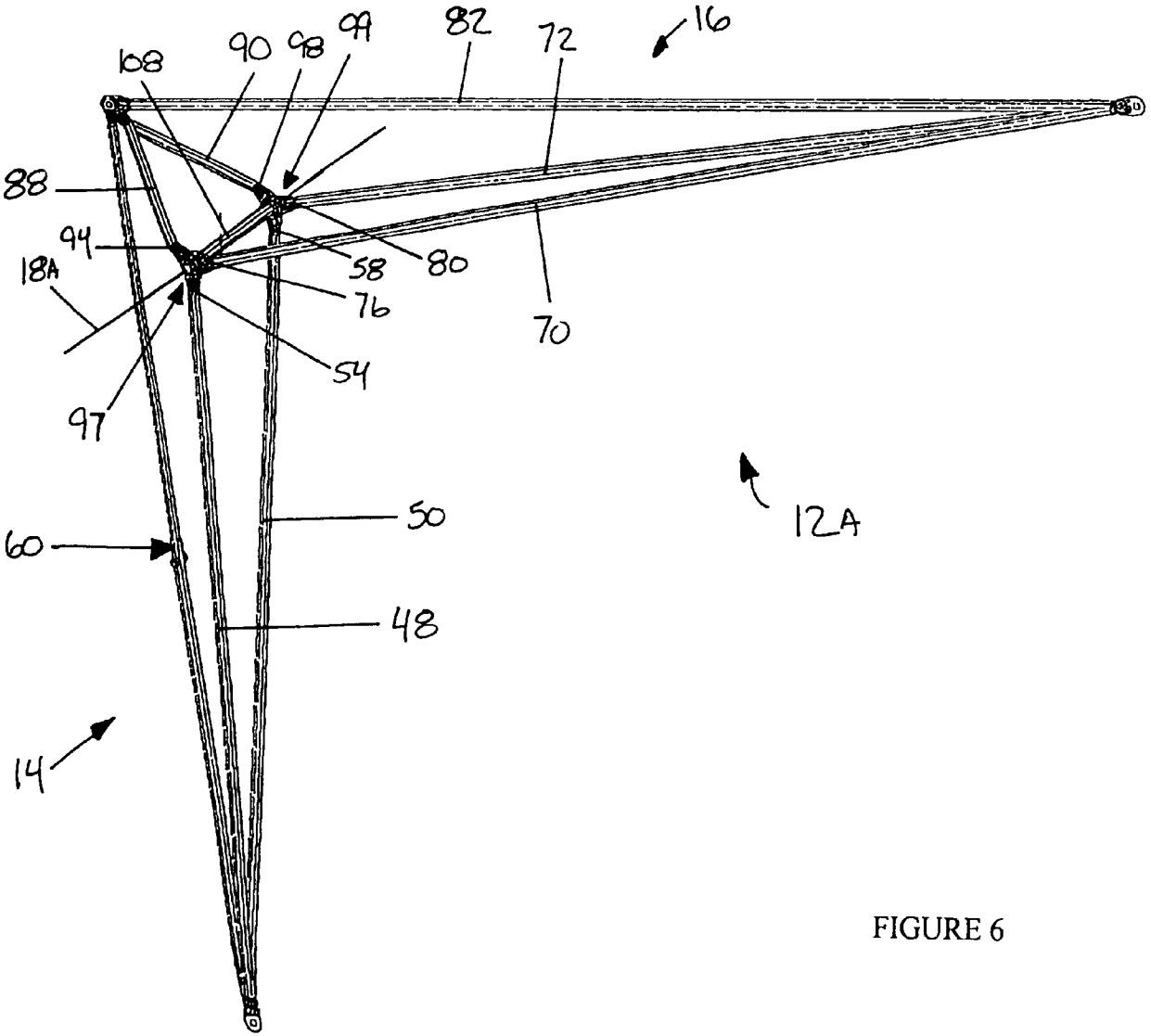
FIG. 6 shows a perspective view of a support frame used in the assembly of the tent frame shown in FIG. 1.

FIG. 6 shows a perspective view of a support frame 12 used in the assembly of the tent 2 of FIG. 1. As shown on FIG. 6, the second end portion 94 of the first coupling pole 88 is pivotally coupled to each of the upper member end 54 of the first side support pole 48 and the distal member end 76 of the first rafter pole 70 at the first side/roof joint 97. The second end portion 98 of the second coupling pole 90 is pivotally coupled to the upper member end 58 of the second side support pole 50 and the distal member end 80 of the second rafter pole 72 at the second side/roof joint 99.

A hollow elongated strut 108 is positioned between the first side/roof joint 97 and the second side/roof joint 99 to secure the eaves attachment cable 18A against lateral movement relative to the support frame 12A. Preferably, the strut 108 is a hollow metal or carbon-fibre tube that allows the eaves attachment cable 18A to pass lengthwise through the hollow tubular strut 108, as shown. The attachment of the strut 108 is shown in exploded view on FIG. 7.

Figure 7:
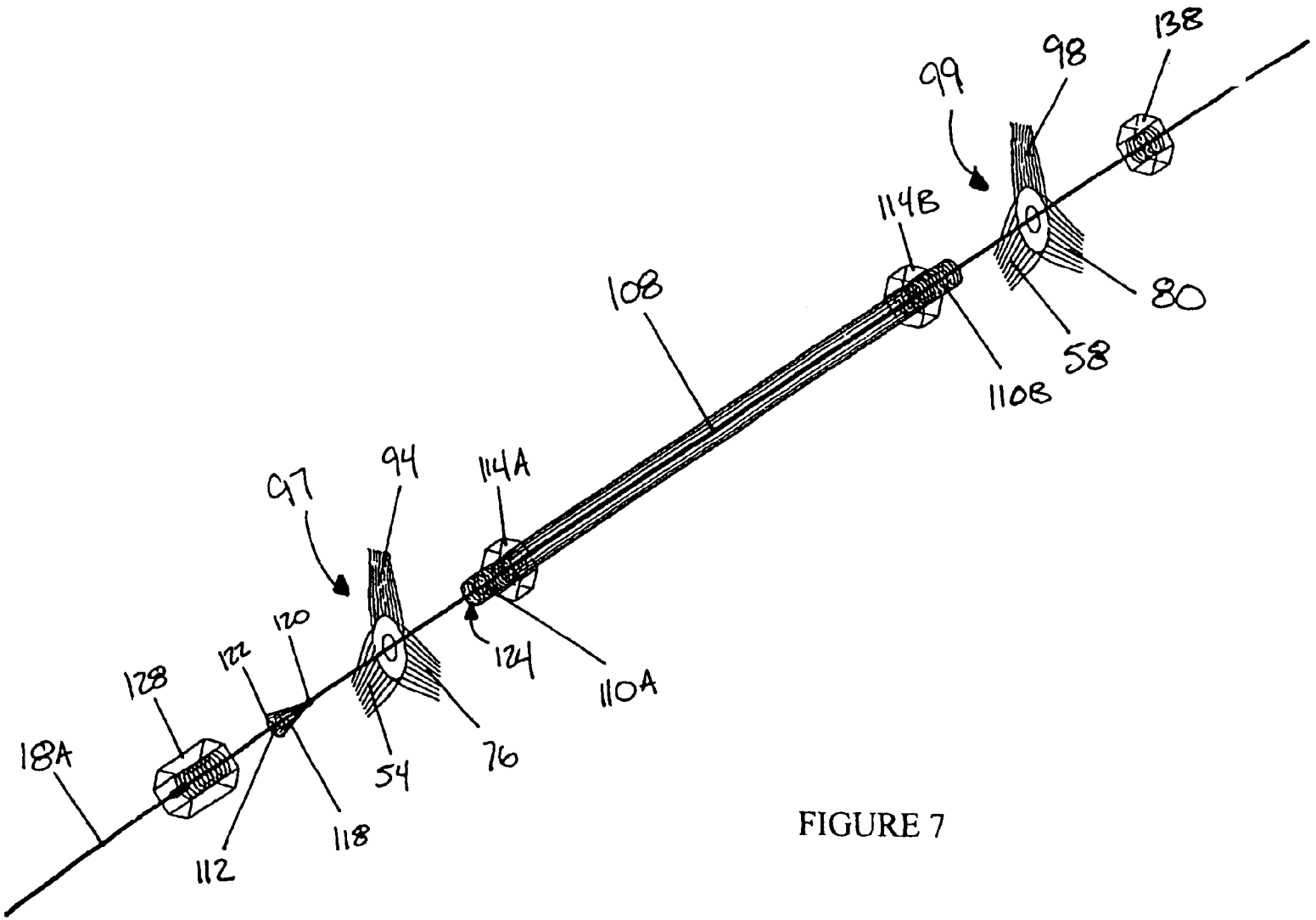
FIG. 7 shows an exploded view of a strut that pivotally connects the structural members of a support frame, and secures an eaves attachment cable at a selected position.

FIG. 7 shows an exploded view of the hollow tubular elongated strut 108. The strut 108 has threaded ends 110A, 110B. Stop nuts 114A, 114B are threaded onto the threaded ends 110A, 110B, respectively. The first side/roof joint 97 is positioned on the first threaded end 110A and is maintained on the strut 108 adjacent to the first stop nut 114A. In a like manner, the second stop nut 114B is threaded onto second threaded end 110B at the opposite end of the strut 108. The second side/roof joint 99 is positioned on the second threaded end 110B and is maintained on the strut 108 by the stop nut 114B. An end nut 138 is secured onto the second threaded end 110B to pivotally position the second side/roof coupling joint 99 on the second threaded end 110B of the support strut 108.

Figure 8:
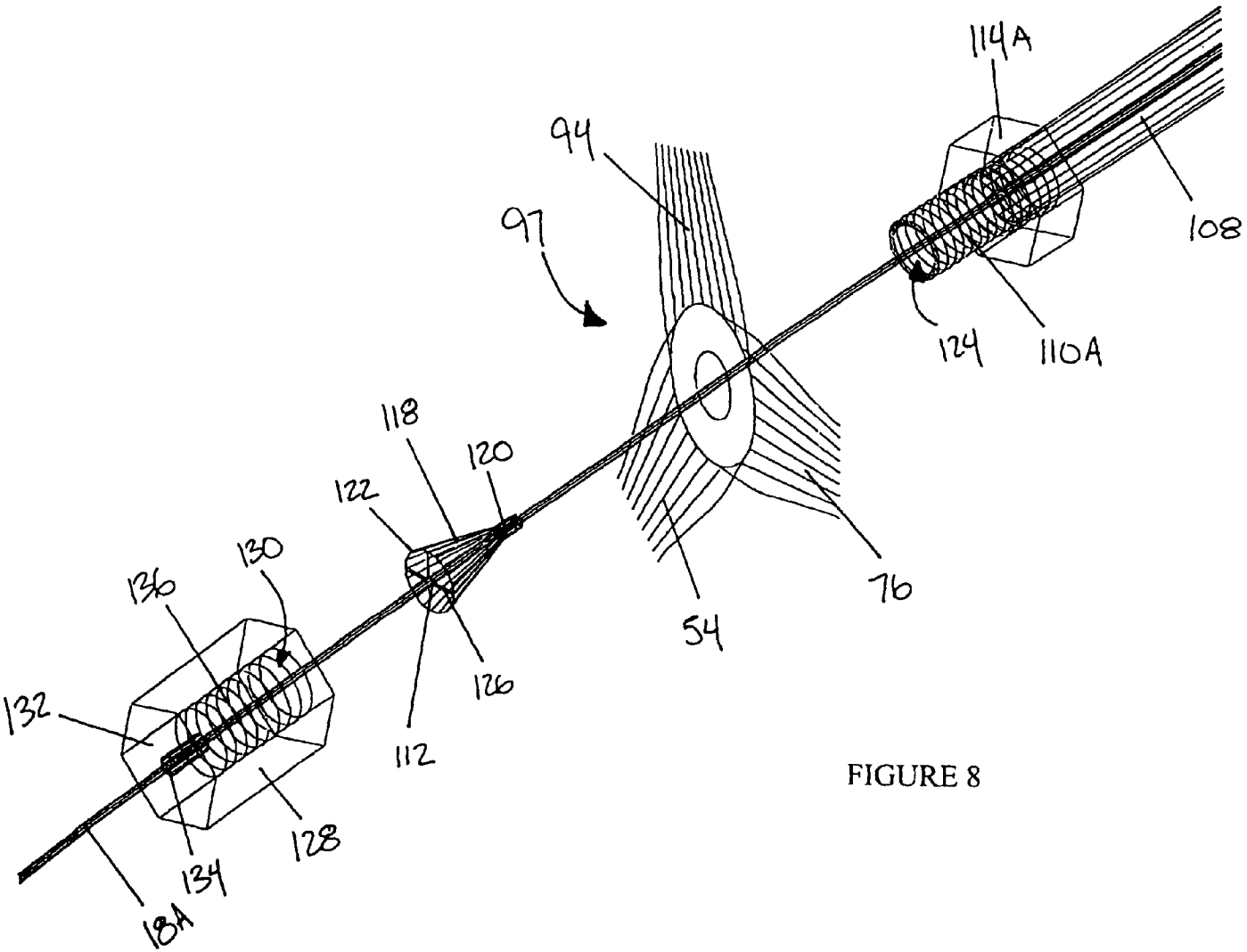
FIG. 8 shows an enlarged view of one end of the strut shown in FIG. 7.

As shown in the enlarged view of FIG. 8, a slotted wedge 118 is positioned on the eaves attachment cable 18A. The slotted wedge 118 is formed as one piece and has a larger diameter end 122, substantially conical in shape, and a smaller diameter end 120, substantially cylindrical in shape. The slotted wedge 118 is sized for fitted placement within an open end 124 of the strut 108. The slotted wedge 118 has a borehole 112 extending longitudinally through the axis of the slotted wedge 118. The sizing of the diameter of the borehole 112 is slightly larger than the diameter of the eaves attachment cable 18A to provide a friction-fit slidable contact between the slotted wedge 118 and the eaves attachment cable 18A when the eaves attachment cable 18A is positioned through the borehole 112. As shown, the slotted wedge 118 has four slotted gaps 126 cut into the wedge 118 substantially perpendicular to a longitudinal axis of the slotted wedge 118 and approximately equidistant around the circumference of the conical larger diameter end 122. The slotted gaps 126 extend into the larger diameter end 122 only so that the slotted wedge 118 remains in one piece. The number of slotted gaps 126 cut into the wedge 118 is at least one although any number of slotted gaps 126 could be provided.

As shown on FIGS. 7 and 8, the slotted wedge 118 is positioned on the eaves attachment cable 18A with the smaller diameter end 120 facing the first threaded end 110A. The larger diameter end 122 has an outer diameter equal to or slightly greater than an inner diameter of the hollow strut 108 at an opening 124 of the first threaded end 110A. Preferably, the larger diameter end 122 of the slotted wedge 118 is slightly larger than the inner diameter of the strut 108, being between about one centimeter and three centimeters. The smaller diameter end 120 is placed inside the opening 124 of the first threaded end 110A of the strut 108. The slotted wedge 118 is fitted into the opening 124 until the larger diameter end 122 is in contact with the inner diameter of the first threaded end 110A at the opening 124.

The slotted gaps 126 are spaces which are compressed when a surface of the conical larger end 112 of the slotted wedge 118 is placed in contact with the inner circumference of the opening 124 at the first threaded end 110A. The compression of the slotted gaps 126 tightens the slotted wedge 118 on the eaves attachment cable 18A such that the eaves attachment cable 18A is held in gripping relation by the slotted wedge 118 and is thereby fixed at the first threaded end 110A of the strut 108.

To secure the slotted wedge 118 inside the opening 124, a pressure nut 128 is fitted onto the first threaded end 110A. The pressure nut 128 is an elongated nut, having an open end 130 and a closed end 132. A hole 134 is drilled through the closed end 132 and the hole 134 has a diameter slightly greater than a diameter of the eaves attachment cable 18A. The open end 130 of the pressure nut 128 has threads on the inside. The pressure nut 128 is positioned on the eaves attachment cable 18A by passing the eaves attachment cable 18A through the open end 130 and hole 134 so that the open end 130 faces the first threaded end 110A. The pressure nut 128 is secured onto the first threaded end 110A of the strut 108, so that the slotted wedge 118 remains fitted inside the opening 124 of the first threaded end 110A in gripping relation with the eaves attachment cable 18A. By this construction, the strut 108 is positioned at a location on the eaves attachment cable 18A, and the first side/roof coupling joint 97 is pivotally positioned on the first threaded end 110A of the strut 108.

The slotted wedge 118 is secured by the following procedure. The first side/roof joint 97 is placed on strut 108. Eaves attachment cable 18A is then positioned through the strut 108 and is held by slotted wedge 118 and nut 128. Then nut 114A is secured against the first side/roof joint 97 to fix the first side/roof joint 97 in pivotal position on the strut 108.

Figure 9:
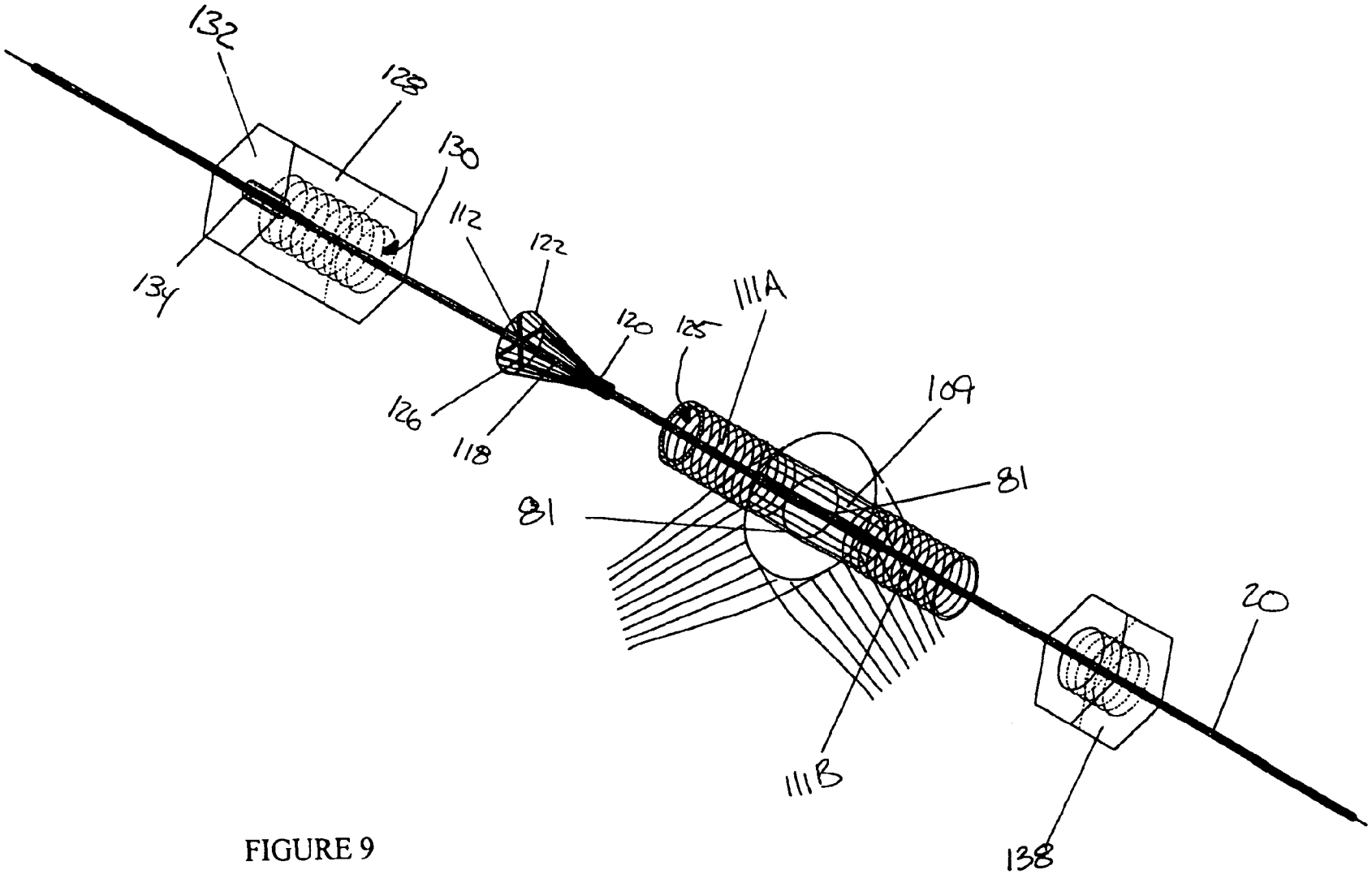
FIG. 9 shows an exploded view of a strut that pivotally connects the structural members of a support truss and secures a ridge attachment cable at a selected position.

FIG. 9 shows an exploded view of a strut 109 that pivotally connects respective support frames 12A, 12B of a support truss 6 and is used to secure a support truss 6 on a ridge attachment cable 20 at a selected position. The strut 109 has threaded ends 111A, 111B. In this regard, the strut 109 is a hollow threaded metal or carbon-fibre tube having a similar construction to the strut 108 used to engage the eaves attachment cable 18A. During assembly of a tent 2, the bore 81 of each respective support frame 12A, 12B of the support truss 6 is positioned on the strut 109, as shown on FIG. 9. A stop nut 138 is threaded onto threaded end 111B to prevent movement of the bores 81 along an axial direction of the strut 109 towards the stop nut 138. As also shown, a slotted wedge 118 is positioned on the ridge attachment cable 20. The slotted wedge 118 is substantially the same as the slotted wedge 118 shown on FIGS. 7 and 8 and is formed of one piece having a larger diameter end 122 substantially conical in shape and a smaller diameter end 120 substantially cylindrical in shape. The slotted wedge 118 is sized for fitted placement within an open end 125 of the strut 109. By this construction, the slotted wedge 118 and its positioning on the ridge attachment cable 20 is similar to that described for the slotted wedge 118 engaging the eaves attachment cable 18A. In this regard, the slotted wedge 118 has a borehole 112 extending longitudinally through the middle of the slotted wedge 118. The sizing of the diameter of bore hole 112 is slightly larger than the diameter of the ridge attachment cable 20 to provide a friction-fit slidable contact between the slotted wedge 118 and the ridge attachment cable 20, when the slotted wedge 118 is placed on the ridge attachment cable 20.

As shown on FIG. 9, the slotted wedge 118 is positioned on the ridge attachment cable 20 with the smaller diameter end 120 facing the opening 125 and threaded end 111A. The larger diameter end 122 has an outer diameter equal to or slightly greater than an inner diameter of the hollow strut 109 at opening 125 of the threaded end 111A. Preferably, the larger diameter end 122 of the slotted wedge 118 is slightly larger than the inner diameter of the strut 109, being between about one centimeter and three centimeters. In assembly, the small diameter end 120 is placed inside the opening 125 of threaded end 111A and the slotted wedge 118 is fitted into the opening 125 until a surface of the conical larger diameter end 122 of the slotted wedge 118 is in contact with the inner diameter of threaded end 111A at opening 125.

Similar to that which is shown on FIGS. 7 and 8, the slotted wedge 118 has a plurality of gaps 126 which are cut into the wedge 118 substantially perpendicular to a longitudinal axis of the slotted wedge 118 and approximately equidistant around the circumference of the larger diameter end 122. The slotted gaps 126 comprise spaces which are compressed when the larger diameter end 122 is placed in contact with the inner circumference at opening 125 of threaded end 111A. The slotted gaps 126 extend into the larger diameter end 122 only so that the slotted wedge 118 remains in one piece. The compression of the slotted gaps 126 tightens the slotted wedge 118 on the ridge attachment cable 20 such that the ridge attachment cable 20 is held in gripping relation by the slotted wedge 118 and thereby positions the strut 109 at a location on the ridge attachment cable.

To secure the slotted wedge 118 inside opening 125, a pressure nut 128 is fitted onto the threaded end 111A. The pressure nut 128 is an elongated nut, having an open end 130 and a closed end 132. A hole 134 is drilled through the closed end 132 with a diameter slightly greater than the ridge attachment cable 20. Pressure nut 128 has threads on the inside. The pressure nut 128 is positioned on the ridge attachment cable 20 by passing the ridge attachment cable 20 through the open end 130 and hole 134 such that the open end 130 faces the threaded end 111A. The pressure nut 128 is secured onto the first threaded end 111A of the strut 109 so that the slotted wedge 118 remains fitted inside the opening 124 of the first threaded end 111A. By this construction, the bores 81 of respective support truss 12A, 12B are pivotally positioned on the strut 109 between stop nut 138 and pressure nut 128.

The respective support trusses 12A and 12B are pivotally secured at a position on the ridge attachment cable 20 by first placing the bores 81 of respective support trusses 12A and 12B on the strut 109. The ridge attachment cable 20 is positioned through the strut 109. The slotted wedge 118 is placed on the ridge attachment cable 20 and inserted into the opening 125. The pressure nut 128 is then secured to the first threaded end 111A. Finally, the stop nut 138 is secured to the second threaded end 111B to position the bores 81 of respective support trusses 12A and 12B in a pivotal relationship on the strut 109.

The construction shown on FIGS. 6 to 9 represents a preferred embodiment of securing the support frames 12A, 12B of a support truss 6 of the tent 2 together in a pivotal relationship such that a selected support truss 6 can be positioned on the eaves attachment cables 18A, 18B and ridge attachment cable 20, spaced at a selected distance from an adjacent support truss 6.

Figure 10:
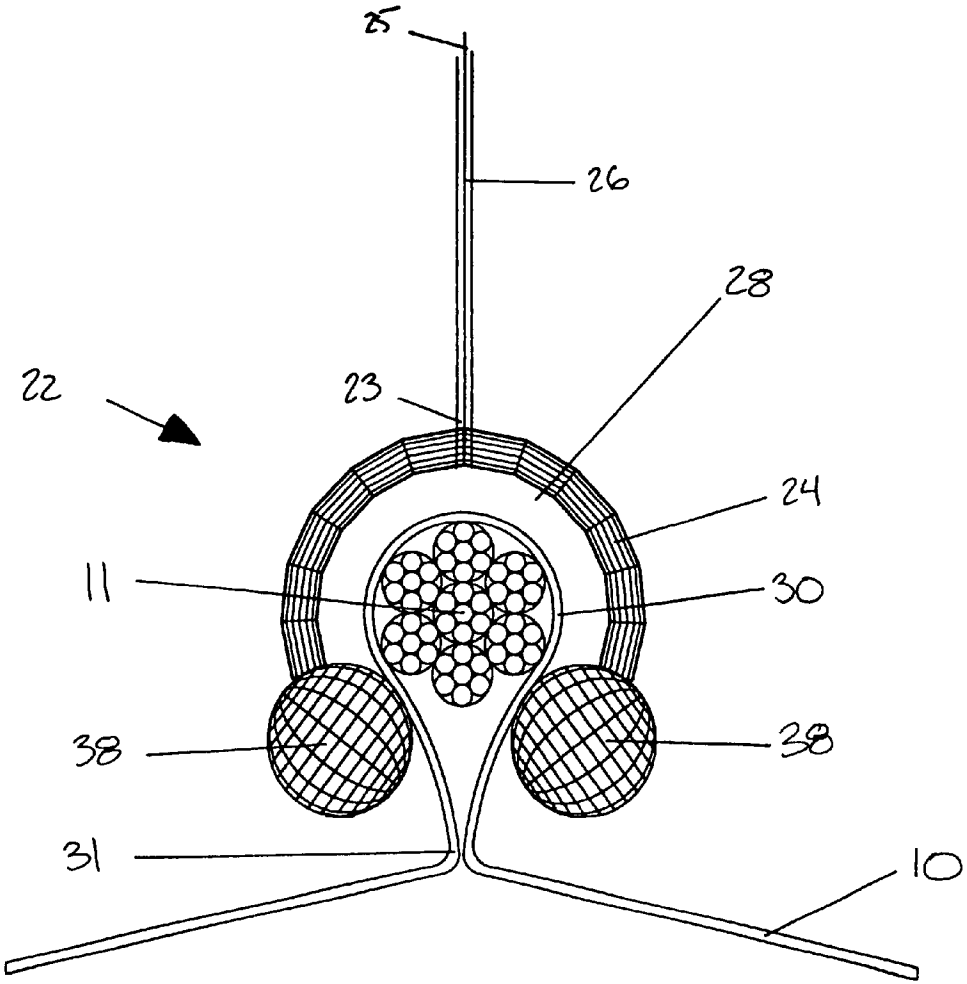
FIG. 10 shows a cross-section of a canopy attachment used to attach the canopy to a support truss as shown in FIG. 2.
Figure 11:
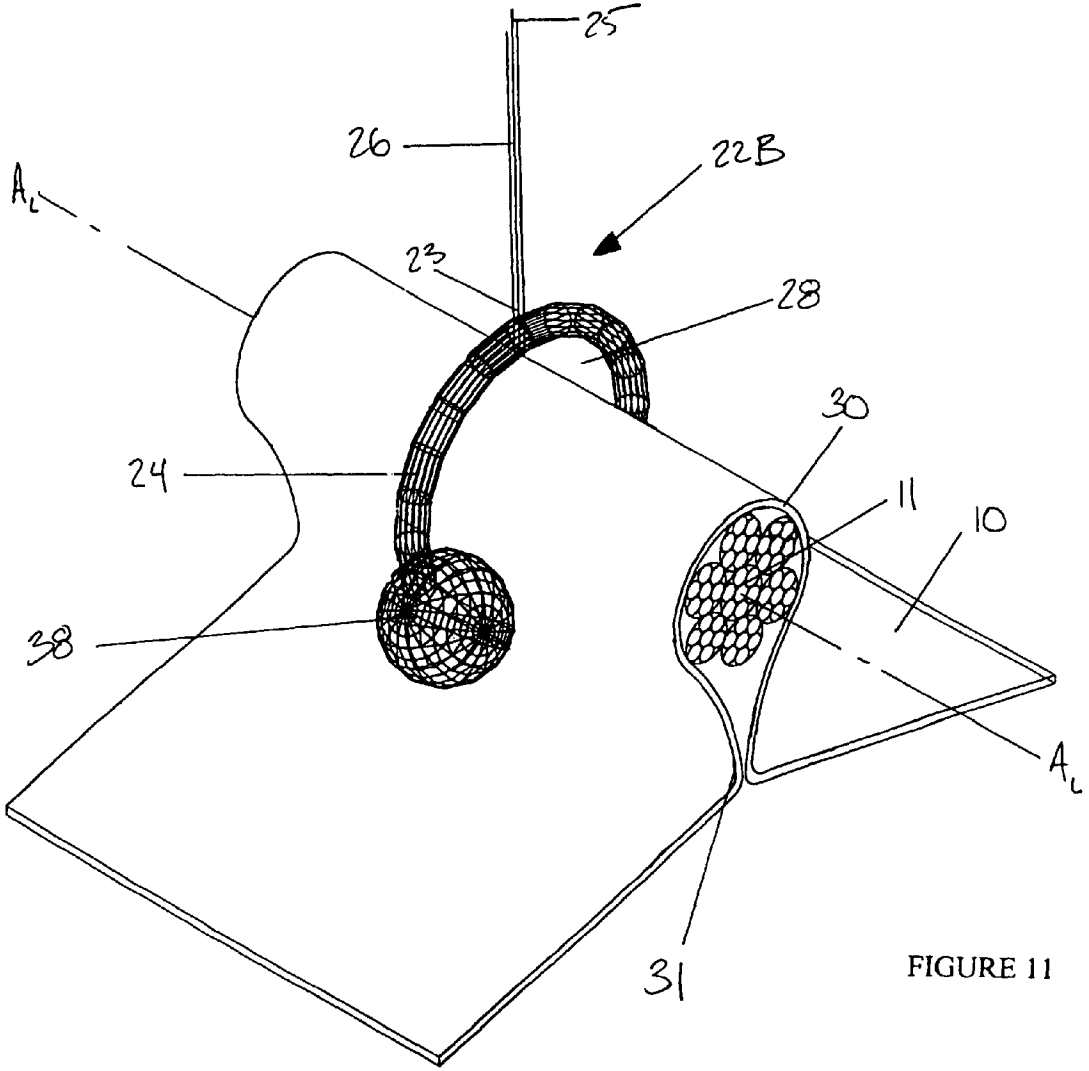
FIG. 11 shows a perspective view of the canopy attachment shown in FIG. 10 used to attach the canopy to a support frame at pivot point P shown on FIG. 2.
Figure 12:
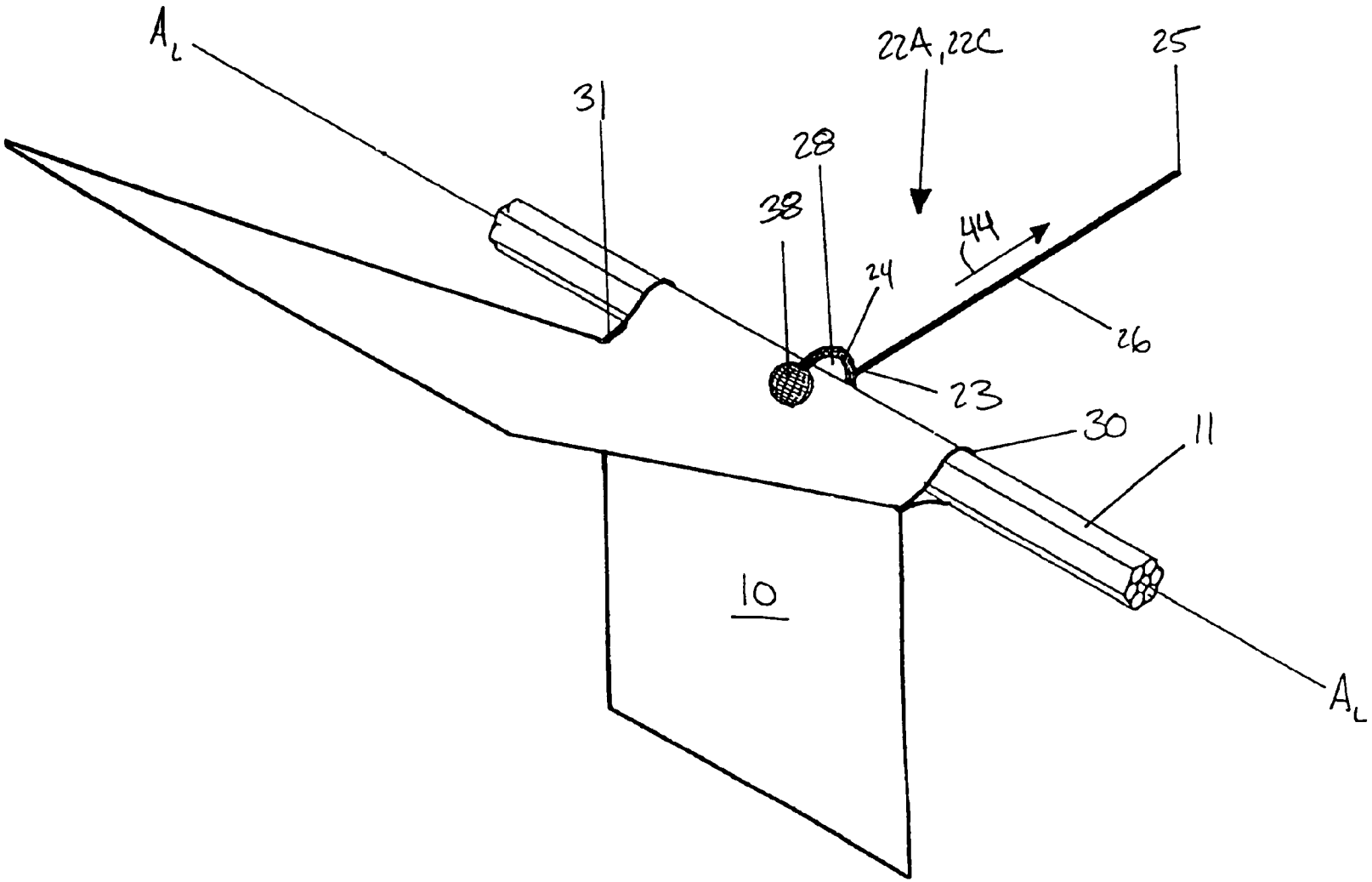
FIG. 12 shows a canopy attachment shown in FIG. 10 used to attach the canopy to a support frame proximate to struts 108, shown on FIG. 3.

As shown on FIG. 2, the support truss 6 of FIG. 1 has the flexible canopy 10 attached to support truss 6 by canopy attachments 22A, 22B shown in detail on FIGS. 10 to 12. Because the canopy 10 is positioned on the inside of the support truss 6, adjustment of the span X of the support truss 6 does not subsequently require an adjustment to the size of the canopy 10.

FIG. 10 shows a canopy attachment 22 having a C-shaped band 24 with two revolving balls 38 attached at each open end of the C-shaped band 24. While the revolving balls 38 are preferred, balls coated with Teflon™ could also be used. A tensioning cable 26 is attached to the C-shaped band 24 opposite to the revolving balls 38 of the C-shaped band 24. The tensioning cable 26 has a free end 25 which is opposite to the fixed end 23 attached to the C-shaped band 24. The fixed end 23 is attached to the C-shaped band 24 opposite to the revolving balls 38. The free end 25 is attached to the tent frame 2, preferably to either rafter pole 70, 72 at the proximal member ends 74, 78 or to the strut 109, or to the distal member ends 76, 80 or to the strut 108, as shown on FIG. 2 as canopy attachments 22A, 22B and 22C. The tensioning cable 26 is made of a metal wire, non-elastic cotton or polyester cable such that the free end 25 can be tied at varied tensions to adjust the tightness of the canopy 10 which hangs therein.

The canopy 10 is held by the canopy attachment 22 wherein a lead cable 11 is enclosed in a fold 30 of the canopy 10. The lead cable 11 is preferably a metal wire, or nylon or cotton rope or cord. The fold 30 encloses the lead cable 11 and thread, not shown, can be used to stitch the folded canopy 10 at loop portion 31, thereby fully enclosing the lead cable 11 within the loop 30 of canopy 10. The lead cable 11 is selected to have a diameter greater than the width of the opening between revolving balls 38, but smaller than an open space 28 of the C-shaped band 24. The canopy lead 11 is then fed through the open space 28 of the C-shaped band 24 such that the canopy 10 is suspended from the C-shaped band 24 as shown on FIG. 10.

FIG. 11 shows a cut-away portion of the canopy attachment 22B from a perspective view. FIG. 12 shows a cut-away portion of the canopy attachment 22A or 22C from a perspective view. As shown in FIGS. 11 and 12, the lead cable 11, which is substantially cylindrical in shape, is disposed in the open space 28 of the C-shaped band 24. The lead cable 11 is maintained within the open space 28 and the canopy 10 is supported by the canopy attachments 22A, 22B or 22C, as shown on FIG. 2.

The lead cable 11 allows the removal of the canopy 10 by pulling the lead cable 11 through the open space 28 in a direction parallel to the longitudinal axis of the lead cable 11, shown as $A_L$-$A_L$. To remove or partially remove the canopy 10 from the pivotal canopy attachment 22, the lead cable 11, together with the canopy 10, is pulled by a user from one lateral end of the tent 2, and the lead cable 11 slides through the open space 28. This construction of the canopy attachment 22, in particular with revolving balls 38, enables the easy removal, partial removal and/or replacement of the canopy 10 by a user, such that the canopy 10 is a retractable cover.

Preferably, the canopy 10 is substantially rectangular in shape and the lead cables 11 are positioned across one side of the canopy and are aligned substantially parallel to a longitudinal axis $A_L$-$A_L$ of the lead cables 11. It is further preferred that a central one of said lead cables 11 is positioned equidistant from either end of the substantially rectangular canopy 10 and two adjacent lead cables 11 are each spaced from the central lead cable 11 at a distance that is substantially the same as a length of the lower rafter poles 70, 72.

As such, with reference to FIG. 12, the tensioning cord 26 is attached to the C-shaped band 24 and has a free end 25 for attachment proximate to the upper member ends 54, 58 of the side support poles 48, 50, or the proximal member ends 74, 78 of the rafter poles 70, 72. Alternatively, the tensioning cord 26 could be attached to tubular strut 108. By such attachment of the free end 25, a force is selectively exerted on the tensioning cord 26 in the direction of arrow 44. In this manner, the canopy 10 may be tensioned to a variable degree by a user. The tension of the canopy 10 can be adjusted by tightening or loosening the tensioning cord 26 on the support truss 6.

It is contemplated that, as shown on FIGS. 11 and 12, the canopy 10 can be attached to the tent frame 2 by the canopy attachments 22A, 22B, 22C, as shown on FIG. 2. As shown on FIG. 2, the canopy 10 is not connected at the lower end of the support truss 6. The canopy 10 could be secured to the lower end of the support truss 6 using similar pivotal canopy supports 22, or the canopy 10 could optionally be secured to the ground 4 using pegs or other suitable securing means, not shown.

Figure 13:
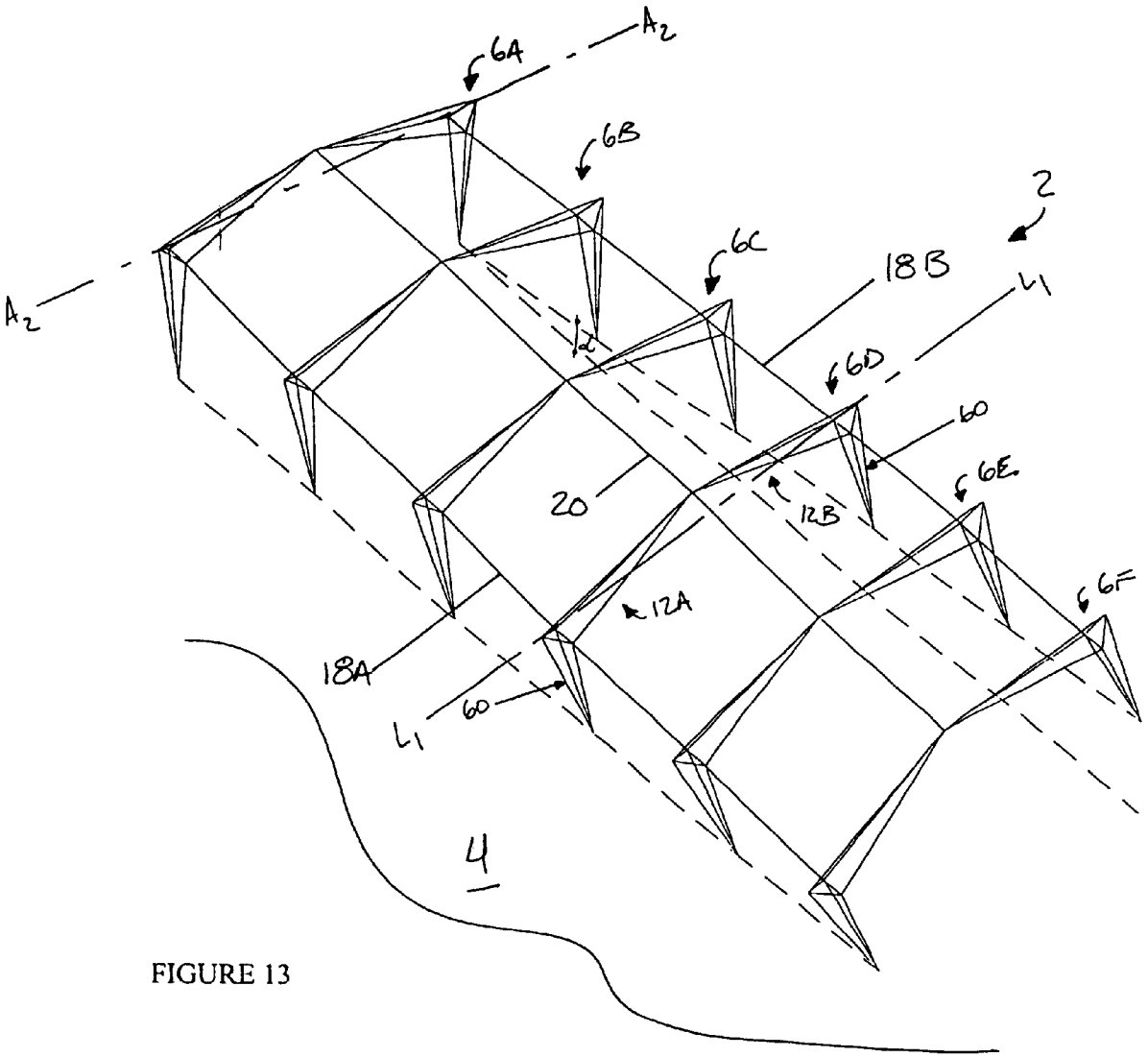
FIG. 13 shows a schematic perspective view of a tent which is set up on uneven ground according to another embodiment of the present invention.

FIG. 13 shows a schematic view of a tent 2 which is set up on uneven ground 4, in accordance with a further embodiment in which like reference numerals are used to identify like components. As shown, six support trusses 6A, 6B, 6C, 6D, 6E, 6F are connected together by eaves attachment cables 18A, 18B and a ridge attachment cable 20, and the support trusses 6A, 6B, 6C, 6D, 6E, 6F are positioned across a slope inclined to a horizontal line at an angle, shown as $\alpha$. The support trusses 6A, 6B, 6C, 6D, 6E, 6F are positioned adjacent to each other and spaced at a lateral distance substantially parallel to axis $A_2$-$A_2$. Because of the pivotal coupling of the elements of the side supports 14 and roof supports 16 of the support trusses 6A, 6B, 6C, 6D, 6E, 6F, the tent frame 2 will adjust such that the inner side support members 48, 50 will become inclined to vertical at an angle corresponding to the angle of the slope $\alpha$. As shown on FIG. 13, the support frames 12 of support trusses 6A, 6B, 6C, 6D, 6E and 6F are rotated with respect to each other parallel to axis $A_2$-$A_2$. Such rotation of the support frames 12 of support trusses 6A to 6F causes the canopy 10 to deform along the length of the tent frame 2, and the sides of the canopy 10 may deviate from the vertical plane. The area of the canopy 10 remains substantially constant.

As previously described, the side support members 48, 50 of a support frame 12 are substantially vertical when the tent frame 2 is assembled on substantially level ground. However, as shown on FIG. 13, as the frames 12 of support trusses 6A to 6F are rotated parallel to axis $A_2$-$A_2$, which causes the side support members 48, 50 to move out of the vertical plane, together with the canopy 10. Alternatively, the side support members 48, 50 can remain in the vertical plane for each support frame 12 of each support truss 6A to 6F by adjusting the length of respective central support members 60. This may be more advantageous for steeper slopes and/or uneven ground.

For example with respect to support truss 6D, the central support member 60 of the support frame 12B can be adjusted to a retracted position as compared to the central support member 60 of the support frame 12A and the inner side support members 48, 50 are positioned substantially vertical with respect to a longitudinal axis. In this construction, the eaves attachment cables 18A, 18B and the ridge attachment cable 20 are not parallel to each other. Also, the canopy 10 may not have plane surfaces throughout the tent frame 2.

By this construction, the tent frame 2 is advantageously adaptable on uneven terrain and is capable of following irregular ground contour, without delay in erection or changes in lengths and details of structural members or components.

Figure 14:
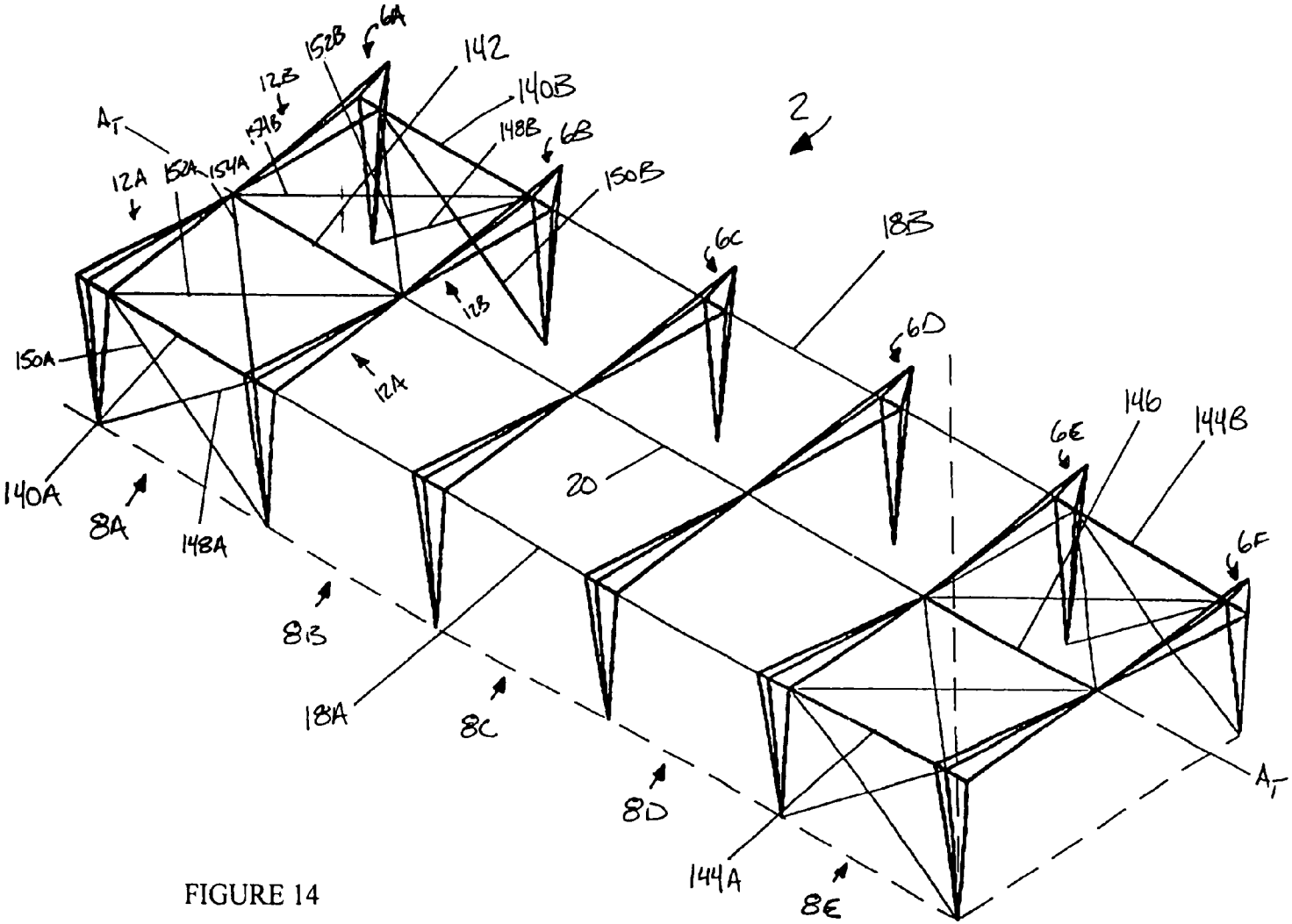
FIG. 14 shows a schematic perspective view of a tent having cross-bracing at end bays according to another embodiment of the present invention.

FIG. 14 shows a schematic perspective view of a tent 2 in accordance with another embodiment of the invention, wherein like reference numerals are used to identify like components. As shown on FIG. 14, the tent 2 is comprised of six support trusses 6A, 6B, 6C, 6D, 6E, 6F spaced apart laterally to form five bays 8A, 8B, 8C, 8D, 8E. The tent 2 shown on FIG. 14 has two end bays 8A, 8E and three interior bays 8B, 8C, 8D. In this embodiment, the eaves attachment cables 18A, 18B and ridge attachment cable 20, for the three interior bays 8B, 8C, 8D are cables secured to each support truss 6B, 6C, 6D, 6E, for example, using similar attachment means as shown on FIGS. 7 to 11. The eaves attachment cables 18A, 18B and ridge attachment cable 20 are preferably cables tensioned between interior bays 8B, 8C and 8D to position the support trusses 6B, 6C, 6D.

End bay 8A has rigid eaves attachment poles 140A, 140B and a rigid ridge attachment pole 142 which are elongated rigid metal or carbon-fibre poles. End bay 8E similarly has eaves attachment poles 144A, 144B and a ridge attachment pole 146 which are similarly elongated rigid metal or carbon-fibre poles. By this structure, support trusses 6A, 6B are stabilized against movement in line with axis $A_T$-$A_T$ by rigid eaves attachment poles 140A, 140B rigid ridge attachment pole 142. Similarly, support trusses 6E, 6F are stabilized against movement in line with axis $A_T$-$A_T$ by rigid eaves attachment poles 144A, 144B rigid ridge attachment pole 146.

Also shown on FIG. 14, the end bays 8A, 8E have cross-bracing to add lateral stability against loads acting parallel to axis $A_T$-$A_T$ of the tent 2. Side cross-braces 148A, 150A and 148B, 150B of respective support frames 12A, 12B, are formed of cables tensioned between adjacent support frames of the tent 2. As shown, side cross-brace 148A has a lower first end and a higher second end. The lower first end of side cross-brace 148A is attached proximate to bore 51 of support frame 12A of support truss 6A, and the higher second end of side cross-brace 148A is attached proximate to second side/roof joint 99 of the support frame 12A of adjacent support truss 6B. Side cross-brace 150A has a higher first end and a lower second end. The higher first end of side cross-brace 150A is attached proximate to first side/roof joint 97 of support frame 12A of support truss 6A, and the lower second end of cross-brace 150A is attached to bore 51 of support frame 12A of adjacent support truss 6B. The higher and lower ends of cross-braces 148A, 150A preferably have conventional mechanical clips attached thereto for connection to the tent frame 2. Side cross-braces 148B and 150B are similarly attached and tensioned between support frame 12B of support truss 6A, and support frame 12B of adjacent support truss 6B.

Roof cross-brace 152A has a first and a second end. The first end of roof cross-brace 152A is attached to the distal member end 76 of the first rafter pole 70 of support frame 12A of support truss 6A, and the second end of roof cross-brace 152A is attached to the proximal member end 78 of the second rafter pole 72 of support frame 12A of adjacent support truss 6B. Roof cross-brace 154A similarly has a first end and a second end. The first end of roof cross-brace 154A is attached to the proximal member end 74 of the first rafter pole 70 of support frame 12A of support truss 6A, and the second end of roof cross-brace 154A is attached to the distal member end 80 of the second rafter pole 72 of support frame 12A of adjacent support truss 6B. Preferably, the first and second ends of cross-braces 152A, 154A have conventional mechanical clips attached thereto and are attached to rafter poles 70, 72 by hooking the clips to o-rings which are fixed to the rafter poles at respective proximal member ends 74, 78 and distal member ends 76, 80. Roof cross-braces 152B and 154B are similarly attached and tensioned between support frame 12B of support truss 6A, and support frame 12B of adjacent support truss 6B.

Similar side and roof cross-bracing cables are connected and tensioned between the support frames at end bay 8E. The use of rigid eaves and roof members and cross-bracing wires at end bays 8A and 8E is advantageous as the tent 2 is further stabilized at either end and a plurality of support truss can be attached between end bays 8A and 8E using eaves attachment cables 18A and a ridge attachment cable 20.

Figure 15:
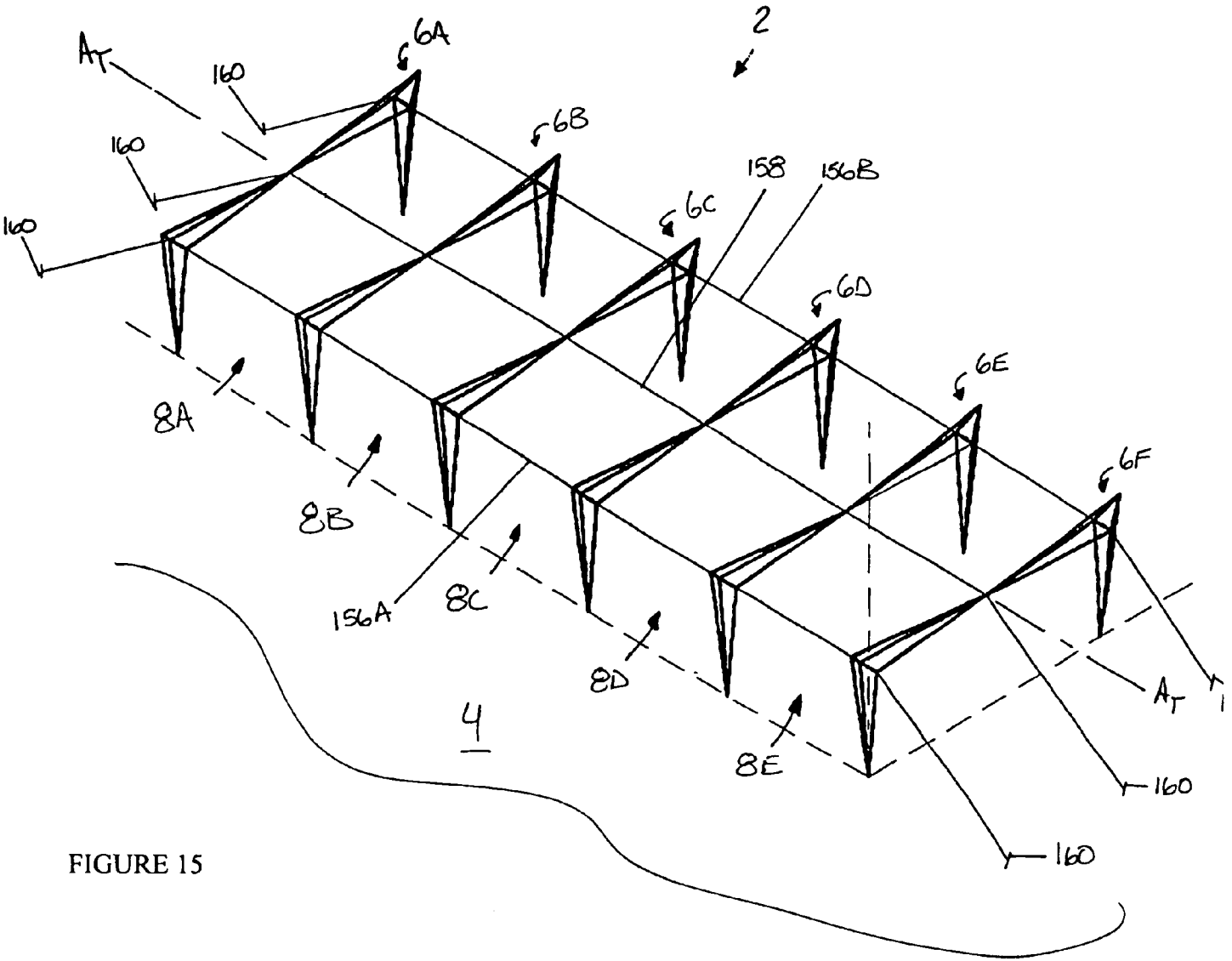
FIG. 15 shows a schematic perspective view of a tent with eaves and ridge support cables anchored to the ground according to another embodiment of the present invention.

Another embodiment of the tent 2 is shown on FIG. 15, wherein like reference numerals are used to identify like components. As shown on FIG. 15, the tent 2 is positioned on the ground 4 and is comprised of six support trusses 6A, 6B, 6C, 6D, 6E, 6F which are spaced apart laterally along axis $A_T$-$A_T$ to form five bays 8A, 8B, 8C, 8D, 8E.

Two lateral eaves attachment ropes 156A, 156B and one lateral ridge attachment rope 158 are attached to the support truss 6 of the bays 8A, 8B, 8C, 8D, 8E. Preferably, the eaves attachment cables 156A, 156B and ridge attachment cable 158 are attached to the support trusses 6A, 6B, 6C, 6D, 6E, 6F, using means similar to that described previously in the tent 2 of FIG. 1. The eaves attachment cables 156A, 156B and ridge attachment cable 158 are formed of metal, nylon, polyester or woven fibre and are attached to and tensioned between adjacent support trusses 6A, 6B, 6C, 6D, 6E, 6F of the tent 2. To stabilize the tent, the eaves attachment cables 156A, 156B and ridge attachment cable 158 are secured to the ground 4 beyond each lateral end of the tent 2. At a lateral end of the tent 2 having support truss 6A, the eaves attachment cables 156A, 156B and ridge attachment cable 158 extend laterally adjacent to the tent 2 in the direction of axis $A_T$-$A_T$, and are secured to the ground 4 by soil anchors or counter weights 160. At an opposite lateral end of the tent 2 having support truss 6F, the eaves attachment cables 156A, 156B and ridge attachment cable 158 extend laterally adjacent to the tent 2 in the direction of axis $A_T$-$A_T$ and are secured to the ground 4 by soil anchors or counter weights 160. While it is contemplated that the eaves attachment cables 156A, 156B and ridge attachment cable 158 are anchored to the ground 4, it is to be appreciated that other suitable means could be used to tension the cables 156A, 156B and 158. By anchoring the eaves attachment cables 156A, 156B and ridge attachment cable 158 to the ground, the tent 2 is advantageously further stabilized without the use of cross-bracing.

Figure 16:
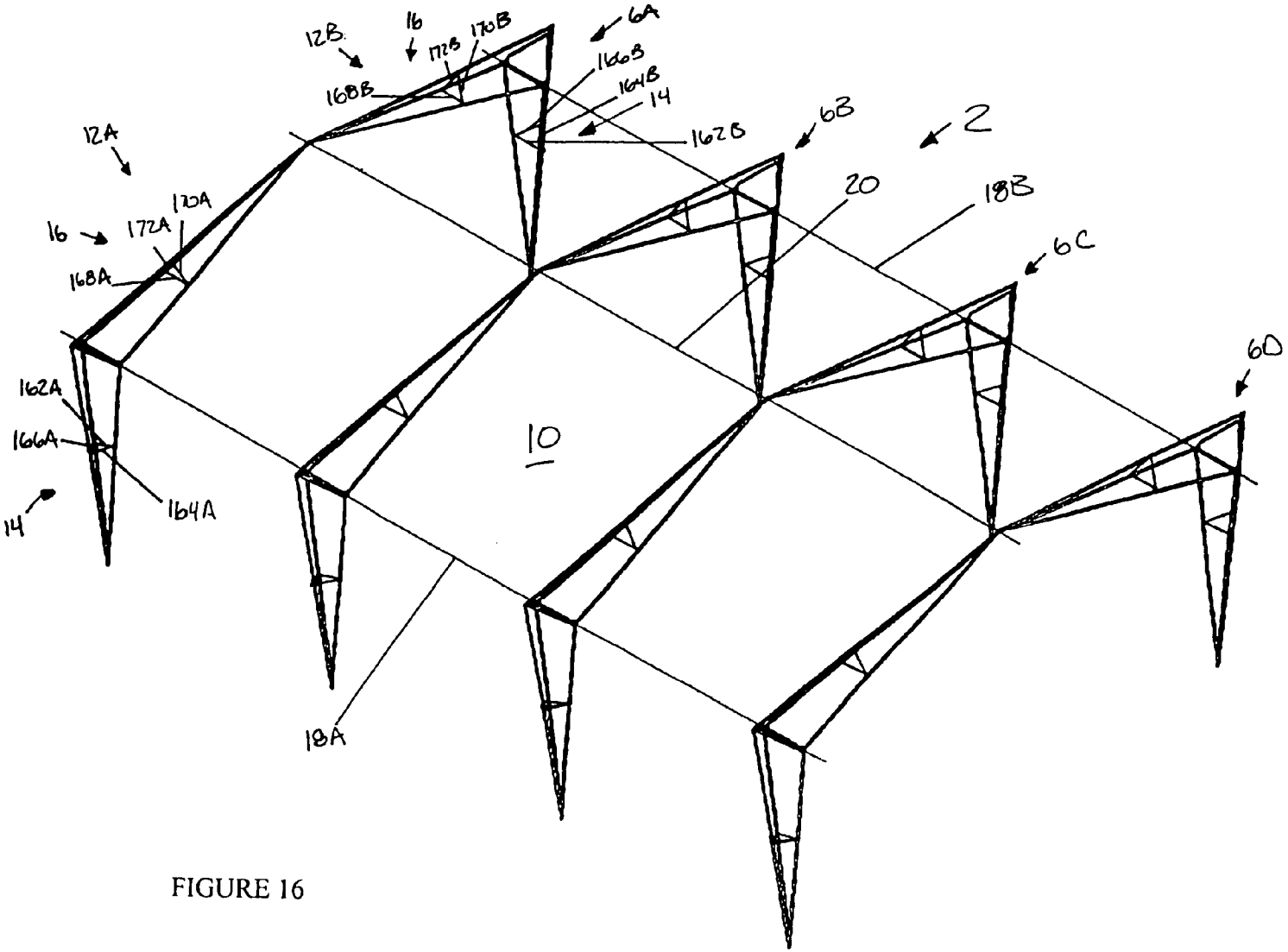
FIG. 16 shows a schematic perspective view of a tent with lateral brackets according to another embodiment of the present invention.

FIG. 16 shows a tent 2 in accordance with another embodiment of the invention wherein like reference numerals reference to like features. The tent 2 has four support trusses 6A, 6B, 6C, 6D which are connected by eaves attachment cables 18A, 18B and a ridge attachment cable 20, as for example has been described in the tent 2 of FIG. 1. As shown, end support truss 6A comprises two support frames 12A, 12B having side supports 14 and roof supports 16. As shown on FIG. 16, side brackets 162A, 164A, 166A are attached to side support 14 of support frame 12A, and side brackets 162B, 164B, 166B are attached to side support 14 of support frame 12B. Each side bracket 162A, 162B, 164A, 164B, 166A, 166B is a rigid metal or carbon-fibre bar having two ends. Preferably, each end has a c-shaped clamp that is sized to fit around side support poles 48, 50 and central support member 60 in a friction-fit or snap-fit relationship, although other suitable means for removable placement of the side brackets 162A, 162B, 164A, 164B, 166A, 166B are contemplated.

First side bracket 162A has a first end attached to the first side support pole 48 and a second end attached to the second side support pole 50. Second side bracket 164A has a first end attached to the central support member 60 and a second end attached to the first side support pole 48. Third side bracket 166A has a first end attached to the central support member 60 and a second end attached to the second side support pole 50. The side brackets 162A, 164A, 166A are removably attached between the support members to add structural strength to the side support 14 of the tent frame 2. As shown, the side brackets 162A, 164A, 166A are spaced generally equidistant along the length of the side support 14.

Similarly, first side bracket 162B has a first end attached to the first side support pole 48 and a second end attached to the second side support pole 50. Second side bracket 164B has a first end attached to the central support member 60 and a second end attached to the first side support pole 48. Third side bracket 166B has a first end attached to the central support member 60 and a second end attached to the second side support pole 50. The side brackets 162B, 164B, 166B are removably attached between the support members to add structural strength to the side support 14 of the tent frame 2. As shown, the side brackets 162B, 164B, 166B are spaced generally equidistant along the length of the side support 14. Such side brackets 162A, 162B, 164, 164B and 166A, 166B are particularly advantageous for longer spans of the side supports 14 to increase structural strength by reducing the slenderness of the side support poles 48, 50 and the central support member 60, and thereby to avoid the buckling failure of the compression members of the tent frame 2.

Also shown on FIG. 16, roof brackets 168A, 170A, 172A are attached to the roof support 16 of support frame 12A, and side brackets 168B, 170B, 172B are attached to roof support 16 of support frame 12B. Each roof bracket 168A, 168B, 170A, 170B, 172A and 172B are rigid metal or carbon-fibre bars having two ends. Similar to the side bracket ends, each roof bracket end preferably has a c-shaped clamp that is sized to fit around the rafter poles 70, 72 and central roof member 82 in a friction-fit or snap-fit relationship, although other suitable means for removable placement of roof brackets 168A, 168B, 170A, 170B, 172A, 172B are contemplated.

First roof bracket 168A has a first end attached to the first rafter pole 70 and a second end attached to the second rafter pole 72. Second roof bracket 170A has a first end attached to central roof pole 82 and a second end attached to the first rafter pole 70. Third roof bracket 172A has a first end attached to central roof pole 82 and a second end attached to second rafter pole 72. The roof brackets 168A, 170A, 172A are removably attached between support members of the roof support 16 to add structural stability to the roof support 16 of the tent 2. As shown, the roof brackets 168A, 170A, 172A are spaced generally equidistant along the length of the roof support 16.

Similarly, first roof bracket 168B has a first end attached to the first rafter pole 70 and a second end attached to the second rafter pole 72. Second roof bracket 170B has a first end attached to the central roof pole 82 and a second end attached to the first rafter pole 70. Third roof bracket 172B has a first end attached to the central roof pole 82 and a second end attached to the second rafter pole 72. As shown, the roof brackets 168B, 170B, 172B are spaced generally equidistant along the length of the roof support 16A. The roof brackets 168B, 170B, 172B are removably attached between support members of the roof support 16 to add structural stability to the roof support 16 of the tent 2, which is particularly advantageous for longer spans of the roof support 16 to increase structured strength of the rafter poles 70, 72 and central roof pole 82 especially due to the weight of the canopy 10.

As mentioned, the side and roof brackets are removably attached so as to not interfere with the adjustability of a support frame 12 at different longitudinal span adjustments to the tent 2. To adjust the longitudinal span of a support frame 12, the side and roof brackets are removed, the longitudinal span of the support truss is adjusted, including the extension or retraction of respective extensible central support members 60, and the side and roof brackets are replaced.

Figure 17:
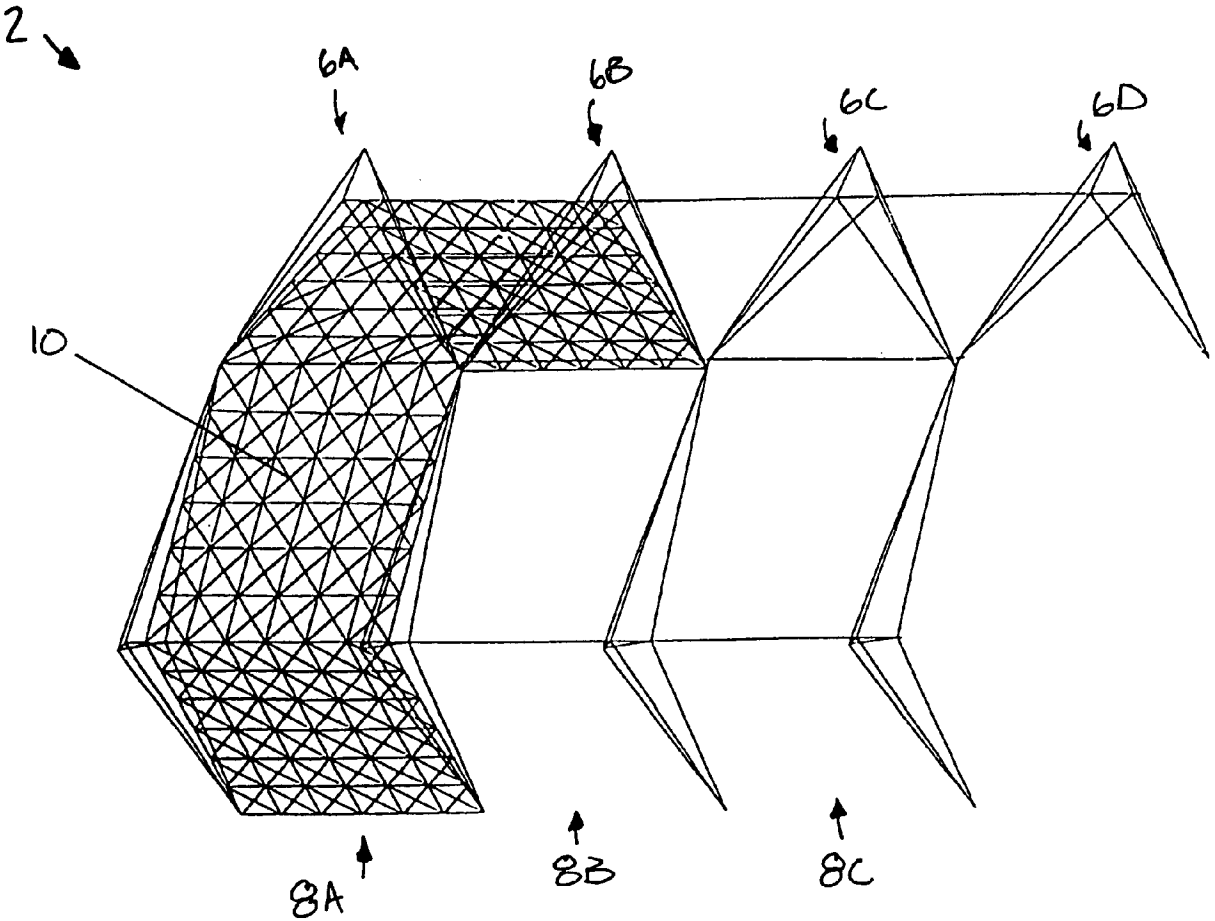
FIG. 17 shows a schematic perspective view of the tent shown in FIG. 1, with a canopy suspended in one bay.

FIG. 17 shows a schematic perspective view of the tent 2 shown in FIG. 1, shown with the canopy 10 covering only end bay 8A. As previously mentioned, the canopy 10 is partially removed by pulling the canopy 10 from one lateral end of the tent 2. Although not shown, the lead 11 slides through the C-shaped band 24 at canopy attachments 22A, 22B, 22C shown attached to the support truss 6 in FIG. 2.

Figure 18:
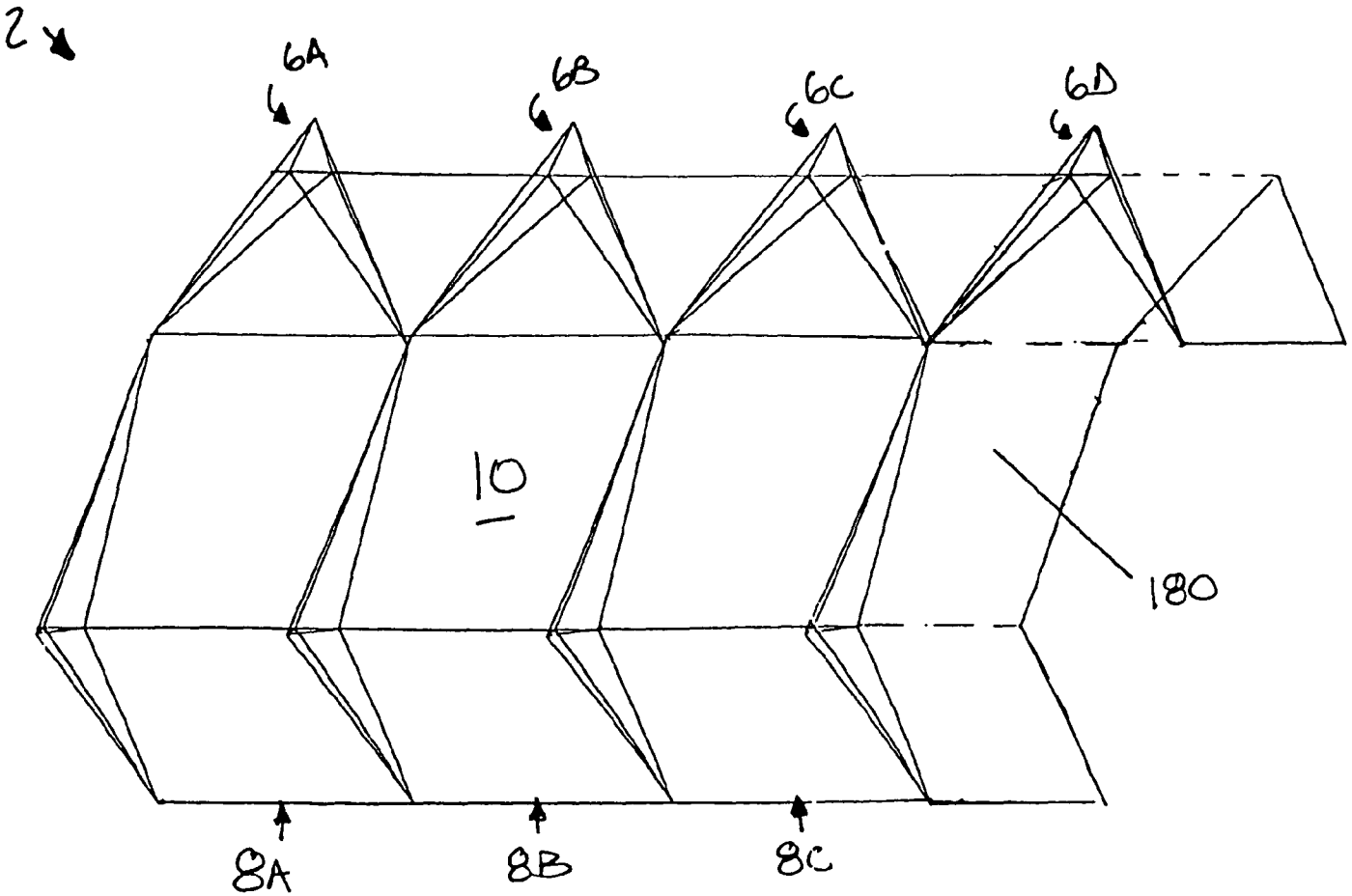
FIG. 18 shows a schematic perspective view of the tent shown in FIG. 1, with the canopy extending past an end of the tent.

FIG. 18 shows a schematic perspective view of the tent 2 shown in FIG. 1, shown with the canopy extension 180. As shown, the canopy 10 has a canopy extension 180 extending laterally past the end of support frame 6D. The canopy extension can be folded to enclose the area at the end bay 8F. It is also contemplated that the canopy 10 can enclose either or both ends of the tent 2.

Figure 19:
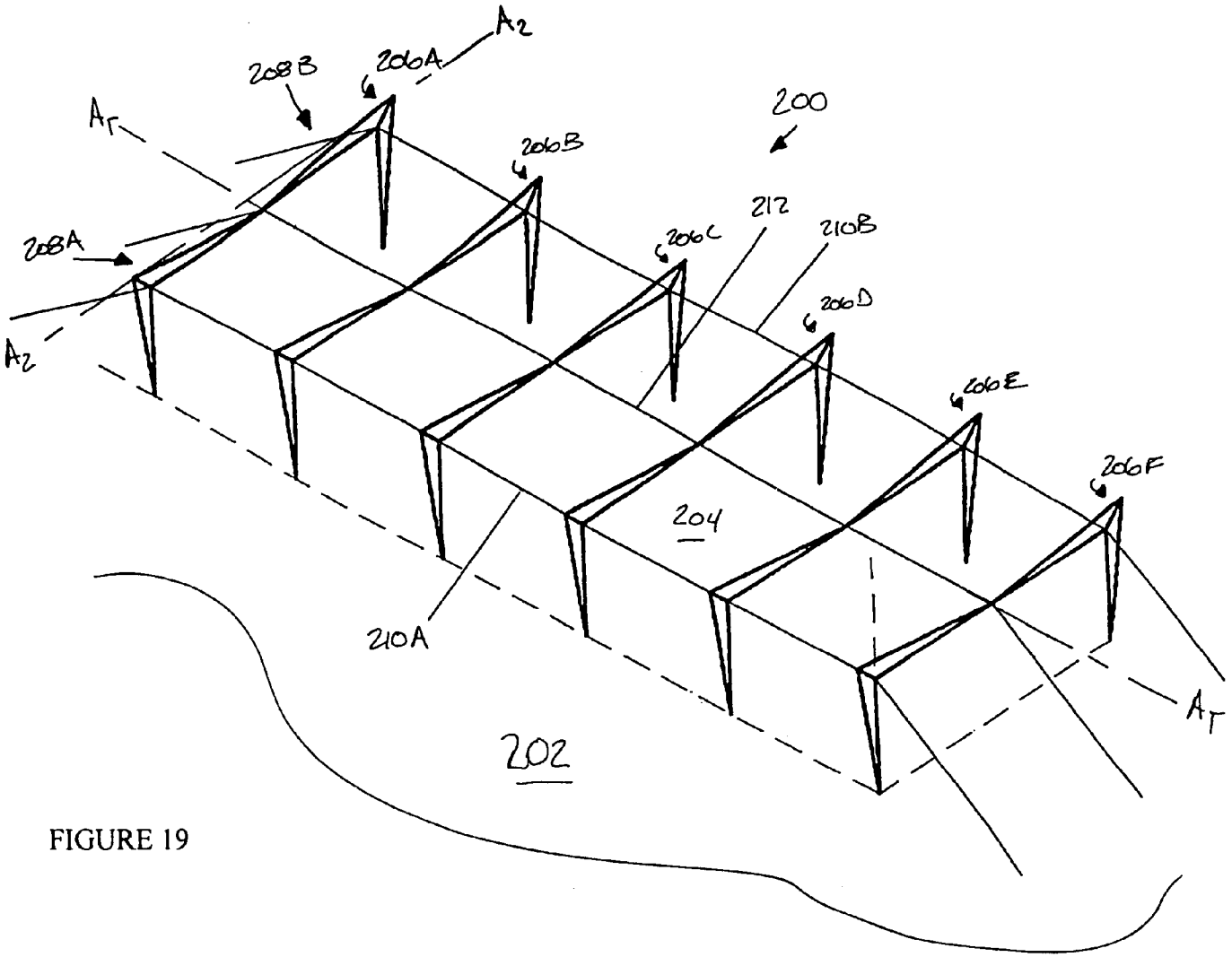
FIG. 19 shows a schematic perspective view of a simplified tent with planar support trusses in accordance with a further embodiment of the present invention.

FIG. 19 shows a simplified construction of an adjustable planar frame tent 200 shown from a schematic perspective view. The tent 200 shown on FIG. 19 is assembled on the ground 202 and has six rigid metal or carbon-fibre support trusses 206A, 206B, 206C, 206D, 206E, 206F and a flexible canopy 204, two eaves attachment cables 210A, 210B, and a ridge attachment cable 212. The support trusses 206A, 206B, 206C, 206D, 206E, 206F are positioned laterally spaced from each other along the axis $A_T$-$A_T$, each support truss 206A, 206B, 206C, 206D, 206E, 206F is symmetrical about the axis $A_T$-$A_T$, and each comprises substantially similar support frames 208A, 208B which are identical. As will be described, the canopy 204, formed of canvass, cloth or other suitable material, is secured to the inner side of the support trusses 206A, 206B, 206C, 206D, 206E, 206F to complete the tent 200. In this construction, the tent 200 provides a sheltered enclosure covering an area of ground 202 which, in a simplified embodiment, comprises six support trusses 206 and has a length selected at between about 18 meters and 24 meters and a width selected at between about 4 meters and 7 meters.

Figure 20:
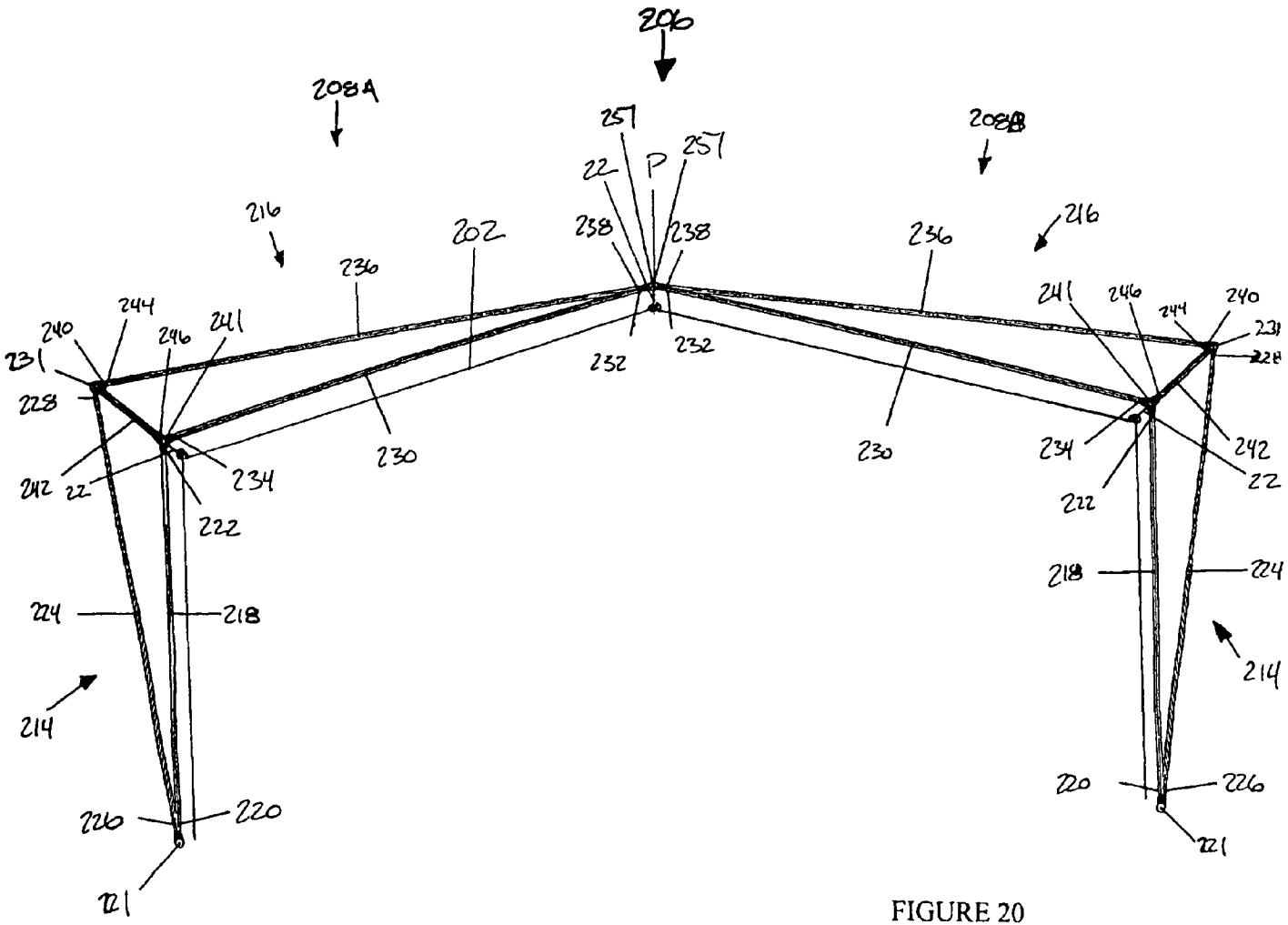
FIG. 20 shows a side view of a support truss used in the tent shown in FIG. 19.

FIG. 20 shows the support truss 206 of the tent 200 shown in FIG. 19 from a side view. Each support frame 208A, 208B has a respective side support 214 and roof support 216.

The side supports 214 have a rigid metal or carbon-fibre inner side pole 218 elongated between a flattened lower member end 220 and a flattened upper member end 222. The side supports 214 also have a rigid metal or carbon-fibre outer side pole 224 having a flattened lower end 226 and a flattened upper end 228. The outer side pole 224 is preferably extensible in length between a retracted position and an extended position, for example, by using the extensible central support member shown in FIG. 5. As shown on FIG. 20, each of the lower member end 220 and lower end 226 have a bore 221 formed there through. A bolt or other suitable mechanical fastener, not shown, is inserted through the bore 221 to pivotally couple the inner side pole 218 and outer side pole 224 so that each lies substantially in a plane extending substantially vertically through axis $A_2$-$A_2$.

The roof supports 216 have a rigid metal or carbon-fibre lower rafter pole 230 elongated between a flattened proximal member end 232 and a flattened distal member end 234. The roof supports 216 also have an upper rafter pole 236 elongated between a flattened proximal end 238 and a flattened distal end 240. As shown on FIG. 18, each of the proximal member end 232 and proximal end 238 are pivotally coupled together by the insertion of the ridge attachment cable 20 through a bore 151 of each support frame 208A, 208B to form a pivot point P. By this construction, the lower rafter pole 230 and upper rafter pole 236 are positioned in planar alignment so that each lies substantially in the plane extending substantially vertically through axis $A_2$-$A_2$.

Each support frame 208A, 208B also has a rigid link member 242. Each link member 242 extends from a first flattened end portion 244 to a second flattened end portion 246.

The first end portion 244 of the link member 242, the upper end 228 of the outer side pole 224 and the distal end 240 of the upper rafter pole 236, each have a hole 231 formed there through and are pivotally coupled by a bolt or other suitable mechanical fastener inserted through the hole 231. The second end portion 246 of the link member 242 and each of the upper member end 222 of the inner side pole 218 and the distal member end 234 of the lower rafter pole 230 have a bore 241 formed there through, and are pivotally coupled to each other by insertion of respective eaves attachment cables 210A, 210B there through, preferably with an assembly as shown on FIG. 9.

As shown on FIG. 20, the support truss 206 is symmetrical about the pivot point P. The support frames 208A, 208B are pivotally connected at pivot point P such that the respective upper rafter poles 236 are substantially co-planar and the support truss 206 is substantially planar in the vertical plane extending through axis $A_2$-$A_2$. Similar to the tent 2 shown on FIG. 1, the support frames 208A, 208B of the tent 200 are pivotally connected to enable the tent ridge cable 212 to be vertically raised or lowered to allow overall adjustment in the height of the tent by varying the span of the support truss 206 in the direction of axis $A_2$-$A_2$, as shown on FIG. 19.

As shown, the support trusses 206A, 206B, 206C, 206D, 206E, 206F are connected by two eaves attachment cables 210A, 210B and a ridge attachment cable 212. As previously mentioned, the eaves attachment cables 210A, 210B pass through bores 241 of respective support frames 208A, 208B. The eaves attachment cables are further secured to the support truss 206 by a clamp or other suitable fastening means. For example, a shortened hollow strut, such as are described on FIG. 9 could be used in conjunction with a slotted wedge to secure the eaves attachment cables 210A, 210B to the support frames 208A, 208B. Ridge attachment cable 212 similarly passes through bore 251 and is similarly secured to the support frames 208A, 208B at pivot point P, preferably using the assembly shown on FIG. 9.

As shown on FIG. 20, the canopy 204 is attached to the tent frame 200 using the pivotal canopy attachments 22 as shown on FIGS. 10 to 12.

While the canopy 10 has been disclosed as being attached to the tent frame 2 using canopy attachments 22, the invention is not intended to be so limiting. Optionally, the canopy leads 11 could be attached to the tent frame 2 using cleats or similar friction fit grips as are used in sailing to fix a rope at a desired position. Similar cleats or friction-fit grips could also be used to attach the canopy 10 at the lower ends of the side supports 12A, 12B.

While the members comprising the tent frame 2 are contemplated as being tubular members with crimped ends in a preferred embodiment, other suitable members could be substituted. Members that are subjected to both tension and compression can be fabricated from a wide variety of shapes and materials. Also, the members may optionally be formed from galvanized steel, a metal alloy resistant to rust, aluminium, composite fibreglass carbon-fibre or like materials.

While it is contemplated that the eaves attachment cables 18A, 18B and ridge attachment cable 20 are cable tensioned between adjacent support trusses 6, rigid poles could be connected between each adjacent support truss to form the tent 2.

The members shown on the support truss 6 of FIG. 3 are elongated tubular metal poles with flattened ends and holes through the ends, although the invention is not intended to be so limiting. The pivotal coupling of the members is formed by positioning bolts or pipes through respective holes in the flattened ends of the tubular poles, although such mechanical fasteners are not necessary and other means operable to pivotally couple the members could be used.

Figure 21:
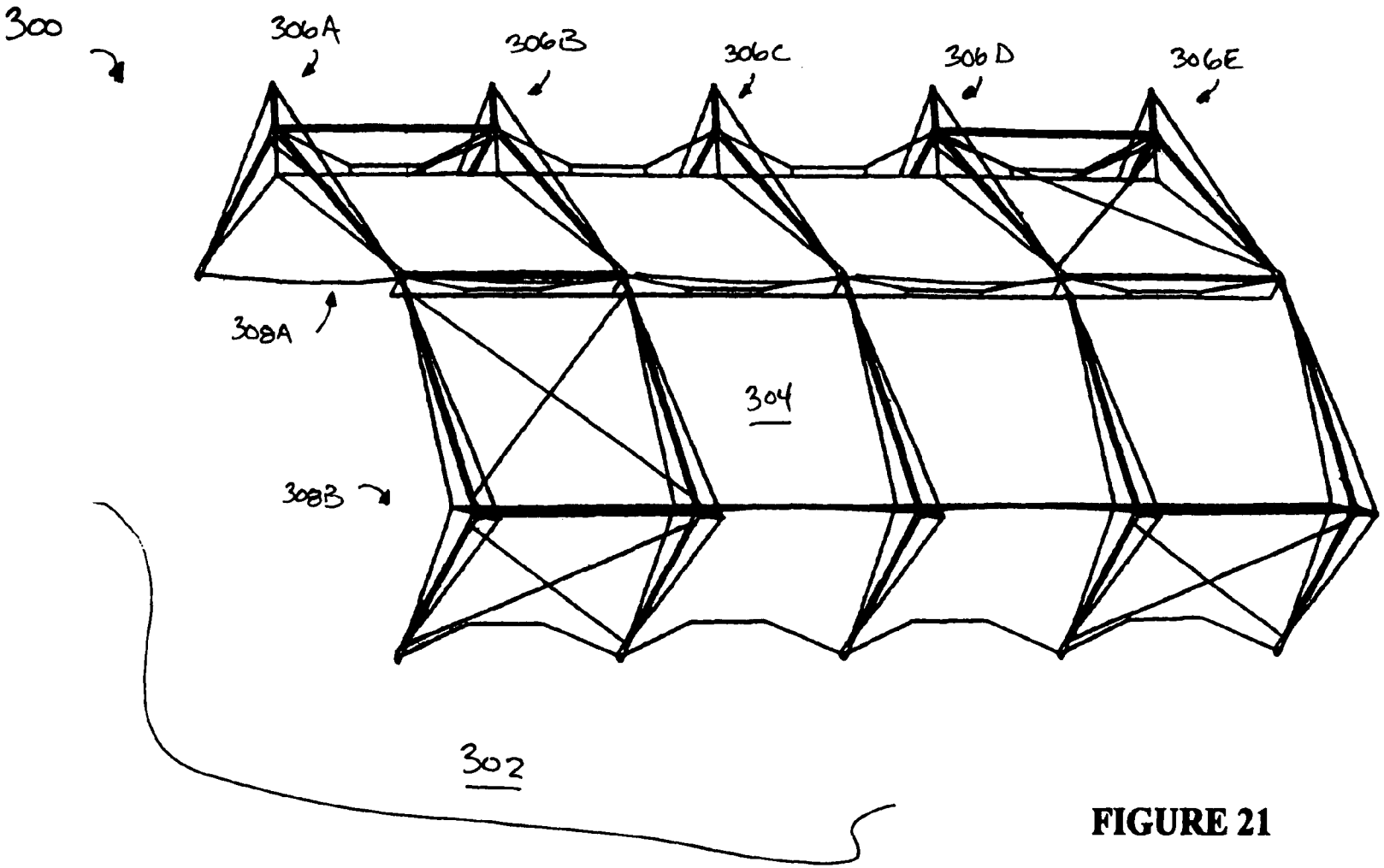
FIG. 21 shows a schematic perspective view of a tent in accordance with another embodiment of the present invention.
Figure 24:
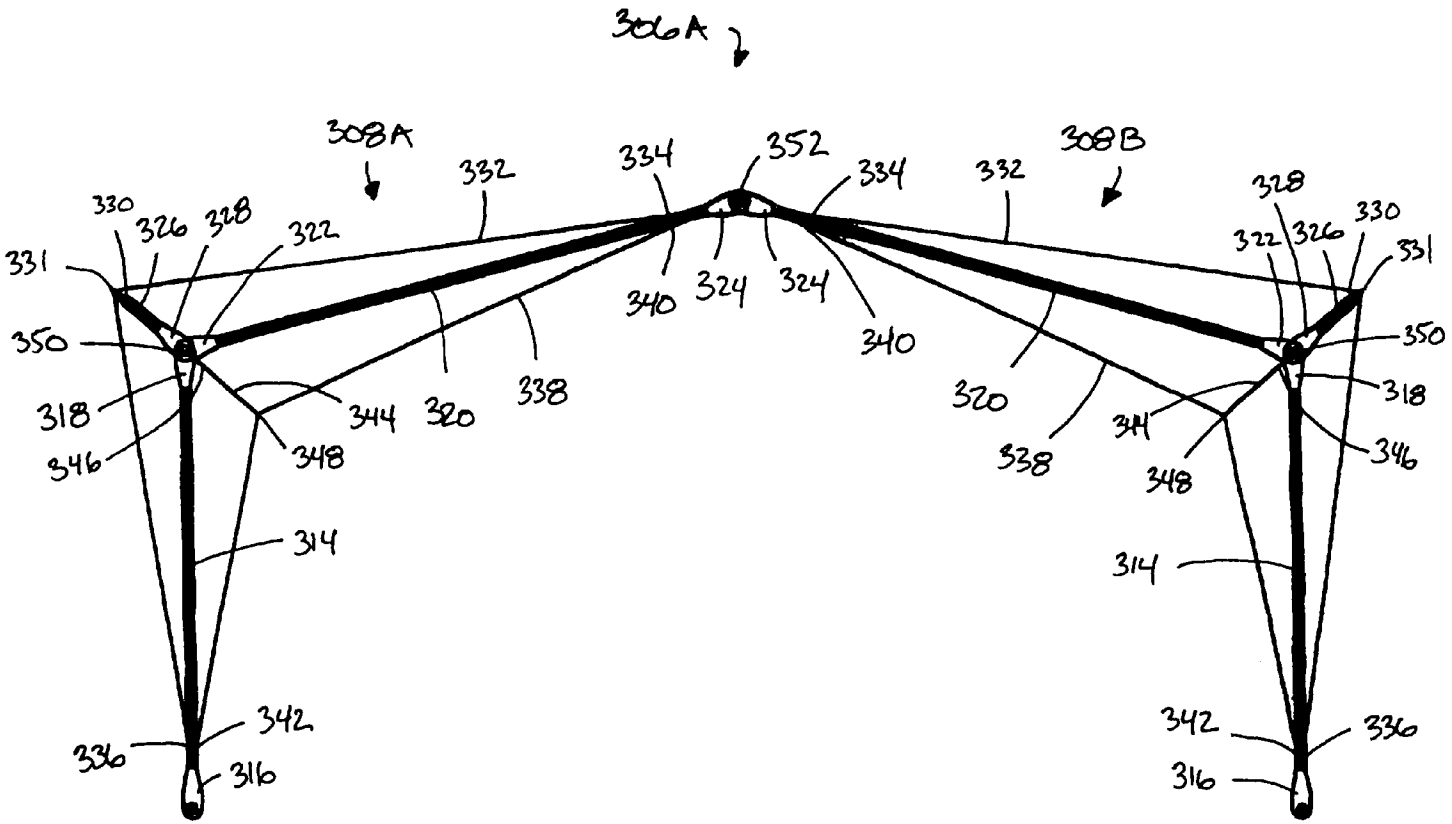
FIG. 24 shows an end view of a support truss used in the tent shown in FIG. 21.

FIG. 21 shows a further simplified construction of an adjustable planar frame tent 300 shown from a schematic perspective view. The tent 300 shown on FIG. 21 is assembled on the ground 302 and has five support trusses 306A, 306B, 306C, 306D and 306E. A flexible canopy 304 is secured to an inner side of the support trusses 306A, 306B, 306C, 306D and 306E. Each of the support trusses 306A, 306B, 306C, 306D and 306E is comprises of substantially similar support frames 308A and 308B, as shown in FIG. 24. Cross bracing members are provided as for example are shown on FIG. 14 and the cross bracing members shown on FIG. 24 can be attached in the same manner as described for FIG. 14.

Figure 22:
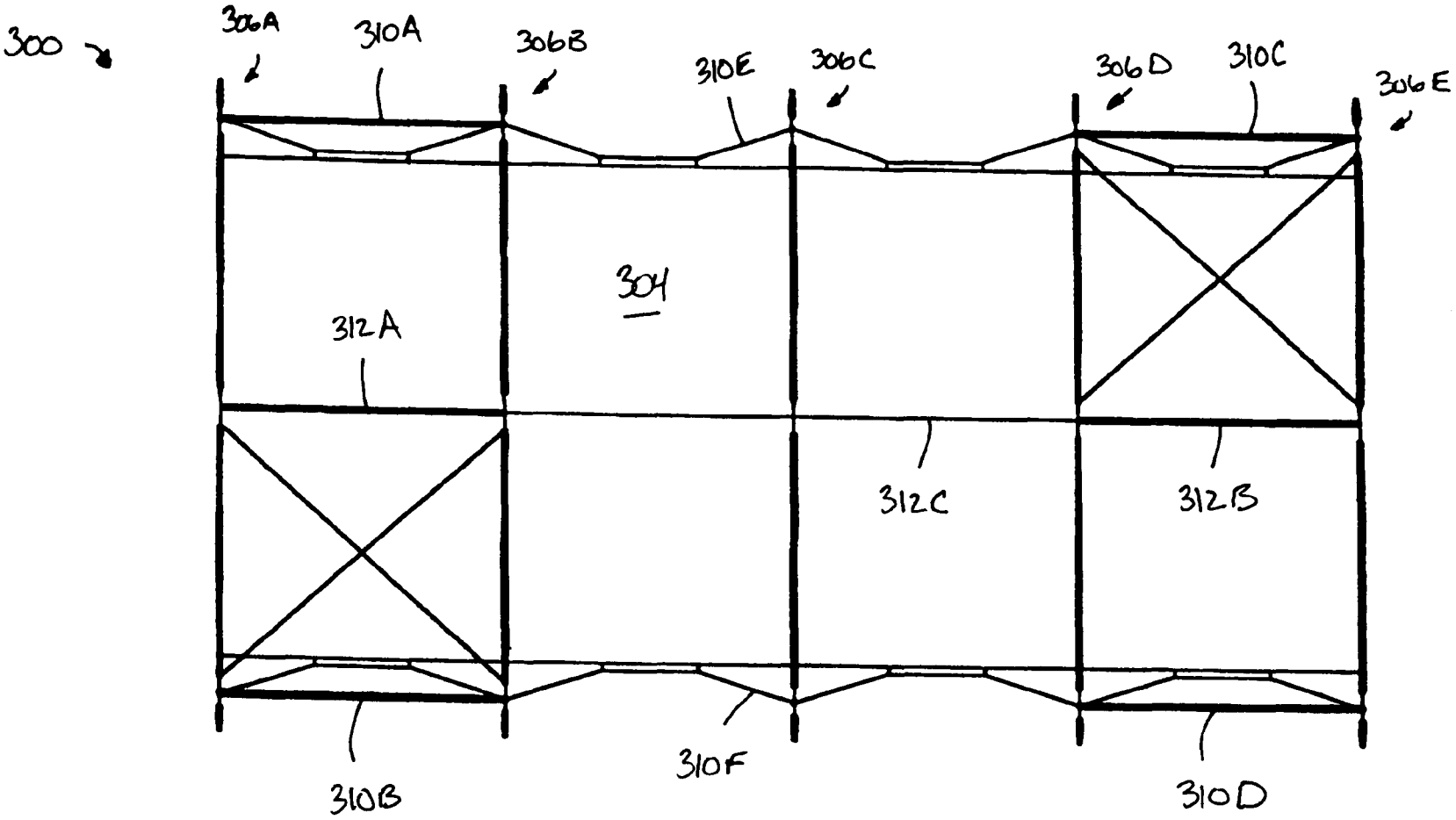
FIG. 22 shows the tent of FIG. 21 in top view.
Figure 23:
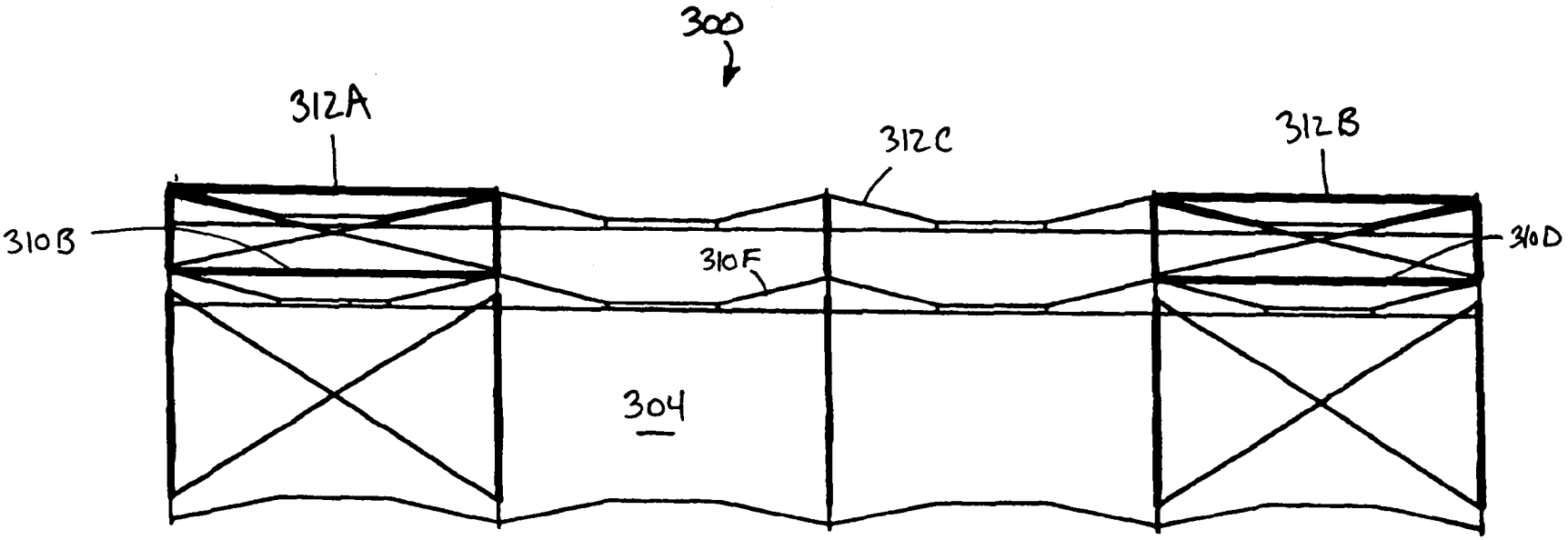
FIG. 23 shows the tent of FIG. 21 in side view.

FIGS. 22 and 23 show the tent 300 from top and side views, respectively. As shown, support trusses 306A and 306B are connected by rigid eaves attachment member 310A and 310B and rigid ridge attachment member 312A, as shown. Similar rigid eaves attachment members 310C and 310D and rigid eaves member 312B connect the adjacent support trusses 306D and 306E. The support truss 306C is positioned between support trusses 306B and 306D by tensile eaves attachment members 310E and 310F and tensile ridge attachment 312C.

FIG. 24 shows the tent 300 of FIG. 21 in end view whereby support truss 306A has identical support frames 308A and 308B. Each of the support frames 308A and 308B has a rigid side member 314. As shown in FIG. 24, the side support 314 has a rigid metal or carbon-fibre elongated tubular construction with a side support and lower end 316 and a side support upper end 318. Each support frame 308A and 308B also has a rigid roof support 320 comprising an rigid metal or carbon-fibre tubular pole having a flattened distal end 322 and a flattened proximal end 324.

Each support frame 308A and 308B further has a first rigid link member 326 which also comprises a rigid metal or carbon-fibre tubular pole elongated between a flattened first end portion 328 and a second end portion 330 having a first tension member deflector 331 thereon. In a simplified embodiment, the first tension member deflector 331 is a ring through which the tension member 332 is threaded.

A first tension member 332 is a rope or cable fixed to the proximal end 324 and the lower end 316 and passes through the first tension member deflector 331, for example a ring, so as to be in tension at an outer side of the support truss 306A. The first tension member 332 is fixed to the proximal end 324 and lower end 316 for example by passing an end of the first tension member 332 through a respective hole in the proximal end 324 and lower end 316, not shown, and then tying the end of the first tension member 332 so that a sufficient tension is maintained.

A second tension member 338 is positioned at a inside of the support truss 306A. The first end 340 of the second tension member 338 is connected at the proximal end 324 and a second end 342 of the second tension member 338 is connected at the lower end 316. A similar connection as was described with respect to the first tension member can be used with the second tension member. A second tensile link member 344 is provided to deflect the second tension member 338 proximate to the distal end 322. The second link member has a first end portion 346 connected to the pivotal coupling of the first end portion of the first link member 328, the distal end 322 and the upper end 318. In a simplified embodiment, the first end portion 346 has a hook which is positioned over a bolt or slot which is used in the pivotal coupling. A second member end 348 of the second link member 344 has a second tension member deflector 348 thereon. In a simplified embodiment, the second tension member deflector is a ring through which the second tension member 338 is threaded.

In a preferred commercial embodiment, the side support 314 has a minimum length of 8 feet such that the overhead clearance of the tent adjacent the side support 314 is 8 feet. The roof support 320 may also have a minimum longitudinal length of 8 feet. In a preferred commercial embodiment, each of the side support 314 and roof support 320 are telescopic poles, as shown in FIG. 5.

In a preferred commercial embodiment, the first link member 326 and/or the second link member 344 have a longitudinal length which is approximately one-fourth the longitudinal length of the side support 314.

To assemble the rigid members, the first end portion 328 of the first link member 326, the distal end 322 of the roof support member 320 and the upper end 318 of the side support member 314, each have a hole 350 formed therethrough and are pivotally coupled by a bolt or other suitable mechanical fastener inserted in the hole 350. In a similar manner, each of the respective proximal ends 324 of each respective roof support member 320 of the support truss 306A has a hole 352 formed therethrough and are pivotally coupled to each other by insertion of a bolt or other suitable mechanical fastener inserted through the hole 352.

Figure 31:
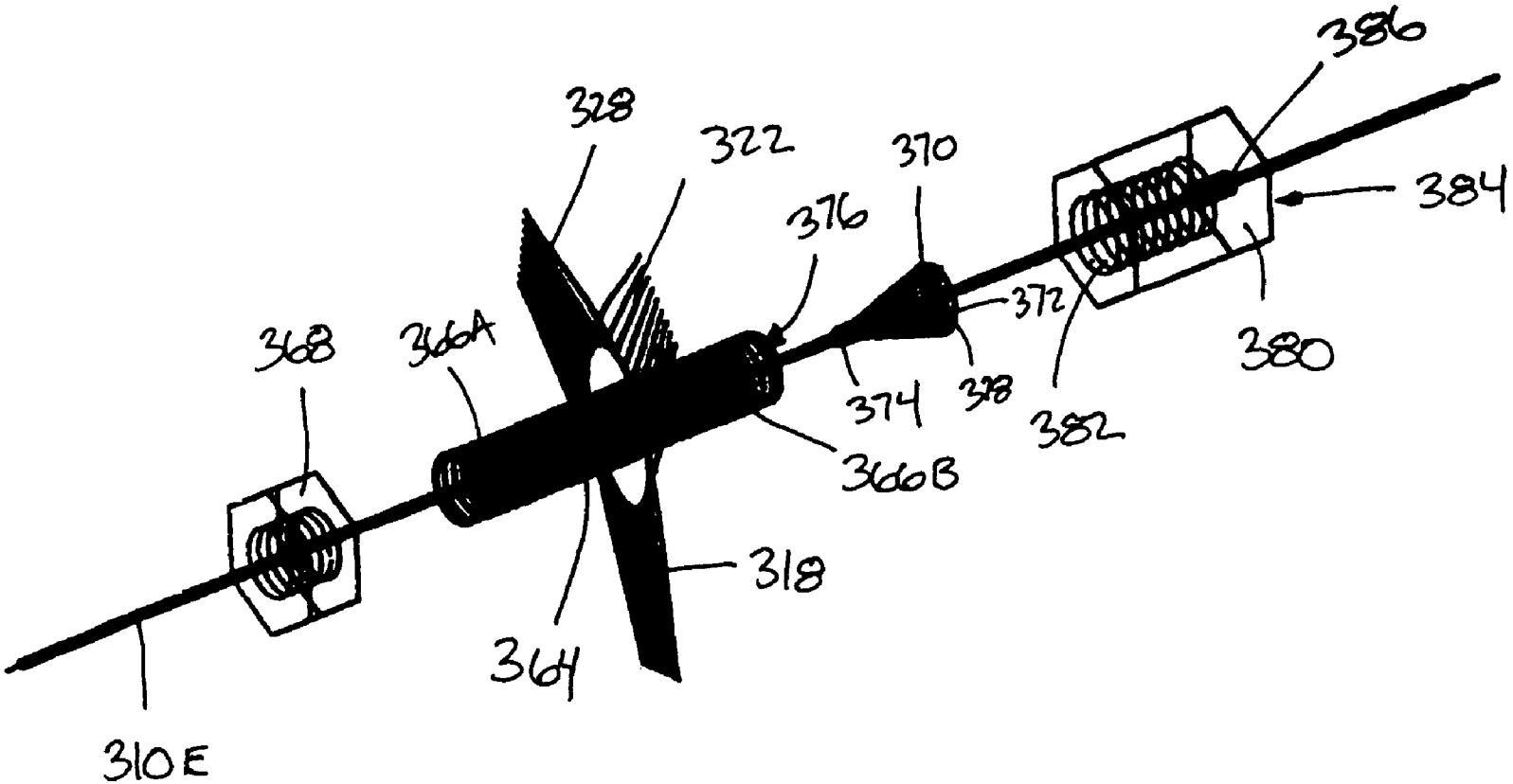
FIG. 31 shows an exploded view of a strut that pivotally connects the structural members of a support frame and secures an eaves or ridge attachment cable at a selected position.

Preferably, the rigid members are attached using a tube 364 positioned through the bore hole 350 or 352, and fastened at either end with threaded nuts, for example as shown in FIG. 31 and also previously described with reference to FIGS. 7 to 9.

Each of the rigid side support members 314, roof support member 320 and first link member 326, are made of rigid materials so that they can take both compression and tensile loading. The first and second tension members 332, 338 are made of material such as cable or rope which can not resist compression loading and can only take tension loads. Thus, generally the rigid members are in compression and either the first or second tension members are tension. Under a vertical downward loading, for example caused by rain or snow, the first tension members 332 are in tension. During a vertical up-lift load, for example caused by wind on the tent 300 and acting vertically upwards on the canopy 304, the second tension members 338 are in tension. During a lateral loading, for example caused by wind, either the first tension member 332 of a first support frame 308A and a second tension member 338 of a second support frame 308B are in tension or vice versa depending on the direction of the lateral loading.

Figure 25:
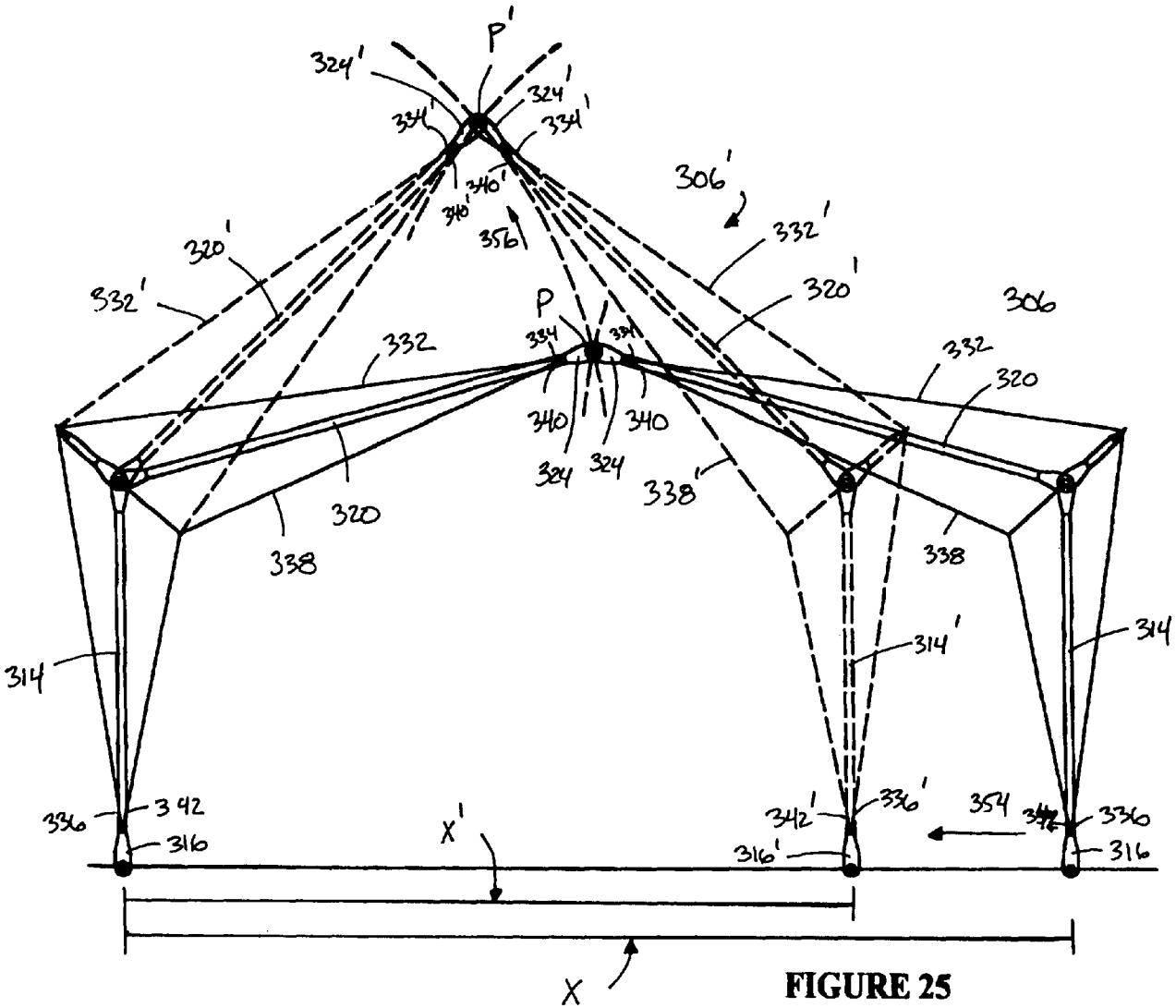
FIG. 25 shows a schematically the support truss of FIG. 24 illustrating the adjustability of the span, whereby a longer span is shown as X and a shorter span is shown as X'.

By the pivotal construction of the rigid members, the longitudinal span of the support truss 306A can be adjusted by changing the lengths of the first tension member 332 and second tension member 338. FIG. 25 shows the support truss 306 at a span X. Support truss 306' is shown in dashed lines and an adjusted shorter span X'. By moving side support 314 in the direction of arrow 354 parallel to a plane extending through the support 306, the pivotally coupled proximal member ends 324 are moved upwards in an arc in the direction of arrow 356 from position P to new position P'. To achieve the adjustment in span reduction from X to X', the respective first and second tension members, 332 and 338 respectively, are adjusted in length. To adjust the length of the first and second tension members, 332 and 338 respectively, the respective second member ends 336 and 342 of the respective first and second tension members 332 and 338, respectively, are detached from the lower end 316 and then reattached once the support truss 306 is moved to its new position 306'.

Figure 27:
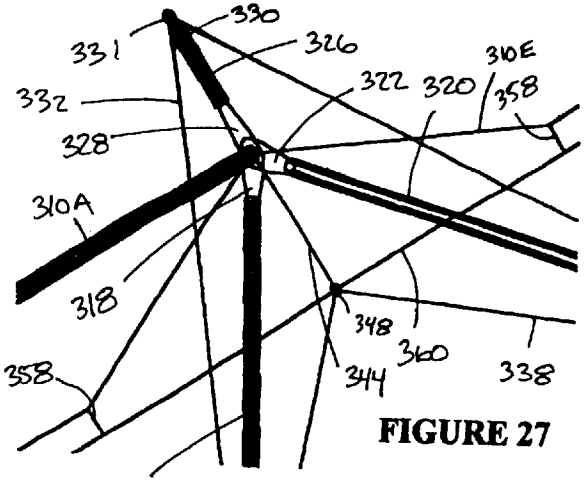
FIG. 27 shows a schematic perspective view an eaves joint of a respective support truss of a tent frame shown in FIG. 21.
Figure 26:
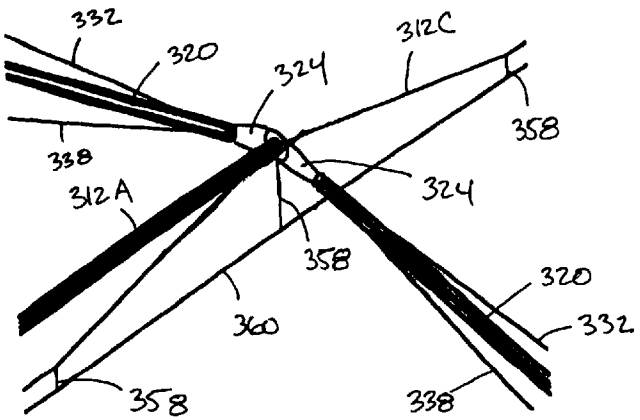
FIG. 26 shows a schematic perspective view of a ridge joint of a support truss of the tent frame shown in FIG. 21.
Figure 28:
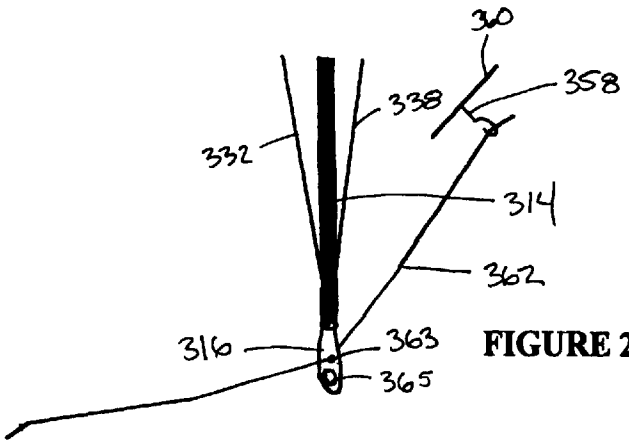
FIG. 28 shows a schematic perspective view of a respective base joint of a support truss of the tent shown in FIG. 21.

FIGS. 26, 27 and 28, show each of the ridge joint, eaves joint and base joint, respectively, in cut-away.

As shown in FIG. 26, the respective proximal ends 324 of each respective roof support member 320 are connected and have a rigid ridge attachment member 312A attached to the pivotal coupling, at one side, and a tensile ridge attachment member 312C attached to the other side. Also shown, hooks 358, which are fastened to a canopy lead 360, are positioned over the ridge attachment cable 312C to support the canopy thereon. As shown in FIG. 21, such hooks 358 may preferably be provided at approximately one third spacings of the distance between adjacent support trusses. However, it is appreciated that any number of hooks 358 can be provided at various spacings as may be required to provide adequate support to attach the canopy to the frame 304.

FIG. 27 shows the coupling of upper ends 318, distal end 322 and first end portion 328, with a rigid eaves attachment member 310A positioned at one side thereof and a tensile eaves attachment member 310E attached at the other side. Similar hooks 358 fixed to canopy leads 360 are positioned over the tensile eaves attachment member 310E to support the canopy thereon.

As shown in FIG. 28, a bore hole 365 is provided at the lower end 316 of side member 314. Bore hole 365 is provided to fix the side member 314 to the ground 302. A base canopy rope 362 is also proved to hold the canopy close to the ground 302. The canopy base cord 362 is fixed to the lower end 316 by threading the canopy base cord 362 through a hole 363 to form through the lower end 316, as shown.

Figure 29:
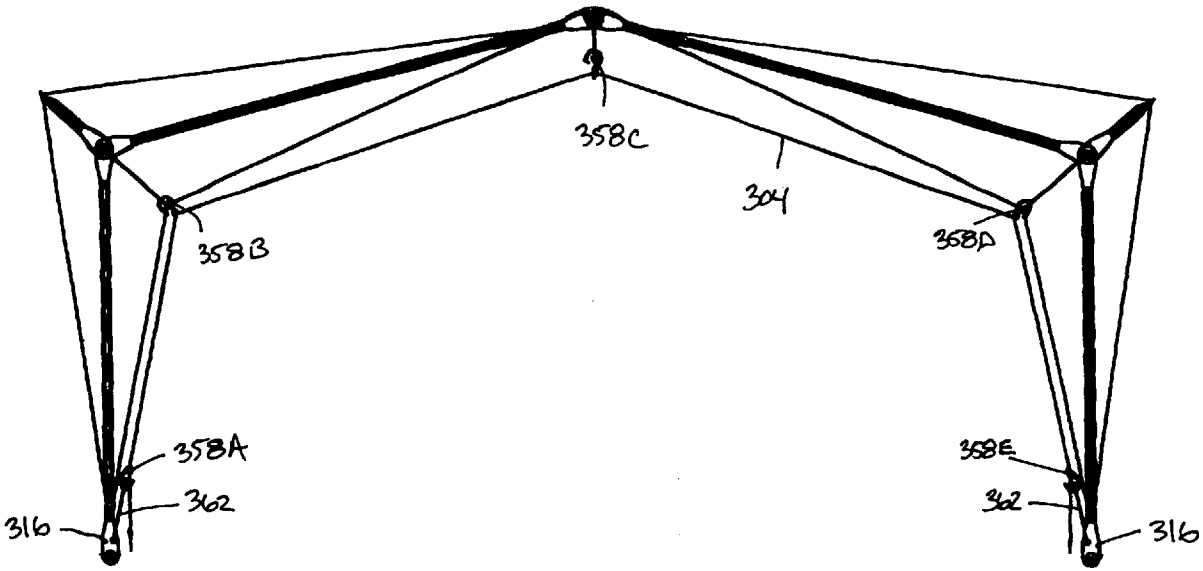
FIG. 29 shows a support truss of the tent shown in FIG. 21 from an end view with a canopy attached to the inside of the support truss.
Figure 30:
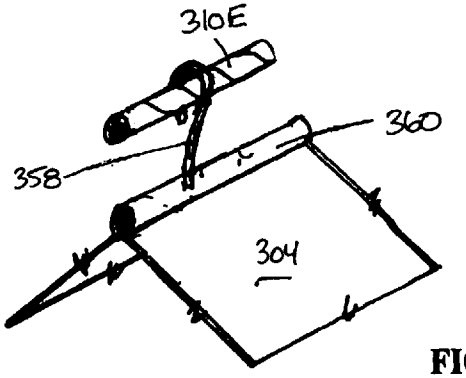
FIG. 30 shows a perspective view of the canopy attachment used to attach the canopy to a support truss as shown in FIG. 29 in cut-away.

FIGS. 29 and 30 show the canopy attachment in more detail.

FIG. 29 shows support truss 306C with the canopy 304 attached underneath. Five hooks 358A, 358B, 358C, 358D and 358E, are provided on the canopy to fix the canopy to the support truss 306C. As shown in FIG. 30, the hooks 358 have a body portion and a hook at one end thereof. The other end of the hook 358 is fixed to a cylindrical canopy lead 360. Preferably, the canopy lead 360 is a metal cable and the hook 358 is fixed to the canopy lead by drilling a hole therethrough, positioning the hook 358 through the hole and screwing a nut or other suitable mechanical fastener onto the hook 358. Alternatively, the end of the hook 358 which is fixed to the canopy lead 360 may comprise a C-shaped band as shown in FIGS. 11 and 12.

Hooks 358A and 358E are provided at a lower part of the canopy 304 and are hooked to lower end canopy attachment rings 362 which are fixed to the lower ends 316 of respective support frames 308 of the support truss 306C. To fix the lower end canopy attachment rings 362 to the lower end 316, a hole is drilled through the lower end 316 and the lower end canopy attachment ring 362 is positioned through the drilled hole. In a preferred embodiment, the lower end canopy attachment rings may be carabiner comprising a D-shaped ring with a spring catch at one side for ease of fixing to the lower end 316.

To fix support truss 306C at a longitudinal position on the rigid eaves attachment member 310E, a cable locking device similar to that shown in FIGS. 7 to 9 and 31 is used.

FIG. 31 shows a cable locking device in exploded view whereby a tube 364 has a first threaded end 366A and a second threaded end 366B. In a preferred embodiment, the tube 364 has threads along an entire length thereof. The upper end 318, the distal end 322 and the first end portion 328 are positioned on the tube 364 through the bore hole 350. A stop nut 368 is threaded onto the first threaded end 366A to prevent the upper end 318, distal end 322 and first end portion 328 from coming off the threaded end 366A. To lock the eaves attachment cable 310E, a slotted wedge 370 is positioned on the eaves attachment cable 310E proximate to the second threaded end 366B. A slotted wedge 370 is formed as one piece and has a larger diameter end 372 and a smaller diameter end 374. The slotted wedge 370 is substantially frusto conical in shape and is sized for fitted placement within an open end 376 of the threaded end 366B. The slotted wedge 370 has a bore hole extending through a longitudinal axis of the slotted wedge 370, the sizing of the diameter of the bore hole being slightly larger than a diameter of the eaves attachment cable 310E to provide a friction-fit slidable contact between the slotted wedge 370 and the eaves attachment cable 310E. The slotted wedge 372 has four slotted gaps 378 cut into the wedge 370 substantially perpendicular to a longitudinal axis of the slotted wedge 370 and approximately equidistant around the circumference of the larger diameter end 372. The number of slotted gaps 378 cut into the wedge 370 is at least one although any number of slotted gaps 378 could be provided.

As shown in FIG. 31, the slotted wedge 370 is positioned on the eaves attachment cable 310E with the smaller diameter end 374 facing the open end 376 of the threaded end 366B of the tube 364. The larger diameter end 372 has an outer diameter equal to or slightly greater than an inner diameter of the tube 364 so that, when the smaller diameter end 374 is positioned inside the open end 376, the larger diameter end is fitted into the opening 376 and the slotted gaps 378 are compressed and tighten the slotted wedge 370 on the eaves attachment cable 310E so that the eaves attachment cable 310E is held in gripping relation and thereby fixed and threaded end 366B of the tube 364. A pressure nut 380 is then fitted onto the threaded end 366B over the slotted wedge 370. The pressure nut 380 is an elongated nut, having an open end 382 and a closed end 384. A hole 386 is drilled through the closed end 384 and the hole 386 has a diameter slightly greater than a diameter of the eaves attachment cable 310E. The open end 382 has threads on the inside so as to be threadable secured onto the threaded end 366B of the tube 364 with the slotted wedge 370 remaining fitted inside the opening 376 in gripping relation with the eaves attachment cable 310E.

A similar arrangement is used to secure the proximal ends 324 of a ridge joint of respective support frames of support truss 306C, although not shown.

Figure 32:
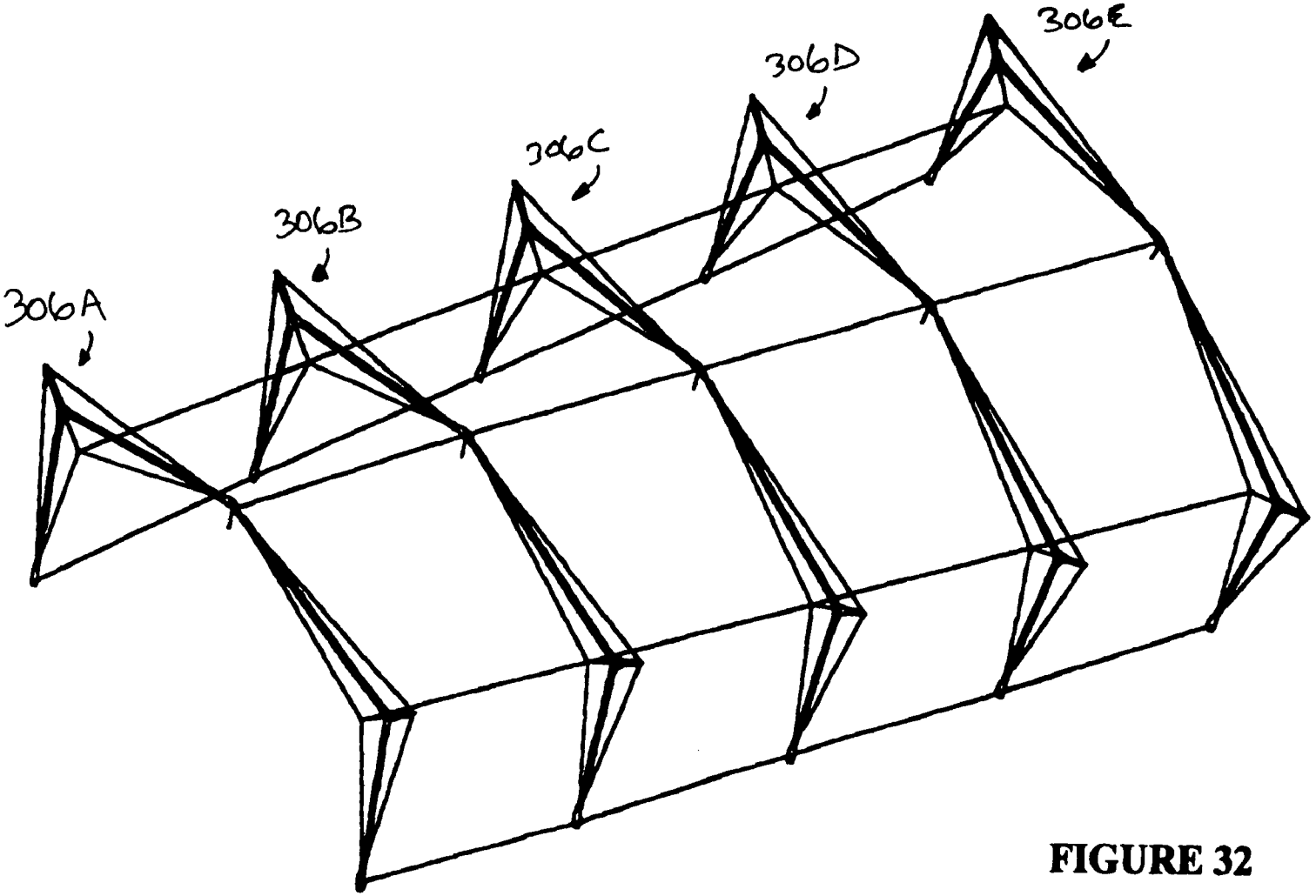
FIG. 32 shows a schematic perspective view of a tent which is set up on uneven ground in accordance with another embodiment of the present invention.

FIG. 32 shows the tent 300 erected on uneven ground whereby respective support trusses 306A, 306B, 306C, 306D and 306E are respectively inclined at 5° increments. Because of the pivotal coupling of the elements of rigid side and roof support members and the adjustability of the length of the first and second tension members, the tent 300 can be adjusted so that the side support members 314 are inclined to the vertical at an angle corresponding to the angle of the slope.

Figure 33:
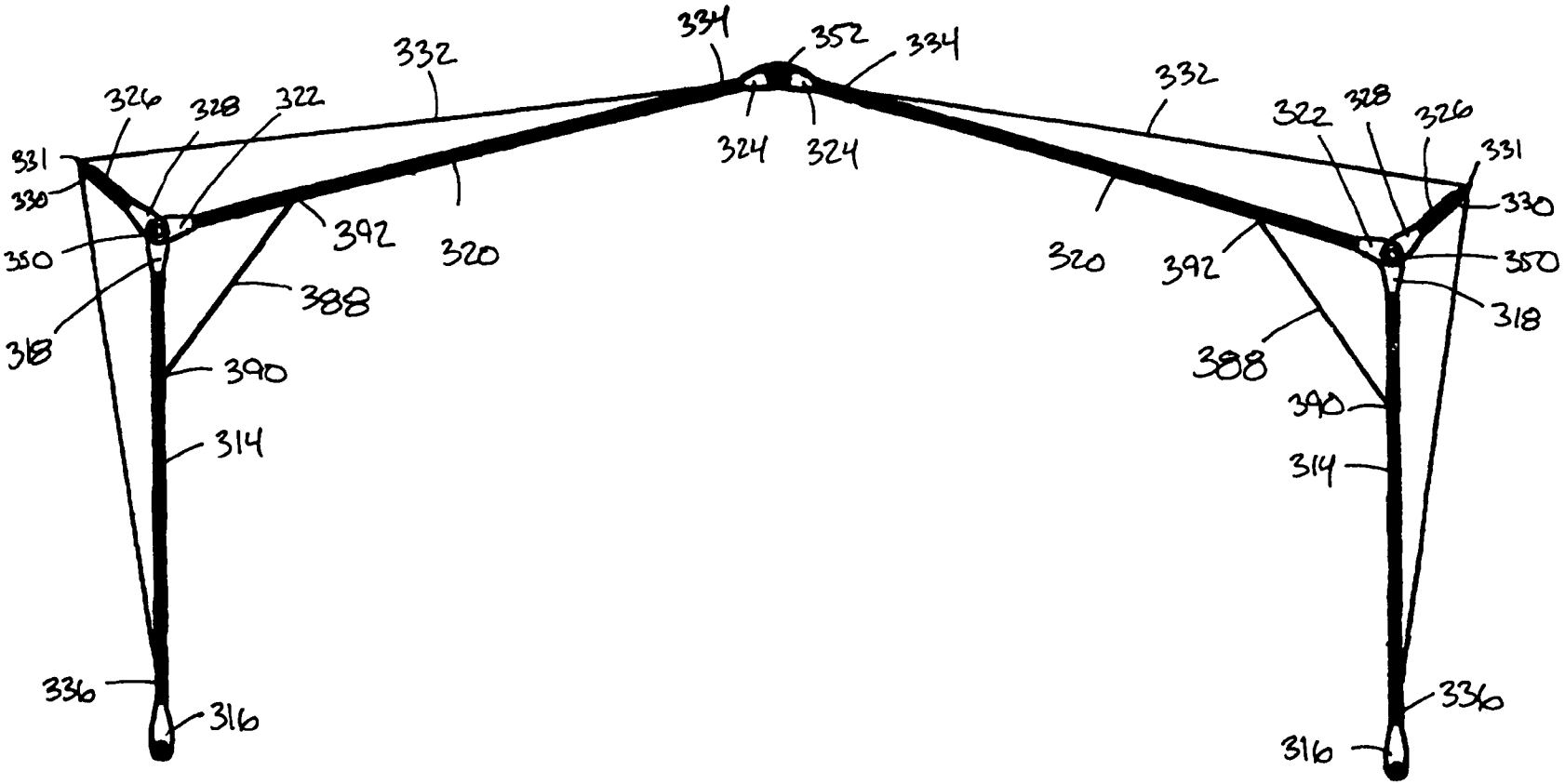
FIG. 33 shows a further simplified planar support truss in accordance with a further embodiment of the present invention.

FIG. 33 shows a more simplified construction of the planar support truss 306 without the second tension member 338 and second link member 344. Eaves bracing members 388 are provided proximate to the pivotal coupling of upper end 318, the distal end 322 and the second end portion 328 of the first rigid link member 326, as shown in FIG. 33. The eaves bracing members 388 have a lower bracing member end 390 fixed to the side support 314, and an upper bracing member end 392 fixed to the roof support member 320. The eaves bracing members 388, as shown in FIG. 33, are so positioned at the eaves of the tent frame so as to not interfere with the hanging canopy 304. The eaves bracing members 388 can be either rigid or tensile, and are provided to better stabilize the tent frame during uplift and/or lateral loading, for example caused by wind.

The simplified support truss 306 is otherwise identical to the support truss 306A shown in FIG. 24 and could be substituted in the tent shown in any of the previous Figures.

Furthermore, it is appreciated that the tent 300 could be sold as a kit merely having at least one eaves and ridge coupling joints. The side and roof support members and the tensile members could also be included with the kit, or preferably could be purchased separately, for example as aluminium poles or wood lumber, and the tensile members could also be purchased separately, for example as metal cable or synthetic rope.

Figure 34:
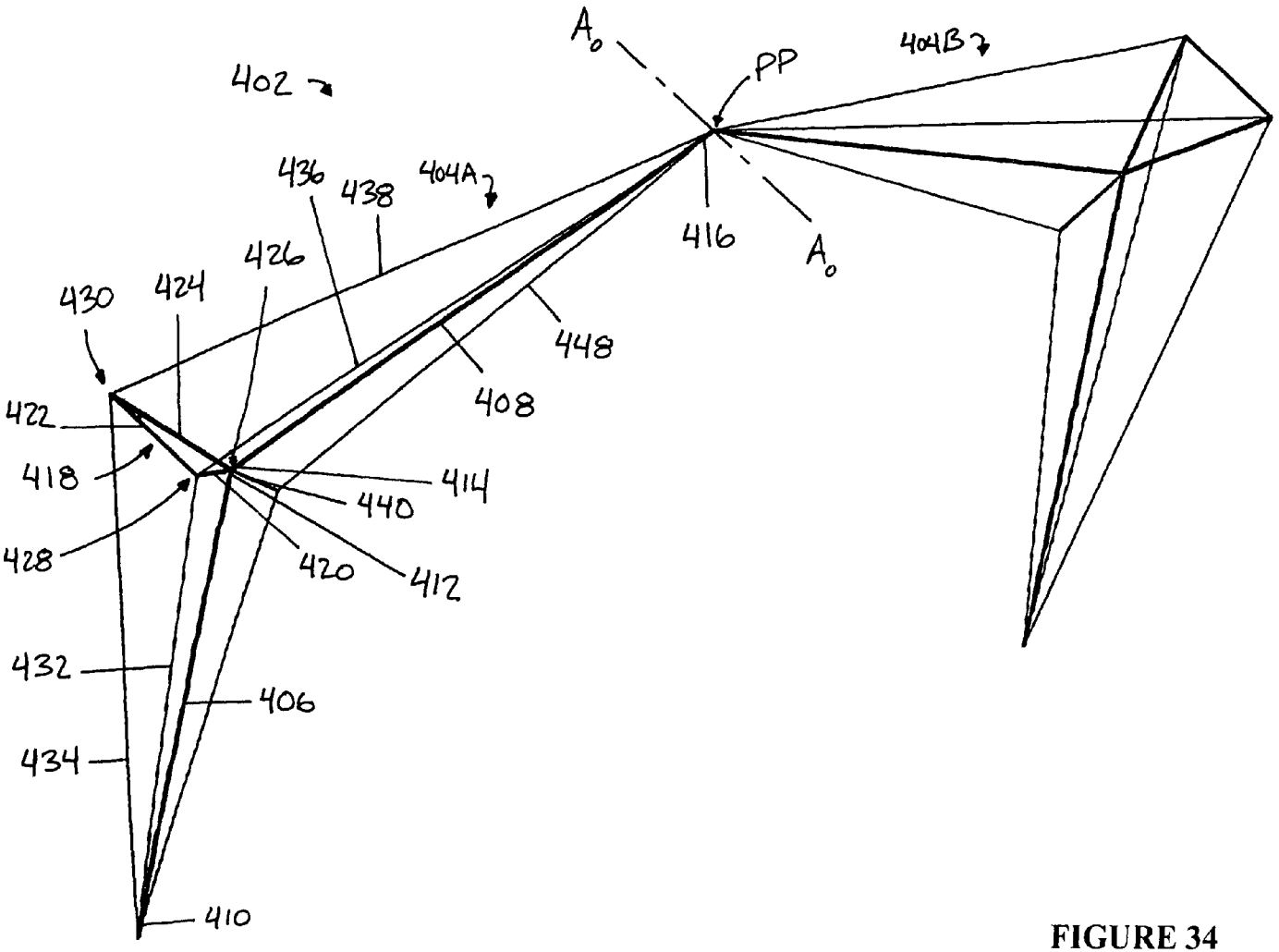
FIG. 34 shows a perspective view of a support truss in accordance with another embodiment of the present invention.

FIG. 34 shows perspective view of a support truss 402 comprising two support frames 404A, 404B. The support frames 404A, 404B are pivotally coupled to each other about a central pivot point PP. The support frames 404A, 404B are shown in FIG. 34 arranged in a substantially co-planar alignment in a plane orthogonal to an axis $A_O$, $A_O$.

By this construction, the support truss 402 is symmetrical about axis $A_O$, $A_O$. Each of the support frames 404A, 404B include a respective rigid side support member 406 and a rigid roof support member 408. The rigid side support member 406 and the rigid roof support member 408 are preferably made of metal or carbon-fibre material.

The rigid side support member 406 is elongated between a lower end 410 and an upper end 412. The rigid roof support member 408 is elongated between a distal end 414 and a proximal end 416.

Figure 35:
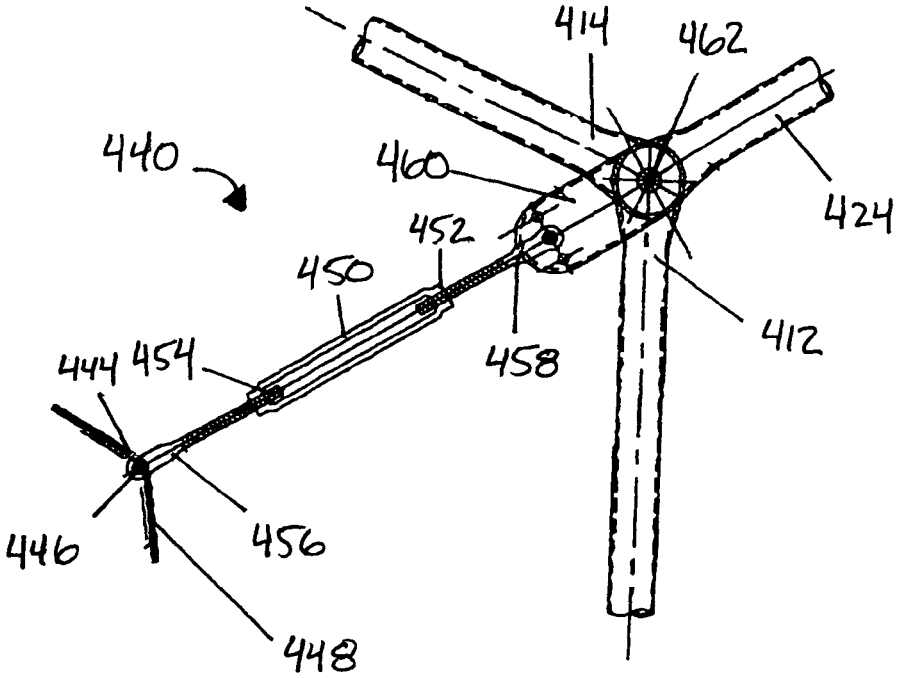
FIG. 35 shows a detailed cut away view of the pivotal coupling of the upper end of the side support member and the distal end of the roof support member of the support truss shown in FIG. 34.

The upper end 412 and the distal end 414 are pivotally coupled together as shown in detail in FIG. 35. As shown in FIG. 35, each of the upper end 412 and the distal end 414 are flattened and have a hole extending therethrough (not shown). A bolt and nut 462 are used to secure the upper end 412 and distal end 414 in pivotal arrangement. For example, the bolt is positioned through the respective holes of the upper end 412 and distal end 414, and then a nut is secured on a threaded end of the bolt. Other suitable mechanical fasteners can be used to achieve the pivotal coupling.

As shown in FIG. 34, each support frame 404A, 404B has a first or outer link member assembly 418. The outer link member assembly 418 has a first pole 420, a second pole 422 and a third pole 424 fixed together in a triangular configuration. The triangular configuration has a first corner 426, a second corner 428, and a third corner 430. As shown in FIG. 34, respective ends of the first pole 420 and the third pole 424, forming the first corner, are pivotally coupled to the upper end 412. Opposite ends of the first pole 420 and the third pole 424 are fixed to ends of the second pole 422, such that the second and third corners 428 and 430, respectively, are positioned outwardly from an obtuse angle side of the support frame 404A, 404B.

A first tension member 432 is fixed between the lower end 410 of the side support member 406 and the second corner 428 of the triangular link member assembly 418. A second tension member 434 is fixed between the lower end 410 and the third corner 430. A third tension member 436 is fixed between the proximal end 416 of the roof support member 408 and the second corner 428 of the triangular link member assembly 418. A fourth tension member 438 is fixed between the proximal end 416 and the third corner 430.

As shown in FIG. 35, a second or inside link member assembly 440 is coupled to a flattened end 460 of the third pole 424 proximate the pivotal coupling of the upper end 412 and the distal end 414. The second inside link member assembly 440 is similarly coupled to a flattened end of the first pole 420 (not shown) proximate to the pivotal coupling of the upper end 412 and the distal end 414. Preferably, the flattened ends of the first pole 420 and the third pole 424 have bore holes and the bolt and nut 462 are also used to pivotally secure the flattened ends.

A second end 444 of the inside link member assembly 440 is provided with an eyelet 446. An inside tension member 448 is positioned through the eyelet 446 and, as shown in FIG. 34, is fixed between the lower end 410 of the side support member 406 and the proximal end 416 of the roof support member 408.

As shown in detail in FIG. 35, the inside link member 440 is a turnbuckle. The turnbuckle 440 has a loop 450. The loop 450 has a first end 452 with a left-hand thread, and a second end 454 with a right-hand thread, or vice versa. The eyelet 446 is positioned at one end of a first threaded rod 456 which is screwed onto the second end 454. A second threaded rod 458 is screwed onto the first end 452. Accordingly, by rotating the loop 450 in either a clockwise or counter clockwise direction, when viewed from an end of the loop 450, the first and second ends 452 and 454 are screwed in or out of the loop 450, and a length of the turnbuckle 440 is adjusted.

The second threaded rod 458 is fixed to the flattened end 460, preferably using a bolt and nut.

Figure 36A:
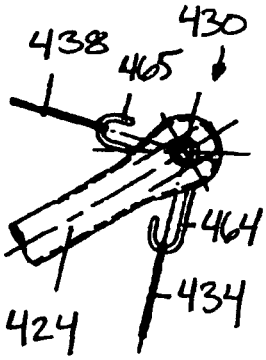
FIG. 36A shows a detailed cut away view of the third corner of the rigid link member of the support truss shown in FIG. 34.

FIG. 36A shows the third corner 430 of the triangular frame 418. As shown, the second tension member 434 has an end which is removably secured to a hook 464 which is fixed at the third corner 430. The fourth tension member 438 has an end which is removably secured to a hook 465 also fixed at the third corner 430. For example, ends of the second tension member 434 and the fourth tension member 438 have loops which are placed over the respective hooks 464, 465.

The second corner 428 has a similar configuration with hooks 464, 465 whereby ends of the first tension member 432, and the third tension member 436 have loops which are placed over the respective hooks 464, 465.

Figure 36B:
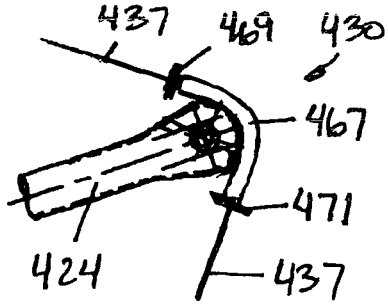
FIG. 36B shows a detailed cut away view of the third corner of the rigid link member in accordance with another embodiment of the present invention.

In another embodiment shown in FIG. 36B, the third corner 330 has a tension member deflector assembly comprising a bent hollow tube 467. In this embodiment, a single tension member 437 passes through and thereby deflects around the tube 467. As such, the single tension member 437 has a first end (not shown) which is fixed to the proximal end 416 of the roof support member 408 in the same manner as the fourth tension member 438, and a second end (not shown) which is fixed to the lower end 410 of the side support member 406 in the same manner as the second tension member 434.

As shown in FIG. 36B, a first stop device 469 is provided at an upper end of the deflector assembly or tube 467 and is clamped or fixed to the single tension member 437 to fix the tension member 467 in relation to the tube 467. Similarly, a second stop device 471 is provided at a lower end of the deflector assembly or tube 467 and is clamped or fixed to the single tension member 437 to fix the tension member 437 in relation to the tube 467. Preferably, the first and second stop devices 469, 471 are clamps which are fixed to the tension members at desired locations.

The second corner 428 (although not shown) has a similar configuration with a single tension member 437 deflected around a tension member deflector assembly 467 and clamped or fixed in relation thereto with first and second stop devices 469, 471. As such, the single tension member 437 has a first end (not shown) which is fixed to the proximal end 416 of the roof support member 408 in the same manner as the third tension member 436, and a second end (not shown) which is fixed to the lower end 410 of the side support member 406 in the same manner as the first tension member 432.

In another embodiment, the coupling of the upper end 412, the distal end 414, and the flattened ends of the first pole 420 and the third pole 424 shown in FIG. 35 is fixed from rotation so that the side support member 406, the roof support member 408, the first pole 420 and the third pole 424 are prevented from rotating in relation to each other. Such a fixed coupling is achieved, for example, by inserting a bolt having a multi faceted cross section through corresponding cross-sectional bores in the upper end 412, the distal end 414, and the flattened ends of the first pole 420 and the third pole 424. However, it is to be appreciated that other suitable means of fixing the coupling could be implemented such as welding.

In this embodiment, the respective second and third corners 428, 430 have tension member deflectors, such as the bent tube 467 shown in FIG. 36B and without the stop devices 469, 471. Accordingly, respective single tension members 437 can be used in place of the first and third tension members 432, 436, and the second and fourth tension members 434, 438, and the single tension members 437 are not fixed at the tension member deflector assembly 467.

Figure 37:
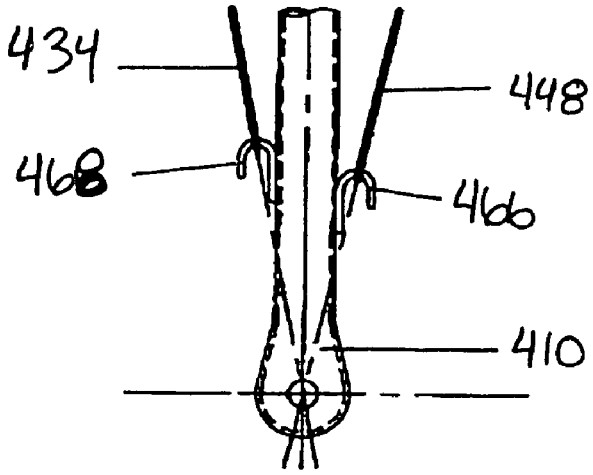
FIG. 37 shows a detailed cut away view of the lower end of the side support member of the support truss shown in FIG. 34.

As shown in FIG. 37, a fastening hook 466 is fixed to the inside of the lower end 410 of the side support member 406. The inside tension member 448 is removably secured to the hook 466 fixed to the inside of the lower end 410. Similarly, a fastening hook 468 is fixed to the outside of the lower end 410 of the side support member 406. The first and second tension members 432 and 434 are removably secured to the hook 468 fixed to the outside of the lower end 410.

Figure 38:
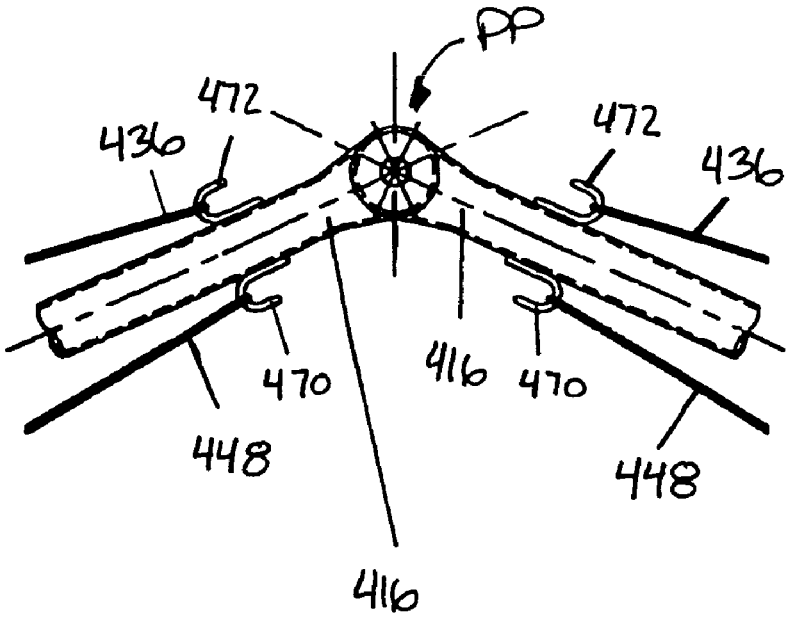
FIG. 38 shows a detailed cut away view of the pivotal coupling of the respective proximal ends of the support truss shown in FIG. 34.

FIG. 38 shows the pivotal coupling of the respective proximal ends 416 of the roof support members 408. A hook 470 is fixed at an inside position of each of the proximal ends 416. The inside tension member 448 is removably secured to the hook 470. A hook 472 is fixed at an outside position on each of the proximal ends 416. The third and fourth tension members 436, 438 are removably secured to the hook 472.

A span of the support truss 402 can be adjusted by moving respective lower ends 410 of support frames 404A, 404B closer or further away from one another. By moving the lower ends 410 closer to one another, the respective proximal ends 416 at pivot point PP move vertically upwards and a subtended angle between the side support member 406 and the roof support member 408, at an inside of the frame 404, remains unchanged. Conversely, by moving the lower ends 410 further away from one another, the respective proximal ends 416 at pivot point PP move vertically downwards and the subtended angle between the side support member 406 and the roof support member 408, at an inside of the frame 404, remains unchanged.

Figure 39:
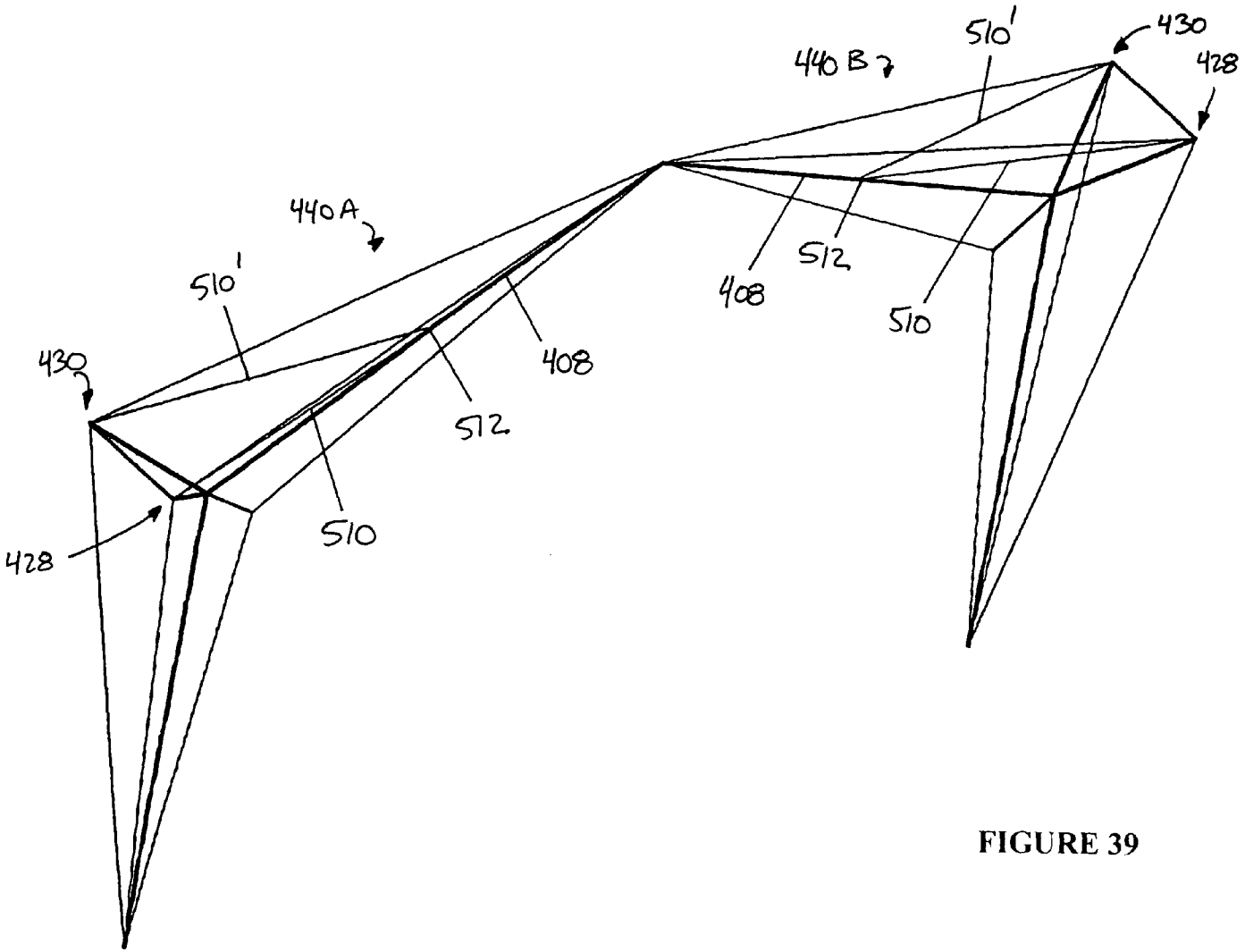
FIG. 39 a perspective view of the support truss shown in FIG. 34 with intermediate support cables in accordance with another embodiment of the present invention.

FIG. 39 shows a perspective view of the support truss shown in FIG. 34 with a first intermediate support cable 510, and a second intermediate support cable 510' on each support frame 404A, 404B.

The first intermediate support cable 510 is fixed between the second corner 428 and an attachment position 512 on the roof support member 408 of the first support frame 404A. The second intermediate support cable 510' is fixed between the third corner 430 and the attachment position 512 of the first support frame 404A.

The attachment position 512 is at a point approximately at a mid-point of a length of the roof support member 408.

The second support frame 404B similarly has a first intermediate support cable 510 fixed between the second corner 428 and an attachment position 512 of the roof support member 408. The second support frame 404B also has a second intermediate support cable 510' fixed between the third corner 430 and the attachment position 512 of the roof support member 408.

The intermediate support cables 510, 510' provide additional support to the roof support members 408 at the points of suspension of a hanging canopy or tarp (not shown). The bending stresses in the roof support members 408 are reduced or eliminated by the intermediate support cables 510, 510' when additional pick-up points are required to suspend a canopy or tarp.

Figure 40:
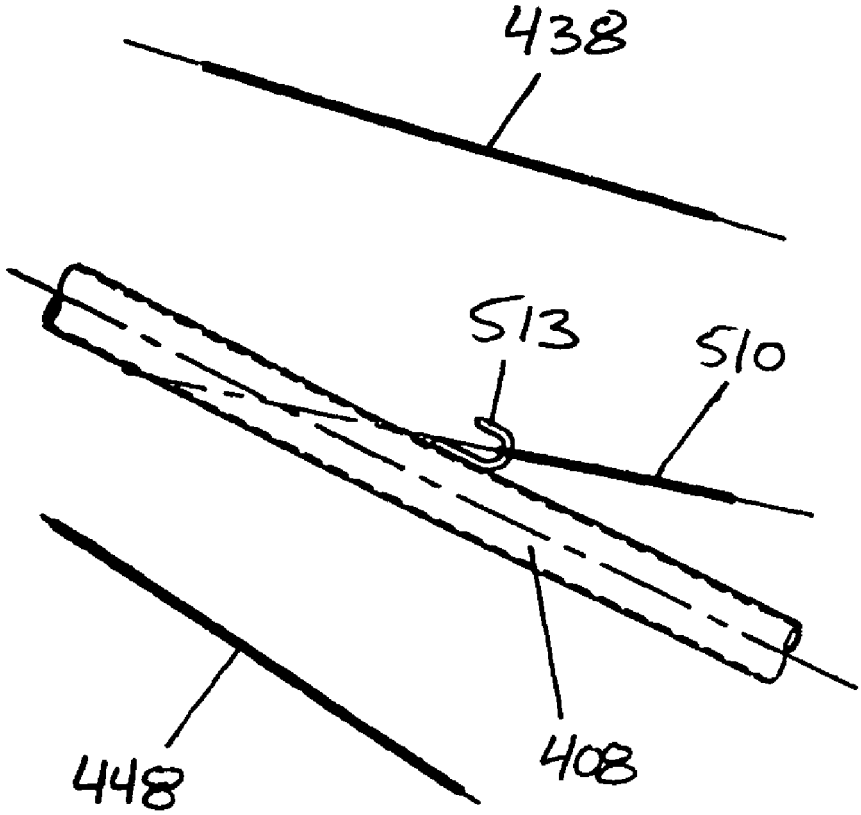
FIG. 40 shows a cut-away through the roof support member of the support truss shown in FIG. 39.

FIG. 40 shows a cut-away view of the roof support member 408 shown in FIG. 39. As shown, a hook 513 is fixed to the roof support member 408, and the intermediate support members 510 and 510' (not shown) are fixed to the hook 513.

Figure 41:
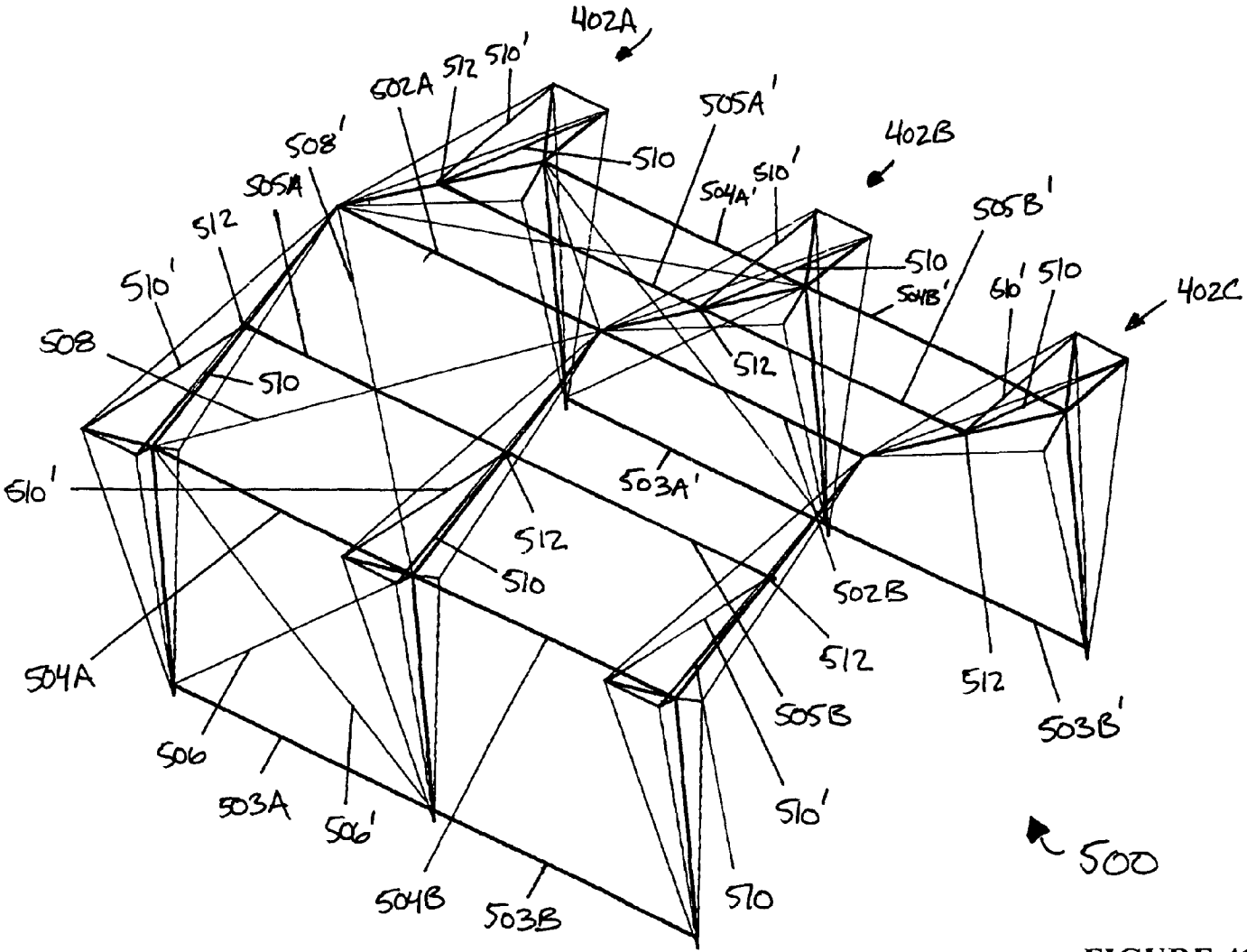
FIG. 41 shows a perspective view of a tent comprising three support trusses, as shown in FIG. 34.

FIG. 41 shows a perspective view of a tent 500 comprising three support trusses 402A, 402B and 402C, as shown in FIG. 39.

The first support truss 402A is connected to the second support truss 402B by a first ridge attachment member 502A attached to the respective support trusses proximate to the respective proximal ends 416 of the rigid roof support members 408.

The first support truss 402A is connected to the second support truss 402B by base attachment members 503A and 503A' which are attached to the respective support trusses proximate to the respective lower ends 410 of the rigid side support members 406.

The first support truss 402A is also connected to the second support truss 402B by first eaves attachment members 504A and 504A' which are attached to the respective support trusses proximate to the respective upper ends 412 of the rigid side support members 406.

In addition, the first support truss 402A is also connected to the second support truss 402B by first intermediate attachment members 505A and 505A' which are attached to the respective support trusses at approximately the mid point 512 of the respective roof support members 408.

Similarly, the second support truss 402B is connected to the third support truss 402C by a second ridge attachment member 502B attached to the respective support trusses proximate to the respective proximal ends 416 of the rigid roof support members 408.

The second support truss 402B is connected to the third support truss 402C by base attachment members 503B and 503B' which are attached to the respective support trusses proximate to the respective lower ends 410 of the rigid side support members 406.

The second support truss 402B is also connected to the third support truss 402C by second eaves attachment members 504B and 504B' which are attached to the respective support trusses proximate to the respective upper ends of the rigid side support members 406.

In addition, the second support truss 402B is also connected to the third support truss 402C by second intermediate attachment members 505B and 505B' which are attached to the respective support trusses at approximately the mid point 512 of the respective roof support members 408.

Where a canopy is attached at the inside of the tent, for example as shown in FIG. 21, the intermediate attachment members provide additional support to account for loading of the canopy, for example by accumulation of snow. A plurality of intermediate attachment members can be used with roof support members 408 having a longer length requiring additional stability.

As shown in FIG. 41, two side support cross bracing members 506 and 506' and two roof support cross bracing members 508 and 508' provide longitudinal stability to the tent 500.

The first side support cross bracing member 506 is fixed between the first support truss 402A proximate the lower end 410 of the side support member 406 and the second support truss 402B proximate the upper end 412 of the side support member 406. The second side support cross bracing member 506' is fixed between the first support truss 402A proximate the upper end 412 of the side support member 406 and the second support truss 402B proximate the lower end 410 of the side support member 406.

The first roof support cross bracing member 508 is fixed between the first support truss 402A proximate the distal end 414 of the roof support member 408 and the second support truss 402B proximate the proximal end 416 of the roof support member 408. The second roof support cross bracing member 508' is fixed between the first support truss 402A proximate the proximal end 416 of the roof support member 408 and the second support truss 402B proximate the distal end 414 of the roof support member 408.

Figure 42:
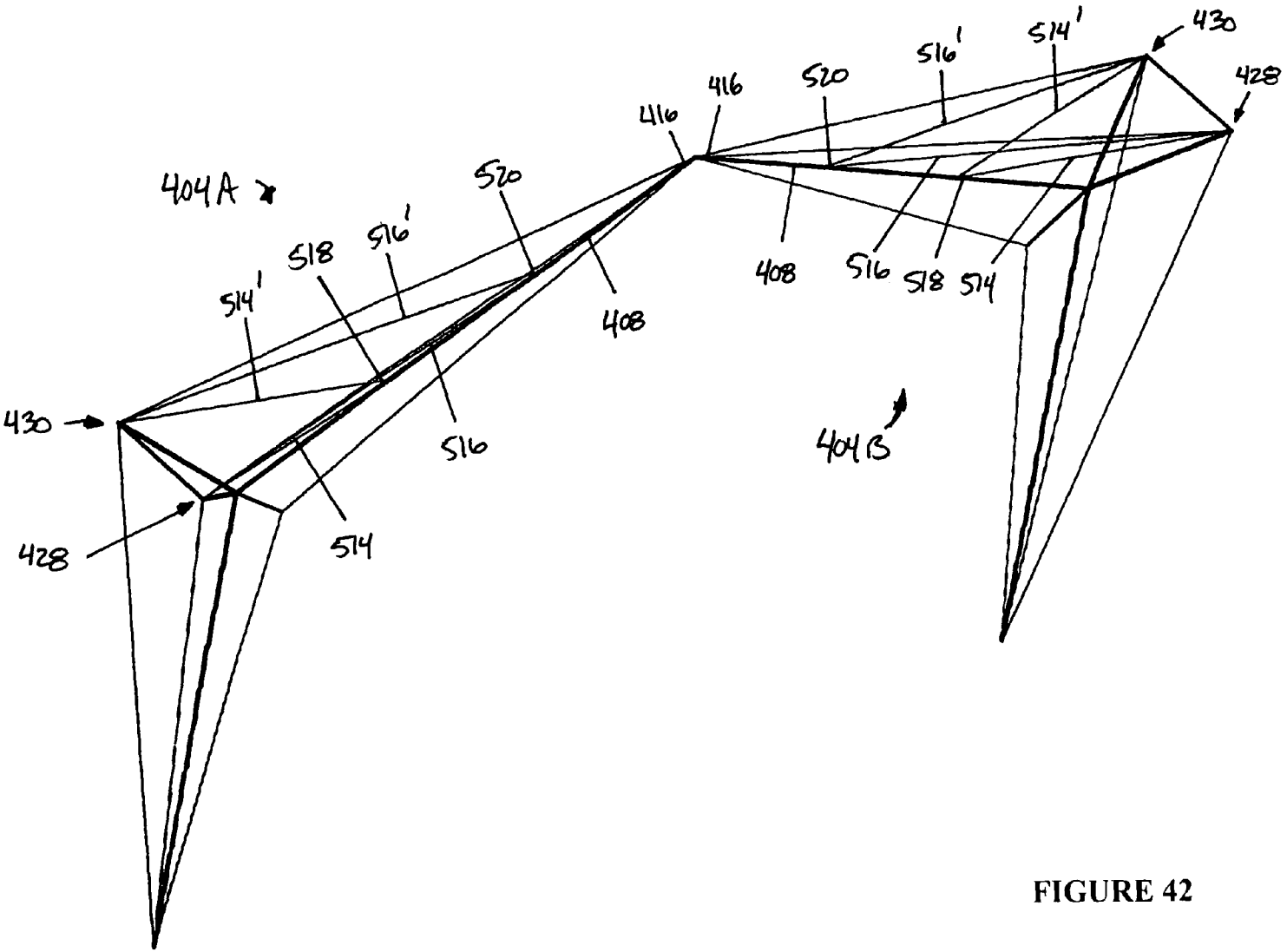
FIG. 42 shows a perspective view of the support truss shown in FIG. 34 additional with intermediate support cables in accordance with another embodiment of the present invention.

FIG. 42 shows a perspective view of the support trust shown in FIG. 34 with additional intermediate support cables 514, 514', 516, and 516'. The first intermediate support cable 514 is fixed between the second corner 428 and an attachment position 518 on the roof support number 408 of the first support frame 404A. The second intermediate support cable 514' is fixed between the third corner 430 and the attachment position 518.

Similarly, the third intermediate support cable 516 is attached between the second corner 428 and an attachment position 520 on the roof support member 408 of the first support frame 404A. The fourth intermediate support cable 516' is fixed between the third corner 430 and the attachment position 520 of the first support frame 404A.

The attachment positions 518 and 520 are spaced along a longitudinal length of the roof support member 408 such that the second attachment position 520 is at approximately ⅓ of the length of the support member 408 as measured from the proximal end 416. In particular, the first attachment position 518 is at a position on the roof support member 408 approximately ⅔ in length of roof support member 408 as measured from the proximal end 416. As such, the attachment positions are spaced substantially equidistant along the roof support member 408, and for example are points where a canopy or tarp is fixed to the roof support member 408. By this construction, the intermediate support cables 514, 514', 516, and 516' support the additional loading of the canopy.

Similarly, the intermediate support cables 514, 514', 516, and 516' are fixed to the second support frame 404B. The attachment positions 518 and 520 are similarly spaced as on support frame 404A.

Figure 43:
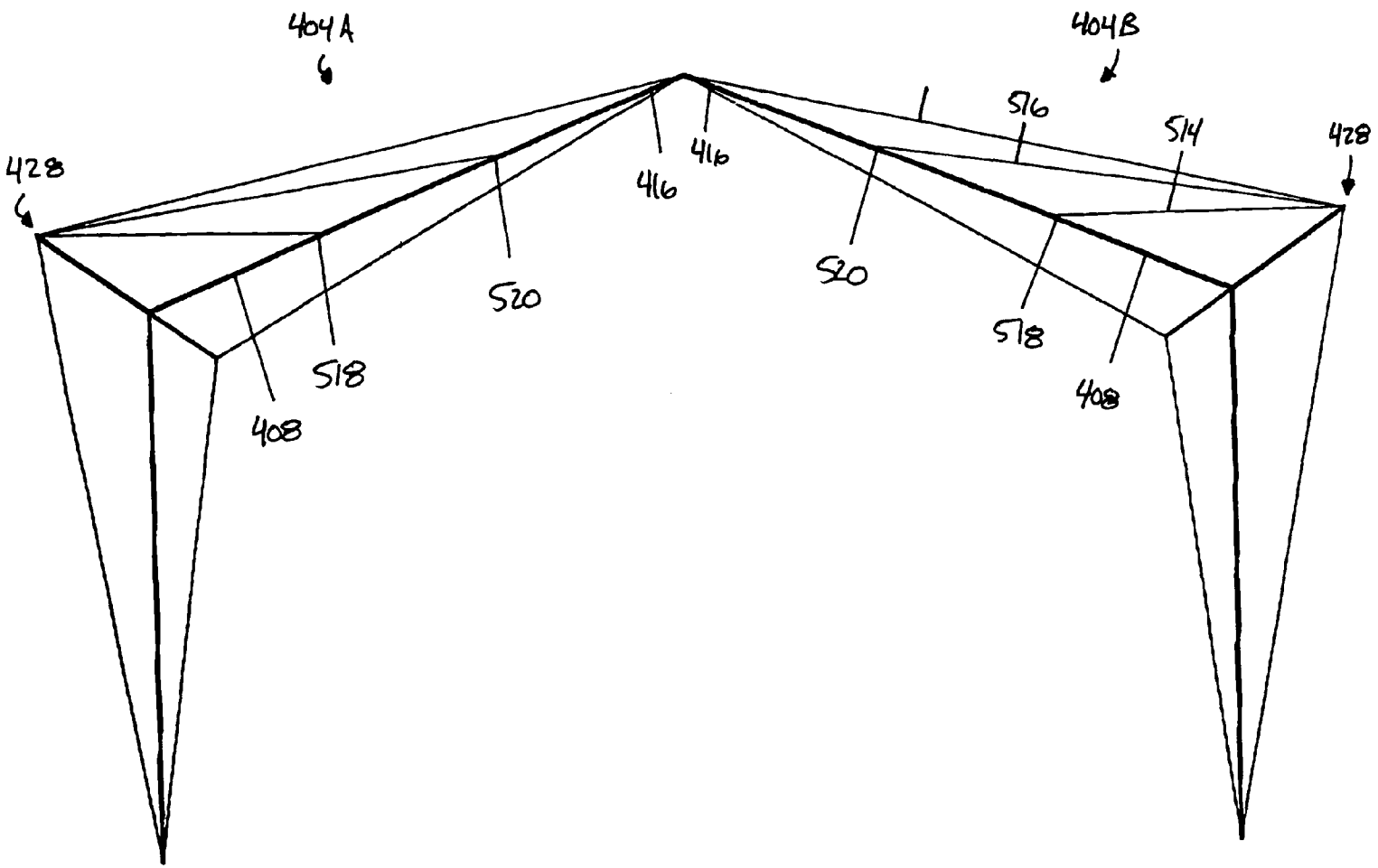
FIG. 43 shows the support truss shown in FIG. 42 from a side view.
Figure 44:
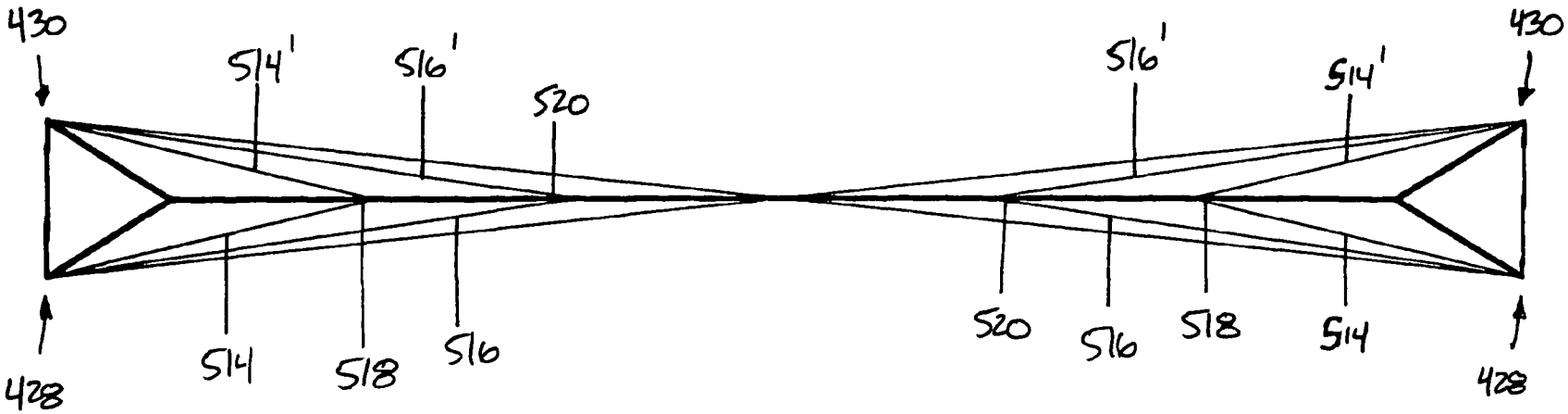
FIG. 44 shows the support truss shown in FIG. 42 from a top view.

FIG. 43 shows the tent frame of FIG. 42 in a side view, and FIG. 44 shows the support frame of FIG. 42 in plan view.

It is contemplated that more intermediate cables could be added and it is generally preferred that the support cables are attached to the roof support member 408 so as to spaced equidistant therealong.

Although this disclosure has described and illustrated certain preferred embodiments of the invention, it is also to be understood that the invention is not restricted to these particular embodiments. The invention includes all embodiments which are functional, or mechanical equivalents of the specific embodiments and features that have been described and illustrated herein. It will be understood that, although various features of the invention have been described with respect to one or another of the embodiments of the invention, the various features and embodiments of the invention may be combined or used in conjunction with other features and embodiments of the invention as described and illustrated herein.

The invention claimed is:

1. A tent frame comprising a support truss having at least one pair of connected support frames, each said support frame including:

a rigid side support member being elongated between a lower end and an upper end;

a rigid roof support member being elongated between a proximal end and a distal end;

an outside link member assembly elongated between a first end portion and a second end portion;

an inside link member assembly elongated between a first end portion and a second end portion, and each of the upper end, the distal end, and the first end portion of said outside link member assembly being coupled for pivotal movement relative to each other, and said first end portion of the inside link member assembly being fixed thereto, the second end portion of said outside link member assembly having an outside tension member deflector assembly positioned thereon, the second end portion of said inside link member assembly having an inside tension member deflector assembly positioned thereon, an outside tension member assembly having at least one cable having a first end and a second end, the first end being fixed to the proximal end of the roof support member, and the second end being removably fixed to the lower end of the side support member such that a portion of the outside tension member assembly is positioned on the outside tension member deflector assembly; and an inside tension member assembly having at least one cable having a first end and a second end, the first end being fixed to the proximal end of the roof support member, and the second end being removably fixed to the lower end of the side support member such that a portion of the inside tension member assembly is positioned on the second tension member deflector assembly;

wherein each of said pair of connected support frames is pivotally connected to each other proximate to each said proximal end, with the respective side and roof support members of each said support frame extending in a substantially co-planar alignment and wherein the outside link member assembly comprises a first rigid pole, a second rigid pole, and a third rigid pole, the three poles being fixed as a substantially triangular frame having a first corner, a second corner and a third corner, such that the first corner of the triangular frame is the first end portion of the outside tension member deflector assembly, and the second and third corners are the second end portion of the outside tension member deflector assembly.

2. The tent frame of claim 1 wherein the outside tension member assembly has at least one stop device which fixes the outside tension member assembly in relation to the outside tension member deflector assembly.

3. The tent frame of claim 1 wherein the pivotal coupling of the upper end, the distal end, and the first end portion of said outside link member assembly is fixed such that the side support member, the roof support member and the outside tension member assembly are prevented from rotating in relation to each other.

4. The tent frame of claim 1 wherein the outside tension member assembly has four cables, whereby a first tension member is fixed between the lower end of the side support member and the second corner of the triangular frame;

a second tension member is fixed between the lower end of the side support member and the third corner of the triangular frame;

a third tension member is fixed between the proximal end of the roof support member and the second corner of the triangular frame; and a fourth tension member is fixed between the proximal end of the roof support member and the third corner of the triangular frame.

5. The tent frame of claim 4, further comprising:

a first intermediate support cable fixed between the second corner and a position substantially equidistant between the proximal end and the distal end of the roof support member; and a second intermediate support cable fixed between the third corner and the position substantially equidistant between the proximal end and the distal end of the roof support member.

6. The tent frame of claim 4, further comprising:

a first intermediate support cable fixed between the second corner and a position on the roof support member that is substantially one-third of a length of the roof support member, as measured from the distal end;

a second intermediate support cable fixed between the third corner and the position substantially one-third of the length of the roof support member, as measured from the distal end;

a third intermediate support cable fixed between the second corner and a position substantially two thirds of the length of the roof support member, as measured from the distal end; and a fourth intermediate support cable fixed between the third corner and the position substantially two thirds of the length of the roof support member, as measured from the distal end.

7. The tent frame of claim 4, further comprising:

a first plurality of intermediate support cables, each of said first plurality of intermediate support cables being fixed between the second corner and an attachment position on the roof support member selected such that the respective attachment positions are spaced equidistant along a length of the roof support member; and a second plurality of intermediate support cables, each of said second plurality of intermediate support cables being fixed between the third corner and an attachment position on the roof support member selected such that the respective attachment positions are spaced equidistant along the length of the roof support member.

8. The tent frame of claim 7, wherein the first and second plurality of intermediate support cables have a same number of cables.

9. The tent frame of claim 1, wherein the inside tension member deflector assembly is a turnbuckle, the turnbuckle having an adjustable length.

10. A tent frame comprising at least one support frame, each said support frame including:

a rigid side support member being elongated between a lower end and an upper end;

a rigid roof support member being elongated between a proximal end and a distal end;

a first link member assembly comprising a first rigid pole, a second rigid pole and a third rigid pole fixed as a substantially triangular frame having a first corner, a second corner and a third corner;

a second adjustable link member being elongated between a first end and a second end;

the first corner of the triangular frame and the first end are pivotally coupled to each of the upper end and the distal end, and the side support member and the roof support member are positioned at an angle to each other such that the support frame has an inner angle side and an outer angle side;

the second corner and the third corner of the triangular frame are positioned outwardly from the outer angle side;

the second end being positioned outwardly from the inner angle side and has a tension member deflector positioned thereon;

a first tension member fixed between the lower end of the side support member and the second corner of the triangular frame;

a second tension member fixed between the lower end of the side support member and the third corner of the triangular frame;

a third tension member fixed between the proximal end of the roof support member and the second corner of the triangular frame;

a fourth tension member fixed between the proximal end of the roof support member and the third corner of the triangular frame; and an inside tension member fixed between the proximal end of the roof support member and the lower end of the side support member such that a portion of the inside tension member is position positioned on the tension member deflector.

11. The tent frame as claimed in claim 10, wherein the tension member deflector comprises a turnbuckle having a through hole in one end such that the inner tension member is positioned through the through hole, and the turnbuckle is adjustable in length to selectively tension the first, second, third and fourth tension members and the inside tension member.

12. The tent frame according to claim 11, wherein the second corner has a second corner hook assembly having at least one hook fixed thereto, and the third corner has a third corner hook assembly having at least one hook fixed thereto, the first and third tension members being fixed to the second corner hook assembly, and the second and fourth tension members being fixed to the third corner hook assembly.

13. The tent frame according to claim 12, further comprising a first hook fixed to the lower end of the side support member on the outer angle side and the first and second tension members are removably connected to the first hook;

a second hook fixed to the proximal end of the roof support member on the outer angle side and the third and fourth tension members are removably connected to the second hook;

a third hook fixed to the lower end of the side support member on the inner angle side and the inside tension member is removably connected to the third hook; and a fourth hook fixed to the proximal end of the roof support member on the inner angle side and the inside tension member is removably connected to the fourth hook.

14. The tent frame of claim 10, further comprising:

a first intermediate support cable fixed between the second corner and a position substantially equidistant between the proximal end and the distal end of the roof support member; and a second intermediate support cable fixed between the third corner and the position substantially equidistant between the proximal end and the distal end of the roof support member.

15. The tent frame of claim 10, further comprising:

a first intermediate support cable fixed between the second corner and a position on the roof support member that is substantially one-third of a length of the roof support member, as measured from the distal end;

a second intermediate support cable fixed between the third corner and the position substantially one-third of the length of the roof support member, as measured from the distal end;

a third intermediate support cable fixed between the second corner and a position substantially two thirds of the length of the roof support member, as measured from the distal end; and a fourth intermediate support cable fixed between the third corner and the position substantially two thirds of the length of the roof support member, as measured from the distal end.

16. The tent frame of claim 10, further comprising:

a first plurality of intermediate support cables, each of said first plurality of intermediate support cables being fixed between the second corner and an attachment position on the roof support member selected such that the respective attachment positions are spaced equidistant along the roof support member; and a second plurality of intermediate support cables, each of said second plurality of intermediate support cables being fixed between the third corner and an attachment position on the roof support member selected such that the respective attachment positions are spaced equidistant along the roof support member.

17. The tent frame of claim 16, wherein the first and second plurality of intermediate support cables have a same number of cables.

18. The tent frame of claim 10, wherein the inside tension member deflector assembly is a turnbuckle, the turnbuckle having an adjustable length.

19. The tent frame according to claim 10, wherein each of said side support and roof support members have a substantially equal longitudinal length.

20. The tent frame according to claim 10, wherein the roof support member has a longitudinal length which is longer than a longitudinal length of the side support member.

21. The tent frame according to claim 10, wherein a canopy is attached to the roof support proximate at each of the proximal end and the distal end of said roof support member.

22. The tent frame according to claim 21, wherein the canopy is also attached to the roof support at least one additional position between the proximal end and the distal end.

23. The tent frame of claim 21, wherein said canopy is attached by at least one canopy attachment having a body portion with a hook on a first end thereof, said hook being engagable with said roof support member, and a second end of the canopy attachment being fixed to the canopy.

24. The tent frame of claim 10, wherein the tent frame comprises a plurality of said support frames, a selected one of said plurality of support frames being pivotally coupled to an adjacent one of said plurality of support frames by a ridge attachment member, said ridge attachment member being a rigid elongated member, a first end portion of said ridge attachment member engaging said selected one of said plurality of support frames proximate to the proximal end of said roof support member of said selected one of said plurality of support frames, and a second end portion of said ridge attachment member engaging said adjacent one of said plurality of support frames proximate to the proximal end of said roof support member of said adjacent one of said support frames.

25. The tent frame of claim 24, wherein said selected one of said plurality of support frames and said adjacent one of said plurality of support frames are further pivotally coupled together by an eaves attachment member, said eaves attachment member being a rigid elongated member, a first end portion of said eaves attachment member pivotally engaging said one of said plurality of support frames proximate to each of the upper end of said side support member and the distal end of said roof support member of said selected one of said plurality of support frames, and a second end portion of said eaves attachment member pivotally engaging said adjacent one of said plurality of support frames proximate to each of the upper end of said side support member and the distal end of said roof support member of said adjacent one of said plurality of support frames.

26. The tent frame of claim 25, wherein said selected one of said plurality of support frames and said adjacent one of said plurality of support frames are further pivotally coupled together by a base attachment member, said base attachment member being a rigid elongated member, a first end portion of said base attachment member pivotally engaging said one of said plurality of support frames proximate to the lower end of said side support member of said selected one of said plurality of support frames, and a second end portion of said base attachment member pivotally engaging said adjacent one of said plurality of support frames proximate to the lower end of said side support member of said adjacent one of said plurality of support frames.

27. The tent frame of claim 26, wherein said selected one of said plurality of support frames and said adjacent one of said plurality of support frames are further pivotally coupled together by at least one intermediate attachment member, said at least one intermediate attachment member being a rigid elongated member, a first end portion of said at least one intermediate attachment member engaging said one of said plurality of support frames at an attachment position on the roof support member of said selected one of said plurality of support frames, and a second end portion of said at least one intermediate attachment member engaging said adjacent one of said plurality of support frames at an attachment position on the roof support member of said adjacent one of said plurality of support frames.

28. The tent frame of claim 27, wherein the attachment position on the respective roof support members is substantially equidistant between the distal end and the proximal end.

29. The tent frame of claim 27, wherein there are a plurality of intermediate attachment members, and the attachment positions of each of the intermediate attachment members are spaced such that the intermediate attachment members are spaced substantially equidistant along a length of the respective roof support members.

* * * * *